US012528023B2

(12) United States Patent
Matos

(10) Patent No.: US 12,528,023 B2
(45) Date of Patent: Jan. 20, 2026

(54) COMBINATION ARTICLES OF ENTERTAINMENT COMPRISING COMPLEMENTARY ACTION FIGURE AND RECONFIGURABLE CASE THEREFOR

(71) Applicant: COMBAT SENSEI, LLC, North Bergen, NJ (US)

(72) Inventor: Eduardo Matos, North Bergen, NJ (US)

(73) Assignee: COMBAT SENSEI, LLC, North Bergen, NJ (US)

( * ) Notice: Subject to any disclaimer, the term of this patent is extended or adjusted under 35 U.S.C. 154(b) by 164 days.

(21) Appl. No.: 16/056,080

(22) Filed: Aug. 6, 2018

(65) Prior Publication Data

US 2019/0038983 A1 Feb. 7, 2019

Related U.S. Application Data

(60) Provisional application No. 62/541,361, filed on Aug. 4, 2017.

(51) Int. Cl.
*A63H 3/10* (2006.01)
*A63H 3/16* (2006.01)
(Continued)

(52) U.S. Cl.
CPC ..... *A63H 3/10* (2013.01); *A63H 3/16* (2013.01); *A63H 3/46* (2013.01); *A63H 3/50* (2013.01);
(Continued)

(58) Field of Classification Search
CPC ... A63H 3/46; A63H 3/50; A63H 3/28; A63H 3/10; A63H 3/08; A63H 3/16; A63H 5/00; A63H 2200/00; A63H 33/26; A63H 13/16; A63H 33/00; A63H 33/38; A63H 33/42; A63H 33/003; B65D 43/16; B65D 43/163; B65D 43/166; B65D 43/167; E05Y 2900/602; A63F 3/00173; A63F 3/00261
(Continued)

(56) References Cited

U.S. PATENT DOCUMENTS 243,873 A * 7/1881 Crandall et al. ..... A63H 33/00 446/478
2,084,912 A * 6/1937 Klep ..... A63F 3/027 206/265
(Continued)

FOREIGN PATENT DOCUMENTS

WO WO-03035205 A1 * 5/2003 ..... A63H 3/52
WO WO-2011132796 A1 * 10/2011 ..... A63F 9/04

OTHER PUBLICATIONS

Ruf Translation All Pages , 2003.*
Translation WO2011/132796A1 (Year: 2011).*

*Primary Examiner* — Eugene L Kim
*Assistant Examiner* — Alyssa M Hylinski
(74) *Attorney, Agent, or Firm* — Venable LLP

(57) ABSTRACT

Articles combining an action figure and complementary reconfigurable case therefore. Examples include low profile action figures and complementary low profile cases which include connected panels which are designed to permit reconfiguration from a closed configuration to at least one open configuration. In various embodiments aspect, the cases and action figures include surfaces configured for engagement of complementary accessories.

16 Claims, 36 Drawing Sheets

(51) Int. Cl.

| | |
|---|---|
| ***A63H 3/46*** | (2006.01) |
| ***A63H 3/50*** | (2006.01) |
| ***A63H 5/00*** | (2006.01) |
| ***A63H 33/00*** | (2006.01) |
| *A63H 3/28* | (2006.01) |
| *A63H 33/26* | (2006.01) |

(52) U.S. Cl.
CPC ..... *A63H 5/00* (2013.01); *A63H 33/003* (2013.01); *A63H 3/28* (2013.01); *A63H 33/26* (2013.01); *A63H 2200/00* (2013.01)

(58) Field of Classification Search
USPC ..... 446/297
See application file for complete search history.

(56) References Cited

U.S. PATENT DOCUMENTS 3,418,746 A * 12/1968 Kharasch ..... A63H 3/50 446/83
4,027,425 A * 6/1977 Morrison ..... A63H 11/00 446/299
4,165,579 A * 8/1979 Chase ..... A63H 3/52 446/73
4,275,887 A * 6/1981 Tateyama ..... A63F 3/00533 273/284
4,575,348 A * 3/1986 Wiggs ..... A63H 13/16 446/330
5,013,278 A * 5/1991 Dixon ..... A63H 3/50 446/219
5,152,710 A * 10/1992 Montgomery ..... A63H 3/52 220/4.23
5,317,823 A * 6/1994 Brunt, II ..... G09F 1/08 40/539
5,403,223 A * 4/1995 Gaulkin ..... A63H 3/46 446/219
5,542,870 A * 8/1996 Westersund ..... A63H 33/42 446/478
5,855,499 A * 1/1999 Yamazaki ..... A63H 3/50 446/268
6,022,259 A * 2/2000 Rudawsky ..... A63H 3/52 446/901
6,203,017 B1 * 3/2001 Schultz ..... A63F 3/0023 273/287
6,352,321 B1 * 3/2002 Munoz ..... A47F 3/00 312/119
6,572,436 B1 * 6/2003 So ..... A63H 17/44 446/478
6,796,561 B2 * 9/2004 Bedford ..... A63F 3/0023 273/262
7,008,289 B2 * 3/2006 Norman ..... A63H 3/18 446/308
7,892,068 B2 * 2/2011 Nuttall ..... A63H 18/026 446/478
8,328,596 B2 * 12/2012 Payne ..... A63H 33/42 446/72
8,777,690 B2 * 7/2014 Zhou ..... A63H 3/52 446/478
9,919,234 B1 * 3/2018 Powell ..... A63H 3/00
2002/0077017 A1 * 6/2002 Lenkoff ..... A63H 33/26 446/73
2002/0182973 A1 * 12/2002 Avital ..... A63J 19/00 281/15.1
2005/0153625 A1 * 7/2005 Wigo ..... A63H 33/42 446/268
2006/0096873 A1 * 5/2006 Fromm ..... B42D 1/00 206/223
2007/0117494 A1 * 5/2007 Sheller ..... A63H 13/18 446/309
2011/0133441 A1 * 6/2011 Kaufman ..... A63H 33/38 281/38
2013/0090034 A1 * 4/2013 Pruzansky ..... A63H 3/08 446/72
2016/0176218 A1 * 6/2016 McCafferty ..... A63H 33/38 40/124.08
2016/0310836 A1 * 10/2016 Maharaj ..... A63J 19/00
2017/0076343 A1 * 3/2017 Bernstein ..... A47F 5/0025

* cited by examiner

COMBINATION ARTICLES OF ENTERTAINMENT COMPRISING COMPLEMENTARY ACTION FIGURE AND RECONFIGURABLE CASE THEREFOR

BACKGROUND

Action figures are familiar articles of entertainment popular with children, hobbyists, and collectors. Marketed since at least the mid-1960s, action figures are typically scale representations of popular fictional characters or conveyances, such as those copyrighted and distributed by Marvel Entertainment, DC Comics, Disney, Saban Brands, and Nickelodeon. Action figures or miniatures are also employed in the wargame genre, in which players simulate battle using physical representations of historical or fantastical soldiers.

More recently, games developers have begun to incorporate near field communication-, RFID-, or image recognition data protocol-compatible action figures into software-based video games. This gaming genre, referred to as "toys-to-life," allows players to collect action figures with various gameplay attributes. When placed on or connected to a "portal" device accompanying the game, the corresponding character becomes available for gameplay. Popular examples of the toys-to-life gaming genre include the Skylanders™ franchise and Nintendo's Amiibo™ platform.

Action figures have also been marketed for use with what can be referred to as environmental accessories, including dollhouses and vehicles, as well as personal (as such) accessories, such as weapons and articles of clothing. Popular in their own right, these accessories often complement their associated action figures to provide greater immersion and interactivity.

Another, generally separate category of collectibles is typified by trading cards. Dating back to the late 19$^{th}$ century, trading cards are well-known and popular among children, hobbyists, and collectors. Typically, trading cards are relatively small, flat, rectangular cards made from card stock, and generally include a representation of a person or character of interest printed on a front surface and information about the person or character of interest printed on the opposite surface.

In the early 1990s, trading card-based games emerged in which players acquire a personal collection of cards that are used to challenge other players in strategic matches. By permitting collection and curation of players' decks, these games incorporate elements of strategy and variety not provided in conventional or gambling card games such as poker and bridge. The most popular of these games include Magic: The Gathering™, published by Wizards of the Coast, and Pokémon™, distributed by The Pokémon Company.

By virtue of their flatness and shallow profile, trading cards are relatively portable and convenient to store while also providing surfaces for printed information. Action figures and related accessories, in contrast, are less convenient to store and transport and do not readily permit conveyance of information, but provide greater tactile interest and interactivity.

Inventive articles of entertainment combining the low profile, illustration and information provided by trading cards and such with the interactivity and immersivity of action figures and related accessories would provide greater interest and enjoyment than currently available products, whether as toys, collectibles, or components of a gaming system. Despite their relative advantages and shortcomings, however, and notwithstanding their longevity and popularity, no product to date is believed to have combined various aspects of trading cards, action figures, and accessories therefore into integrated articles of entertainment as described herein.

SUMMARY

A general object of the present disclosure is to combine various appealing aspects of trading cards with those of action figures and related accessories. A further object of the present disclosure is to provide articles of entertainment which offer greater interest, enjoyment in use, and functionality than those currently available. These and other objectives are realized in the articles, kits, and systems of the present disclosure.

In preferred aspects and embodiments of the present disclosure, features of prior art cards and toys are not simply superimposed, but synergistically combined into an integrated whole that is more enjoyable than the sum of its conceptually forbearing parts. In certain embodiments of the present disclosure, this synergy is achieved by complementary integration of specially adapted action figures with reconfigurable and multifunctional cases therefore.

For example, one particularly appealing aspect of trading cards not provided by action figures is a convenient form factor. As reconciliation, the present disclosure provides articles, kits, and systems comprising an action figure and case therefor, wherein the action figure and case are integrated and mutually complementary, and wherein the case approximates the form factor of a trading card when closed.

In a related aspect, the present disclosure provides mutually complementary action figures and cases, which cases are configured for convenient storage and transportation of case and action figure (as well as associated accessories, as discussed below) when closed. In a further related aspect, the present disclosure provides mutually complementary action figures and cases which are dimensioned so as to minimize the thickness or depth of the case when closed. In certain embodiments, for example, the depth of the case when closed is about one inch or less. In related embodiments, the maximum depth or thickness of the action figure when configured for enclosure in the case (e.g., posed flat) is about half an inch or less.

Preferably, the depth of the action figures and cases of the present disclosure is not minimized by simply reducing proportionately their two-dimensional scale (i.e., their length/height and width/breadth). In certain currently preferred embodiments, the action figure has a two-dimensional scale of at least 1:48, or at least 1:36, and/or a height of at least 1.5 inches, or at least two inches, while the case has a length-to-width ratio of 1:1 to 2.5:1 and/or a length of 2.5 inches or greater.

As another non-limiting example, trading cards are particularly suited for the conveyance of information and/or illustration of an environment of characters/personae/objects in two dimensions, whereas action figures represent characters/personae/objects in three dimensions, and are therefore particularly suited for user manipulation and interaction. As reconciliation, the present disclosure provides articles, kits, and systems comprising an action figure and case therefor, wherein the action figure and case are integrated and mutually complementary, wherein the case is adapted to be manually configured to provide a base or platform for the action figure and displays information and/or an illustrated environment for the action figure.

In one related aspect, the present disclosure provides mutually complementary action figures and cases, which cases are configured for simultaneous freestanding exhibition of the action figure and display of information concerning and/or an illustration of an environment of the subject of the action figure. In a further related aspect, the action figure, displayed information and/or illustrated environment are visually aligned.

In certain embodiments, the action figure is freestanding (e.g., supported only at a base or bottom end thereof) on a surface of the case and information and/or illustration of an environment of the corresponding character/person/object is displayed to the user on another surface of the case when the case is open. In further embodiments, the arrangement of the action figure and case is dioramic in the open configuration.

In a number of preferred embodiments, the case is adapted to reversibly transform between a closed configuration in which the action figure is enclosed within the case and at least one open configuration in which the action figure is unenclosed by the case. The case is advantageously adapted to stably assume and reversibly transform between the closed configuration and the open configuration.

In a further aspect of the present disclosure, novel low-profile action figures are provided. These action figures preferably have at least one low-profile configuration in which the major surfaces of the figurine are generally flat. In certain preferred embodiments, the action figures are configured for cooperative engagement with the reconfigurable cases of the present disclosure, such as engagement to a mounting surface of the case. In certain embodiments, the action figures can be detached from and reattached to the reconfigurable cases. In still further embodiments, the figurine is integrated with a reconfigurable support stand to balance the figurine upright when detached from the case.

In certain embodiments, the action figures are jointed and/or posable. In certain embodiments, the action figures are adapted to permit attachment and detachment of figurine accessories, such as clothing, armor, weapons, and the like. In certain embodiments, the action figure and action figure accessories are configured to permit cooperative engagement of the accessories to the action figures, such as by male/female engagement members, magnets, and the like. In certain embodiments, at least one interior surface of the reconfigurable case is also configured to permit attachment and detachment of the figurine accessories, preferably by cooperative engagement therewith.

Accordingly, in another aspect of the present disclosure, the action figure and accessories therefore can be stored within the reconfigurable case in its closed configuration for storage and transportation. The action figure and accessories therefore can likewise be displayed and used while the reconfigurable case is in the at least one open configuration.

Many of the advantages of the presently disclosed subject matter are provided in part by the inventive reconfigurable cases disclosed herein. In certain embodiments, the case comprises a plurality of polygonal panels, such as rectangular panels, wherein each panel of the plurality is connected to at least one other panel of the plurality, and wherein the case is adapted to permit rotation and/or translation of each panel relative to the panel or panels to which it is connected during transformation between the closed configuration and the open configuration.

In certain embodiments, at least three exterior panels are connected by hinges, which hinges permit bidirectional rotation of the connected panels relative to one another. In further embodiments, one exterior panel is both connected by a hinge along a first side thereof to a second exterior panel, and connected along a parallel side to a third exterior panel. This arrangement permits reversible "folding" and "unfolding" of the panels of the case along parallel axes to permit reconfiguration of the case between its open and closed configurations. In certain preferred embodiments, the hinges are disposed along panel sides defining or parallel to the sides of the case (in its closed configuration) which define the width of the closed case, such that the case opens and closes vertically rather than horizontally in intended use.

In other representative embodiments, the case comprises at least four panels, wherein at least three panels are connected along parallel sides, and wherein the fourth is connected along a side which is perpendicular to the connected parallel sides. For example, in certain embodiments, one or more interior panels are provided which conceal the accessories (while in cooperative engagement with the case) in a closed configuration and which rotate to an open configuration to provide access to the accessories. In certain embodiments, the interior panels in said open configuration extend the three-dimensional backdrop for the action figure and/or are configured to permit cooperative engagement with like panels of additional cases, such that the user can arrange a series of connected cases for greater interest and interactivity.

In certain embodiments, at least two panels are connected such that they can translate longitudinally relative to one another. For example, in certain embodiments, two panels are connected at sides thereof by an expandable swivel. In certain embodiments, one or both of these panels is connected along a different side thereof, such as a parallel side thereof, to a third panel by a rotating hinge.

A further aspect of the present disclosure provides combinations wherein the action figure is enclosed within a trading card-like case when the case is in a closed configuration. In a related aspect, three, four, five or more exterior side surfaces of the case are generally flat in the closed configuration. In certain embodiments, the case comprises a sidewall. In certain exemplary embodiments, the sidewall is provided at least in part as an orthogonal extension at the perimeter of one or more of the plurality of panels.

In certain embodiments, at least a portion of the sidewall comprises a discrete panel attached along a side thereof to one or more panels along a hinge. In certain embodiments, the sidewall comprises a track element which permits translation of panels therealong relative to one another. In still further embodiments, one or more panels are mounted within the sidewall to permit translation and rotation relative to other panels of the case.

According to yet another aspect of the present disclosure, the action figures and/or cases contain and/or are suitable for use with additional technologies which may provide further immersive or interactive capabilities. For example, in certain embodiments, the action figures, accessories, and/or cases comprise one or more motors, LEDs and/or audio transducers. In certain embodiments, the action figures, accessories, and/or cases comprise one or more of a power source, an integrated circuit or microprocessor, a video screen, and/or are equipped with RFID, Bluetooth, or nearfield communication capability.

These and other aspects of the present disclosure are understood more fully with reference to the accompanying figures, description, and claims which follow.

DETAILED DESCRIPTION

The present disclosure provides novel action figures, cases, and accessories therefor, referred to herein collectively as articles of entertainment. The present disclosure further provides combinations of the same, as well as kits and systems comprising such combinations.

In preferred embodiments, the cases are adapted to be reversibly reconfigured between a closed configuration and at least one open display configuration. In certain embodiments, the cases and action figures of the present disclosure are mutually complementary, such that an action figure can be securely mounted to a case, contained within the case when the case is in the closed configuration, and displayed while the case is in the at least one open configuration. In certain embodiments, the action figure is displayed in free-standing arrangement on the case in the open display configuration, such that the action figure is supported by the case only at its base. In certain embodiments, the accessories are similarly complementary and can be affixed to the action figure and the case, contained within the closed case, and displayed while the case is in an open configuration.

Additional exemplary embodiments of the present disclosure are described below, some with reference to the figures which accompany and constitute a portion of the disclosure. All depicted embodiments are representative and exemplary only; they are not intended to and should not be construed to limit the scope of the present disclosure. Rather, as described below, these embodiments are illustrative of a novel class of articles of entertainment, for use as and/or with toys, collectibles, and gaming systems, which is encompassed by the present disclosure and will be fully understood by and available to a person of ordinary skill in the art having the benefit of same.

Figure 1:
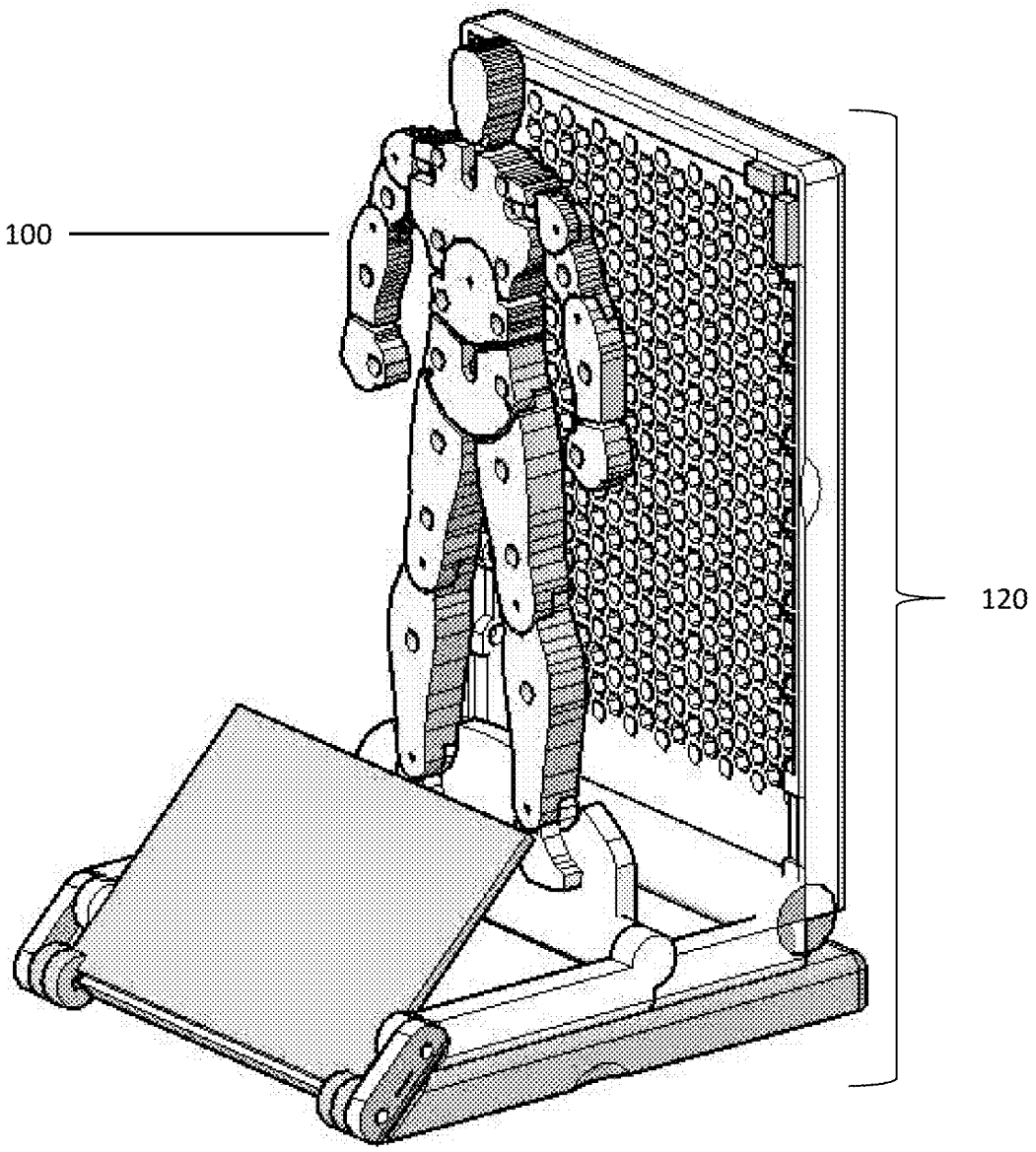
FIG. 1 is a perspective drawing of an exemplary embodiment of the present disclosure in which the case is in an open display configuration and the action figure is attached to and displayed upon the case.

With reference to FIG. 1, an exemplary embodiment of the present disclosure is depicted in which action figure 100 is secured to and displayed upon case 120. In the depicted embodiment, action figure 100 is displayed upright before and generally parallel to a rear panel of case 120, and behind a placard panel oriented at an angle. Action FIG. 100 is generally flat. Both the ventral surface of action figure 100 and the rear panel of case 120 possess female engagement members, depicted as round holes, to which accessories for the action figure can be joined via complementary male engagement members, e.g., round pegs of like diameter and depth. Action FIG. 100 comprises a number of components connected by joints. These and other non-limiting, exemplary features are described in further below.

Figure 2:
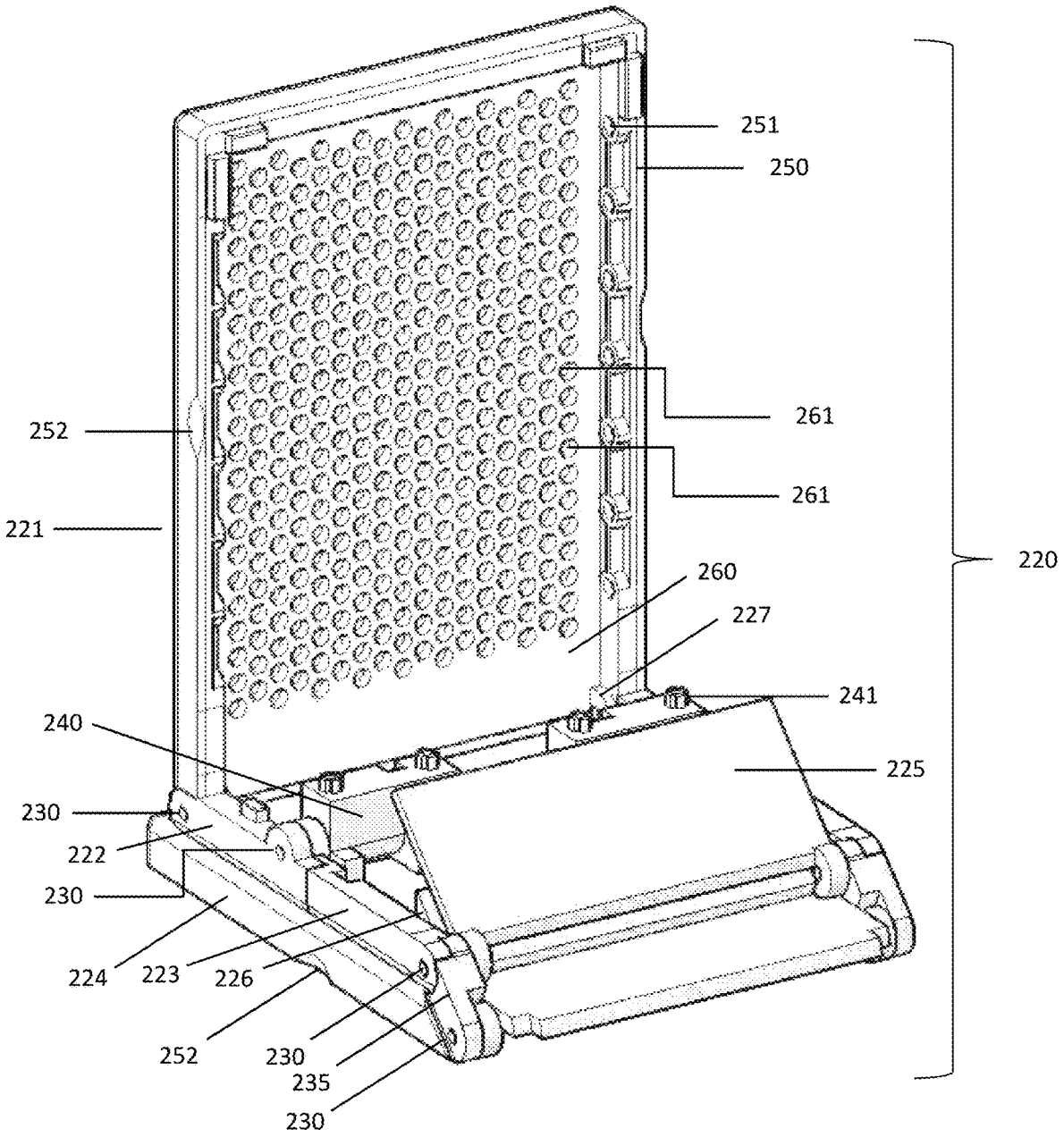
FIG. 2 is a perspective drawing of another exemplary embodiment of the present disclosure in which the case is in an open display configuration.

Another exemplary embodiment of the present disclosure is depicted in FIG. 2. In particular, an exemplary embodiment of a case 220 according to the present disclosure is depicted in an open display configuration. Case 220 includes first panel 221, second panel 222, third panel 223, fourth panel 224, and a placard panel 225. Panels 221, 222, 223, and 224 are exterior panels, while placard panel 225 is an interior panel. Each panel is rectangular or generally rectangular, and is connected to at least one adjacent panel along a side thereof by a hinge 230. In the embodiment depicted, the hinges connect panels along parallel sides of the panels, such that each panel has a parallel axis of rotation. Notwithstanding the foregoing, the case further includes an offset pivot hinge 235. Offset pivot hinge 235 permits 180° rotation of fourth panel 224 about third panel 223 such that fourth panel 224 folds underneath the other panels in the open display configuration.

The exemplary case embodiment of FIG. 2 further comprises placard stop 226, panel stop 227, mount 240 and sidewall 250. Placard stop 226 supports placard panel 225 when case 220 is in the open display configuration as shown. In the exemplary embodiment depicted, offset pivot hinge 235 and placard panel 225 are generally coplanar in the open display configuration. Panel stop 227 supports panel 221 in an upright position while case 220 is in the open display configuration. In the exemplary embodiment depicted, panel 221 is vertical and perpendicular to panel 222 in the open display configuration.

Mount 240 includes mounting elements 241, which cooperate with complementary elements on the action figure and/or action figure stand to secure the action figure to the case, for example by a friction fit. In the embodiment depicted in FIG. 2, sidewall 250 comprises interior sidewall surface elements 251 and exterior sidewall surface elements 252. Interior sidewall surface elements 251 define female engagement members, which can cooperatively engage with corresponding male engagement members of various accessories for the action figure and case as discussed below. In the same embodiment, exterior sidewall surface elements 252 define a finger groove used to urge the case from the closed configuration, such as by releasing a catchment or retention member which secures the case in the closed configuration until opened by the user.

Sidewall 250 further defines an interior recess 260 which includes interior engagement members 261. In the embodiment depicted in FIG. 2, this interior recess comprises an array of female engagement members 261 (e.g., a "pegboard") which can cooperatively engage with corresponding male engagement members of various accessories for the action figure and case as discussed below. Interior recess 260 defines a convenient storage area for such accessories.

Figure 3:
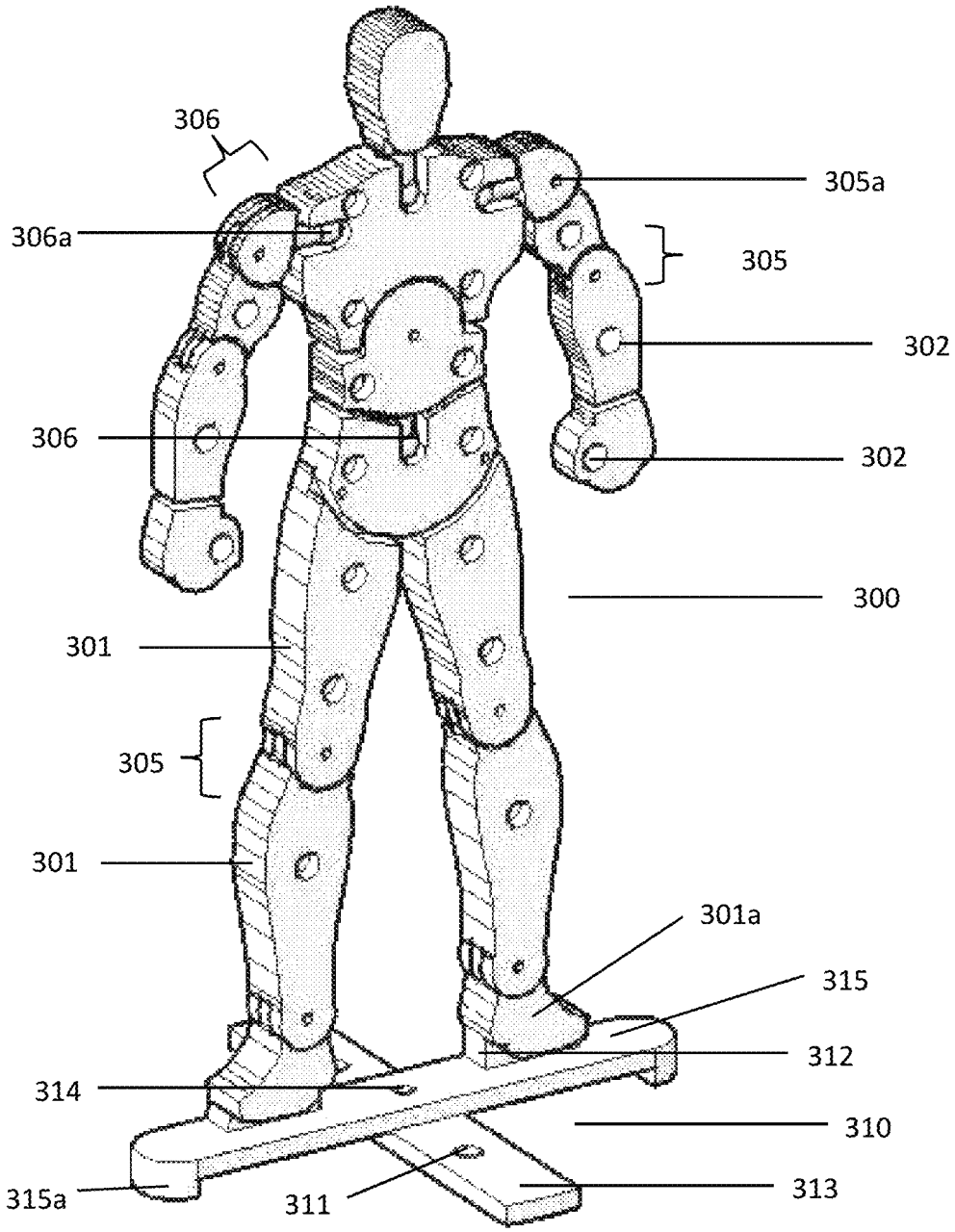
FIG. 3 is a perspective drawing of an exemplary embodiment of an action figure and reconfigurable stand according to the present disclosure.

FIG. 3 depicts another exemplary action figure 300 according to the present disclosure. In the depicted embodiment, action figure 300 comprises a plurality of discrete elements 301. In particular, the anthropomorphic action figure 300 depicted comprises discrete elements 301 corresponding to primary human anatomic features (e.g., head, hand, forearm, etc.). Elements 301 are connected by joints 305, 306. Joints 305 comprise hinges 305*a* which affix and permit bidirectional rotation between adjoined elements 301. Joints 306 comprise ball-and-socket elements 306*a* which affix and permit multiplanar rotation between adjoined elements 301. As such, action figure 300 has a generally flat or two-dimensional configuration as depicted, but is possible in three dimensions (e.g., each of the transverse, sagittal, and coronal planes).

Action FIG. 300 further comprises engagement elements 302. As depicted, engagement elements 302 are female engagement members, which can cooperatively engage with corresponding male engagement members of various accessories for the action figure and case, as discussed below.

Also depicted in FIG. 3 is action figure stand 310. As depicted, stand 310 is in an open support configuration, with support arm 313 rotated relative to mount surface 315 to support action figure 300. The underside of mount surface feet 315*a* and support arm 313 are in contact with a flat surface and support action figure upright 300 via normal force. The extended surface area provided by support arm 313 permits action figure 300 to remain upright even when posed such that the center of gravity extends forward or backward past mount surface 315 in the coronal plane. Mount surface 315 and support arm 313 are connected via rotating hinge 314.

In the embodiment depicted in FIG. 3, action figure 300 is attached to or integrated with stand 310 via connectors 312. In certain embodiments, mounting elements 301*a* and connectors 312 are configured for cooperative engagement, such as via corresponding male and female engagement members, magnetized surfaces, snap or friction fit, and the like. In alternative embodiments, engagement elements 301*a* and connectors 312 are integrally formed. Engagement elements 311 are provided on support arm 313. These elements are adapted to cooperatively engage with complementary members on the action figure mounts of the present disclosure to support the action figure upright and attach action figure to the cases of the present disclosure.

Figure 4A:
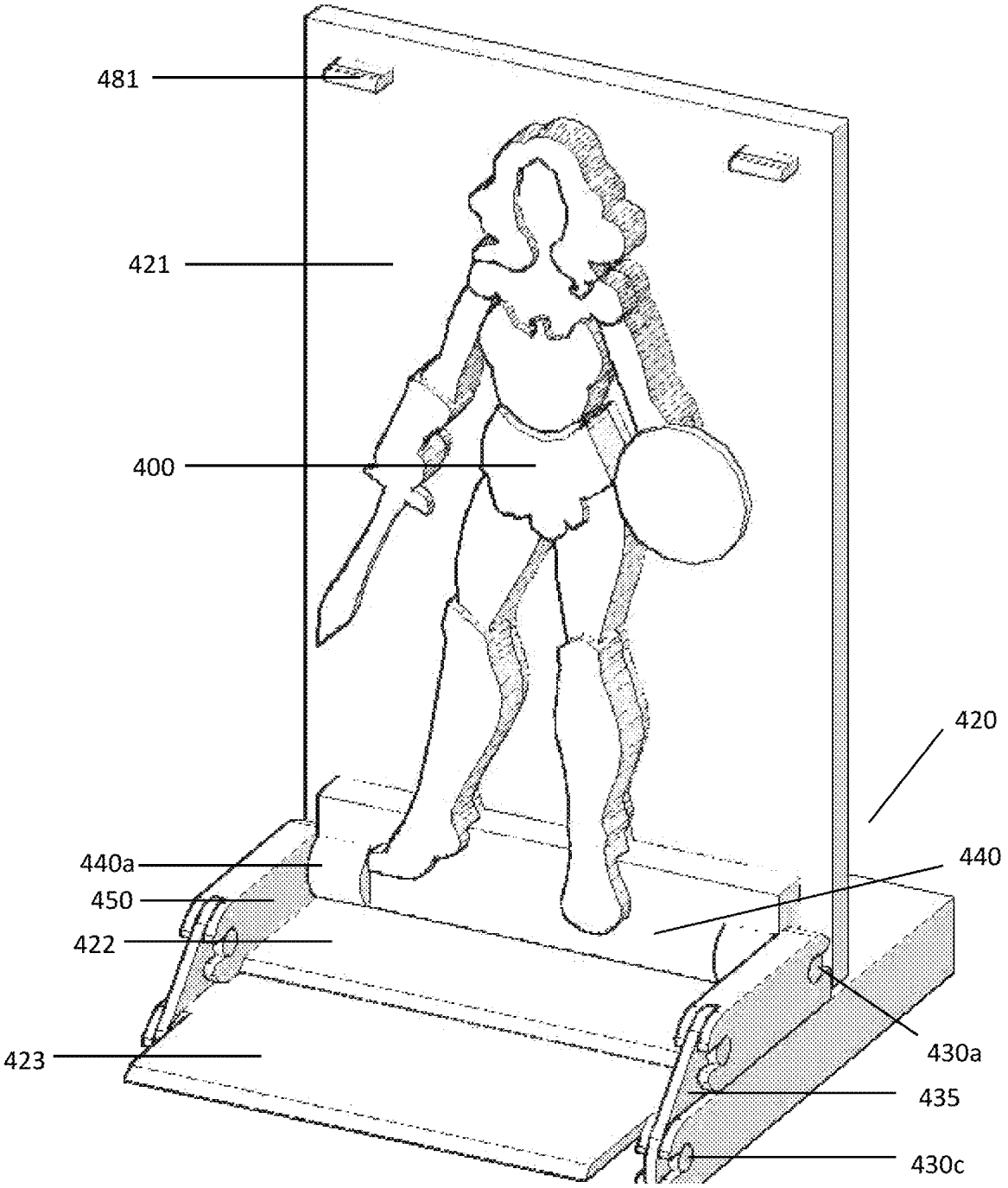
FIG. 4 consists of perspective drawings of another exemplary embodiment of the present disclosure, in which, in FIG. 4A, the case is in an open display configuration, and in FIG. 4B, the case is in the closed configuration.
Figure 4B:
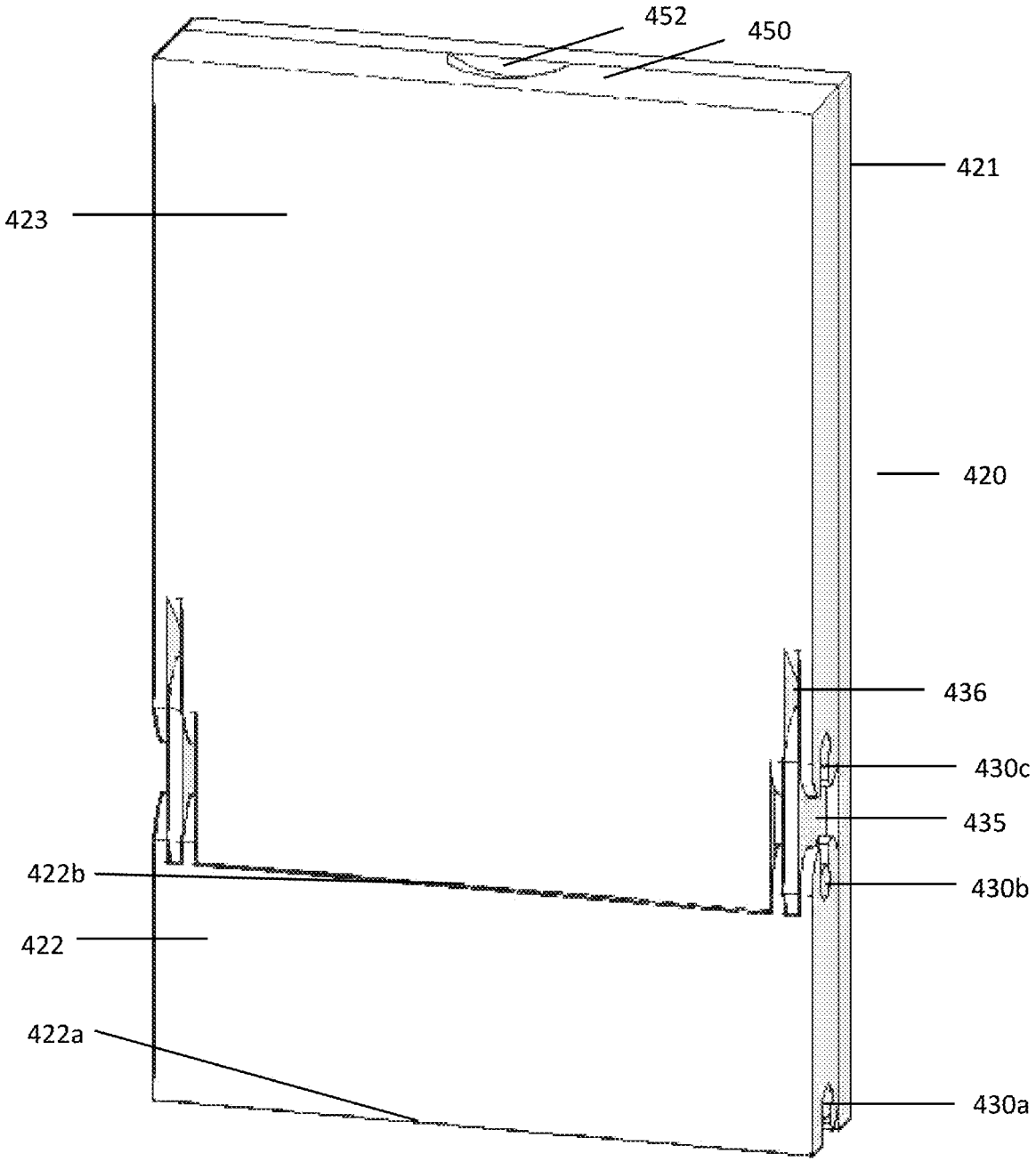

Another embodiment of the present disclosure is depicted in FIG. 4A in an open display configuration and in FIG. 4B in the closed configuration. In the open display configuration depicted in FIG. 4A, action figure 400 and mount 440 are contiguous with and displayed in relief against panel 421 in the open display configuration. Panel 421 is connected along a side thereof to an adjacent parallel side of panel 422 via hinge 430*a*. Panel 422 is likewise connected in turn to panel 423 via hinge 430*c* and offset pivot hinge 435. In the open display configuration, panel 421 is rotated 90° relative to panel 422, while panel 423 is rotated 180° relative to panel 422 and offset via pivot hinge 435 such that panels 421 and 422 are disposed on top of and, respectively, perpendicular to and parallel to, panel 423.

In the embodiment depicted in FIG. 4A, a pair of closure members 481 is provided on panel 421. The clasps cooperatively engage with a pair of corresponding members on the interior surface of panel 423 to maintain case 420 in the closed configuration until opened by the user. Sidewall 450 extends along the lateral side surfaces of panels 422 and 423. In the depicted embodiment, sidewall 450 sandwiches offset hinge 435.

A related embodiment in which the case is in the closed configuration is depicted in FIG. 4B. In the depicted embodiment, the action figure is fully contained within case 420. Sidewall 450 extends along the lateral surfaces of panels 422 and 423 and top perimeter surface of panel 423 to define an interior recess in which the action figure is contained. Finger groove 452 is provided to facilitate opening of the case by releasing internal closure members. Groove 436 is provided to permit offset and 180° rotation of panel 423 relative to panel 422 via offset hinge 435.

Accordingly, case 420 is adapted to permit simple and convenient reconfiguration between the stable closed configuration depicted in FIG. 4B and the stable open display configuration depicted in FIG. 4A. To open the case, the user applies pressure via finger groove 452 to release closure members 481 from engagement with their corresponding catchments, then unfolds the case by rotating panel 422 90° relative to panel 421, and simultaneously or sequentially rotating panel 423 180° relative to and underneath panel 422. To close the case, the user performs the same steps in reverse sequence. In the closed configuration, notwithstanding functional elements, case 420 is generally flat on the exterior surfaces and has the shape of a rectangular prism.

Figure 5:
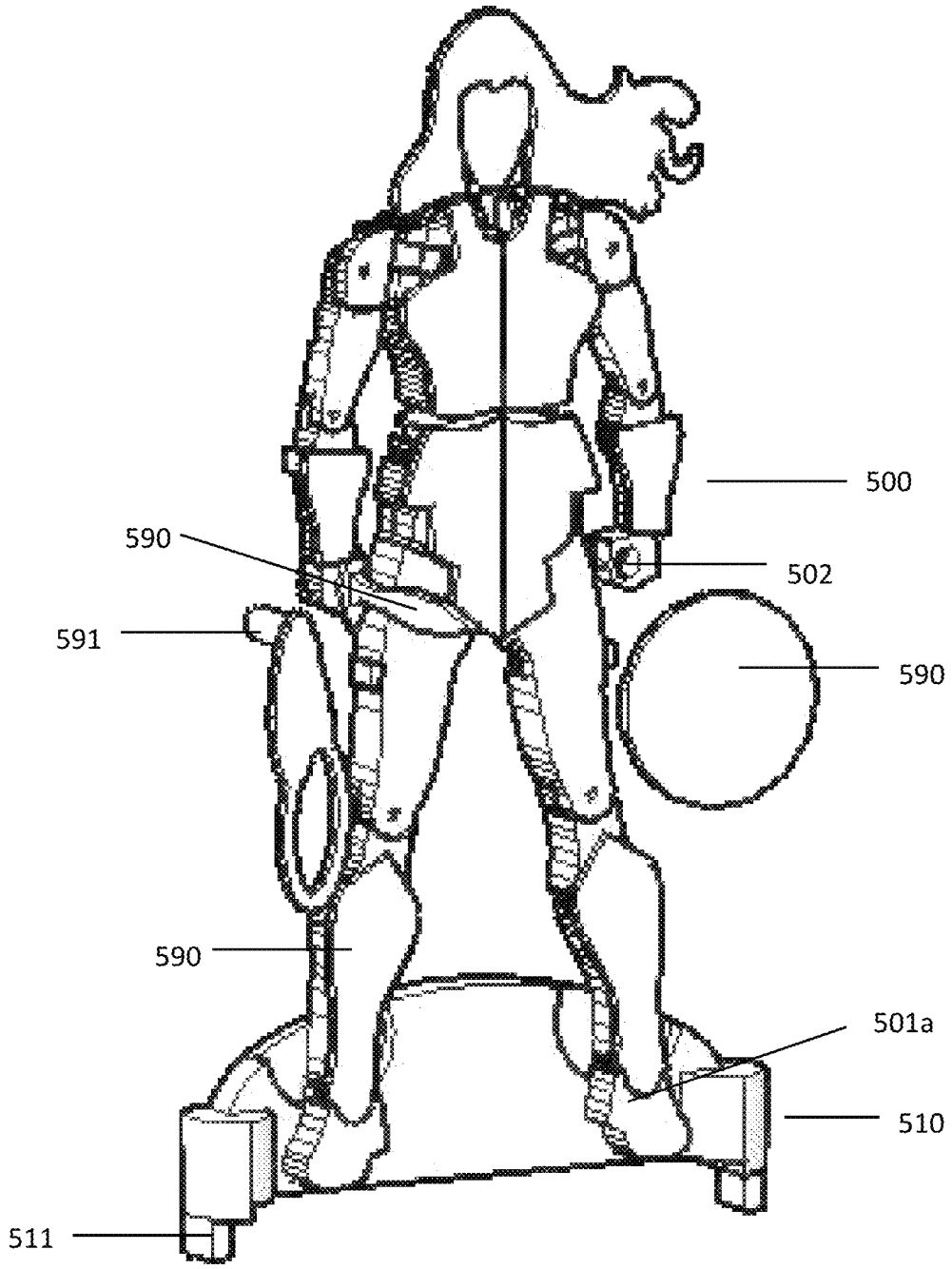
FIG. 5 is a perspective drawing of another exemplary embodiment of an action figure with stand and exemplary accessories according to the present disclosure.

Another embodiment of the action figures of the present disclosure is depicted in FIG. 5. As depicted, action figure 500 has been equipped with representative accessories 590, including armored shinguards and a sword. For purpose of illustration, alternative accessories 590 are displayed alongside action figure 500. In the depicted embodiment, accessories 590 comprise engagement member 591, adapted to cooperatively engage with corresponding engagement members 502 on action figure 500. Accessories 590 can accordingly be attached, detached, and replaced by the user with relative ease.

In the embodiment depicted in FIG. 5, stand 510 comprises engagement members 511 which are configured to engage with corresponding elements on a mount attached to the case. Action figure elements 501*a* may be integral with stand 510 or may comprise engagement members to permit detachment from and reattachment to stand 510.

Figure 6A:
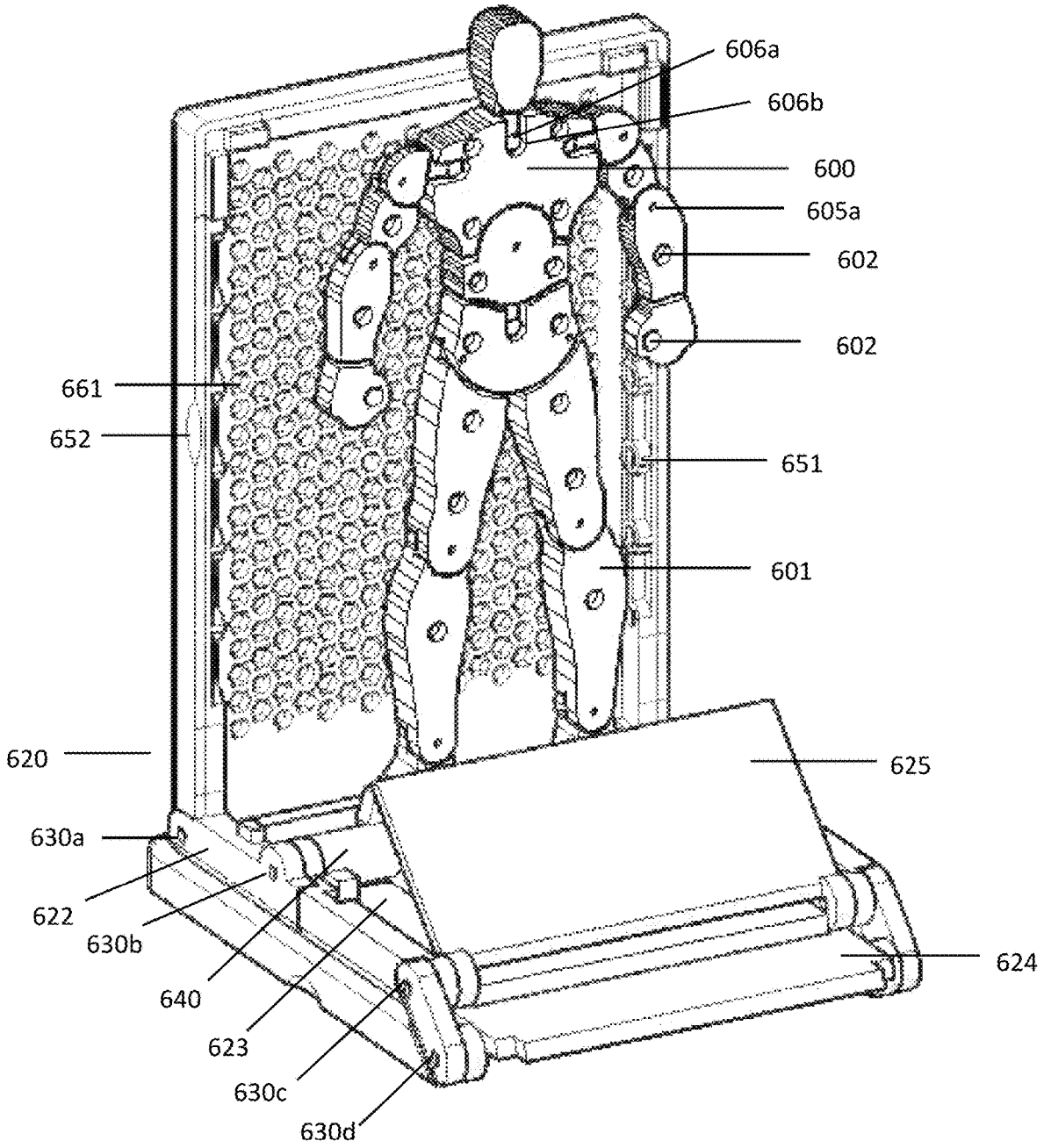
FIG. 6 consists of perspective drawings of another exemplary embodiment of the present disclosure in which, in FIG. 6A and FIG. 6B, the case is in an open display configuration, and in FIG. 6C and FIG. 6D, the case is in the closed configuration.
Figure 6B:
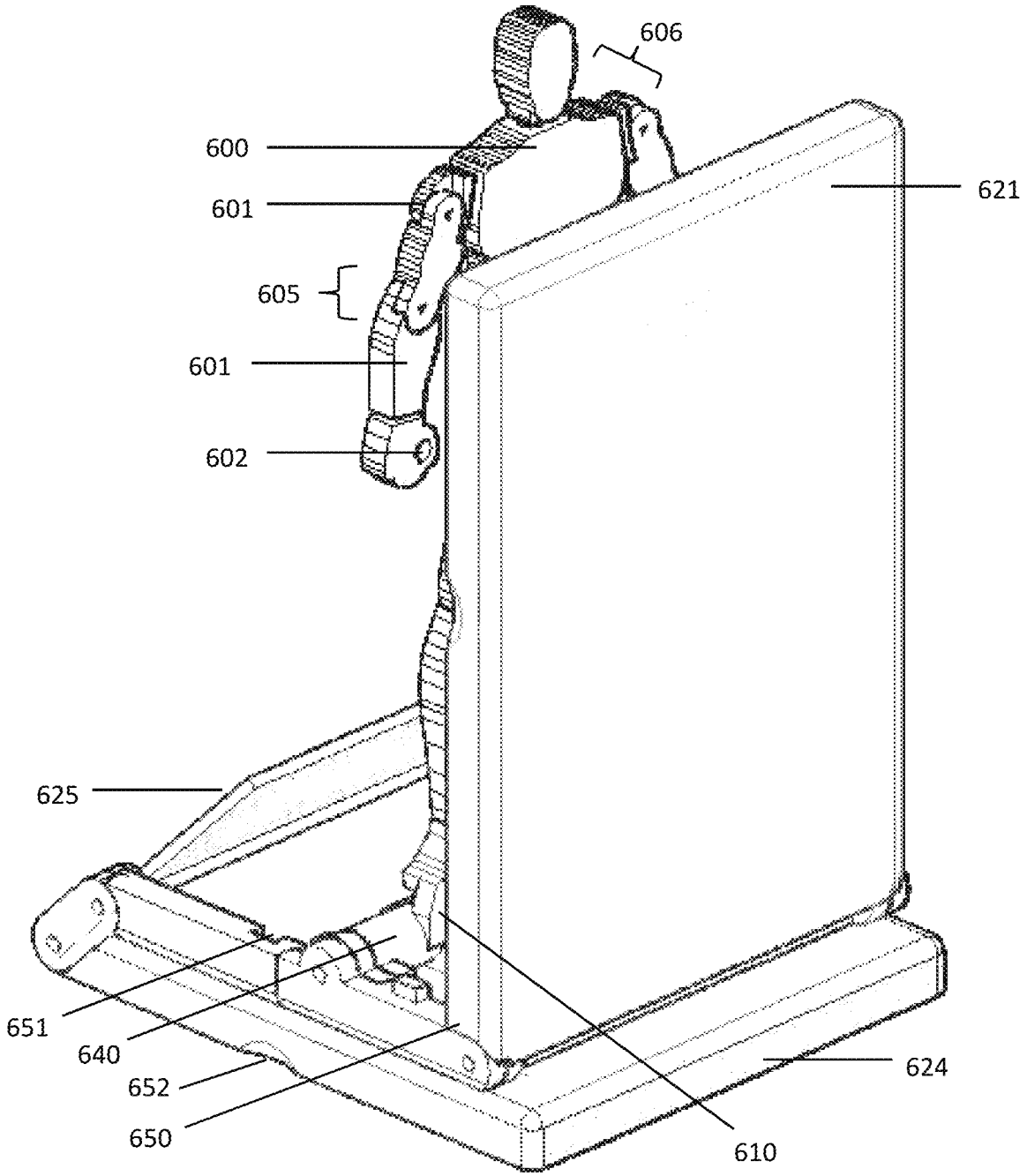
Figure 6C:
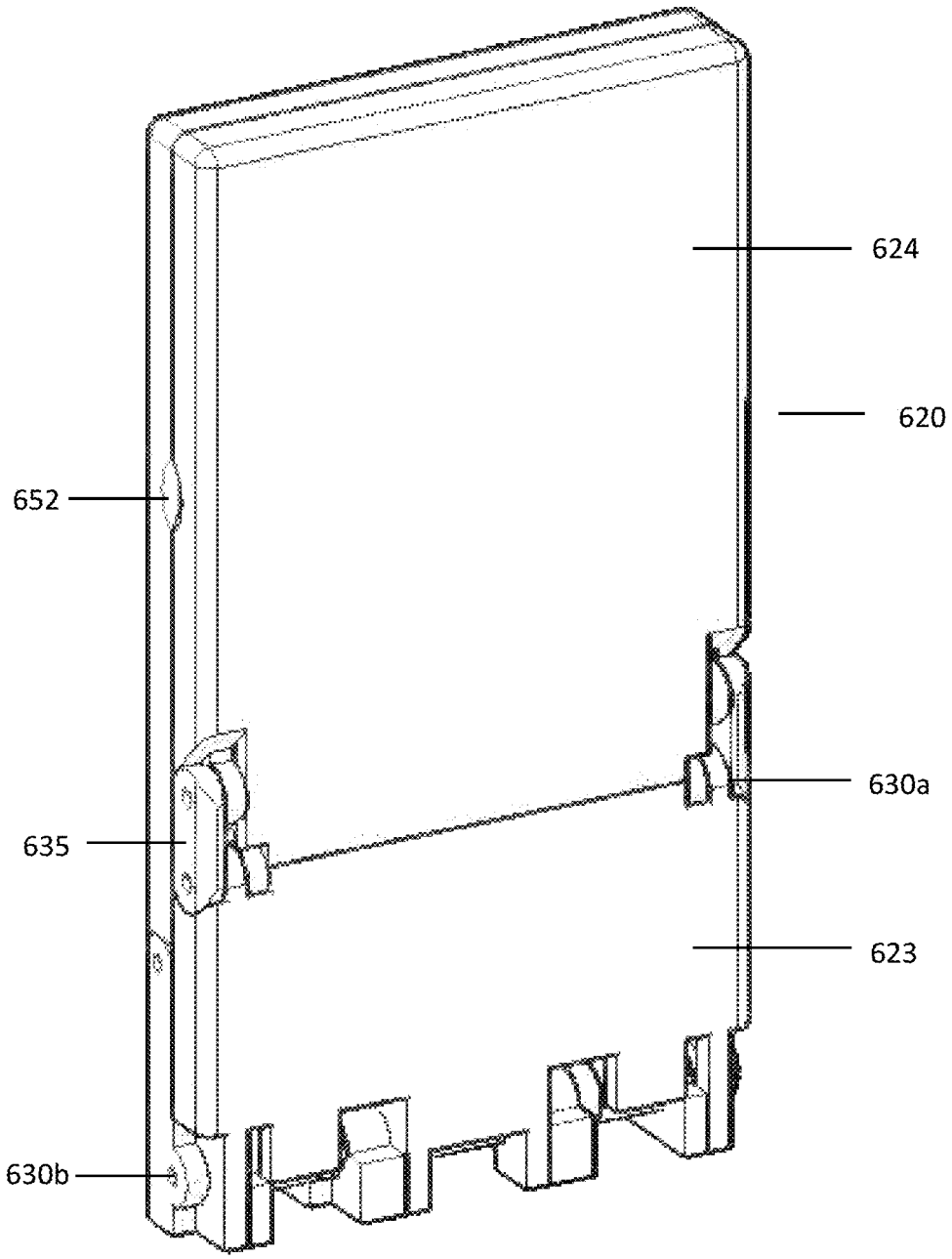
Figure 6D:
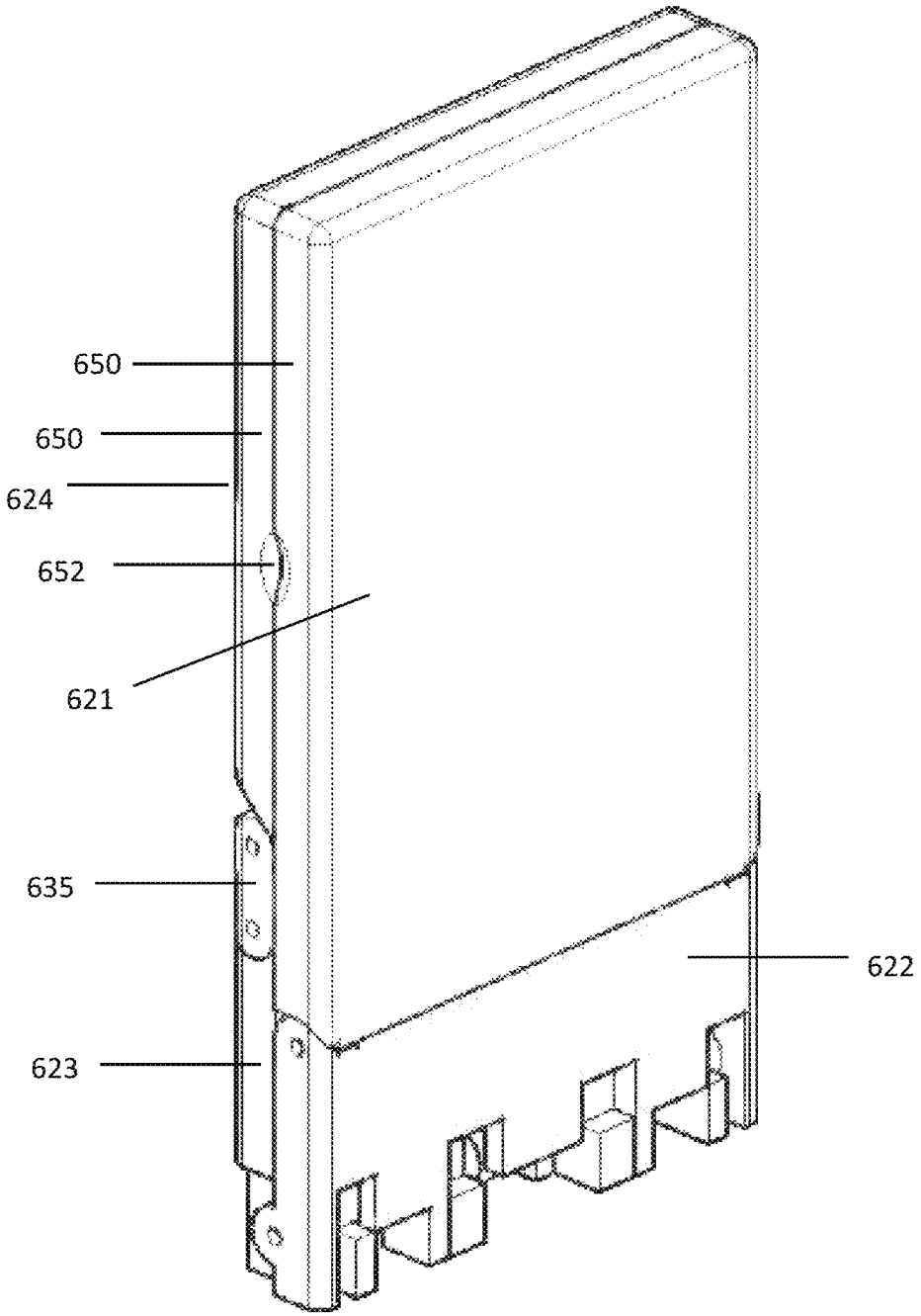

A further embodiment of the present disclosure is depicted in the open display configuration in front perspective in FIG. 6A and rear perspective in FIG. 6B, and in the closed configuration in front perspective in FIG. 6C and rear perspective in FIG. 6D. As depicted in FIG. 6A and FIG. 6B, action figure 600 comprises a plurality of elements 601 connected by joints 605, 606. Joints 605 comprise hinges 605*a* connecting overlapping portions of adjacent elements 601, while joints 606 are ball-and-socket joints in which head portions 606*a* of elements 601 reside in joint recesses 606*b* of adjoined elements 601. Action FIG. 600 further comprises engagement members 602 to permit attachment of action figure accessories.

Case 620 comprises a plurality of panels 621, 622, 623, 624, 625, of which panels 621, 622, 623, and 624 are exterior panels, connected along at least one side thereof to a parallel side of an adjacent panel by a hinge 630. Case 620 further comprises sidewall 650 disposed around perimeter sides of panels 621, 622, 623, and 624, which sidewall comprises interior sidewall surface elements 651 and exterior sidewall surface elements 652. In the embodiment depicted, action figure stand 610 is connected to mount 640, which is disposed above hinge 630*b* connecting panel 622 and panel 623.

This embodiment is depicted with the case in the closed configuration in FIG. 6C and FIG. 6D. Relative to the open display configuration as depicted in FIG. 6A and FIG. 6B, the case has been (and is adapted to be) reversibly reconfigured to the closed configuration. In particular, sequentially and/or simultaneously, panel 621 is rotated 90° relative to panel 622 about hinge 630*a* so as to be coplanar with panel 622, panel 624 is been rotated 180° about hinge 630*d* and offset 635 rotated approximately 45° about hinge 630*c* such that panel 624 is coplanar with panel 623, panel 625 is rotated approximately 135° relative to panel 623 so as to lie on top of and congruent to panel 624, and panels 622, 623 are each rotated 90° relative to one another about hinge 630*b*. Thus, in the closed configuration, action figure 600 is enclosed within case 620 in the closed configuration by two pairs of coplanar panels (621, 622 and 623, 624) and conjoined sidewall 650. Similarly, the case is transformed back to the open configuration by pressing the exterior sidewall surface elements 652 and then sequentially and/or simultaneously rotating panel 621 90° relative to panel 622, rotating panel 624 180° underneath panel 623, and rotating placard panel 625 to lie at an angle before action figure 600.

As depicted, panel 622 and panel 623 are joined by hinge 630*b*. As shown in FIG. 6C and FIG. 6D, Panel 622 and panel 623 comprise complementary projections and recesses to permit case unfolding at abutting regions of panels 622, 623 and sidewall 650. The projections and recesses interdigitate to provide a contiguous exterior panel surface interface while the case is open.

Figure 7:
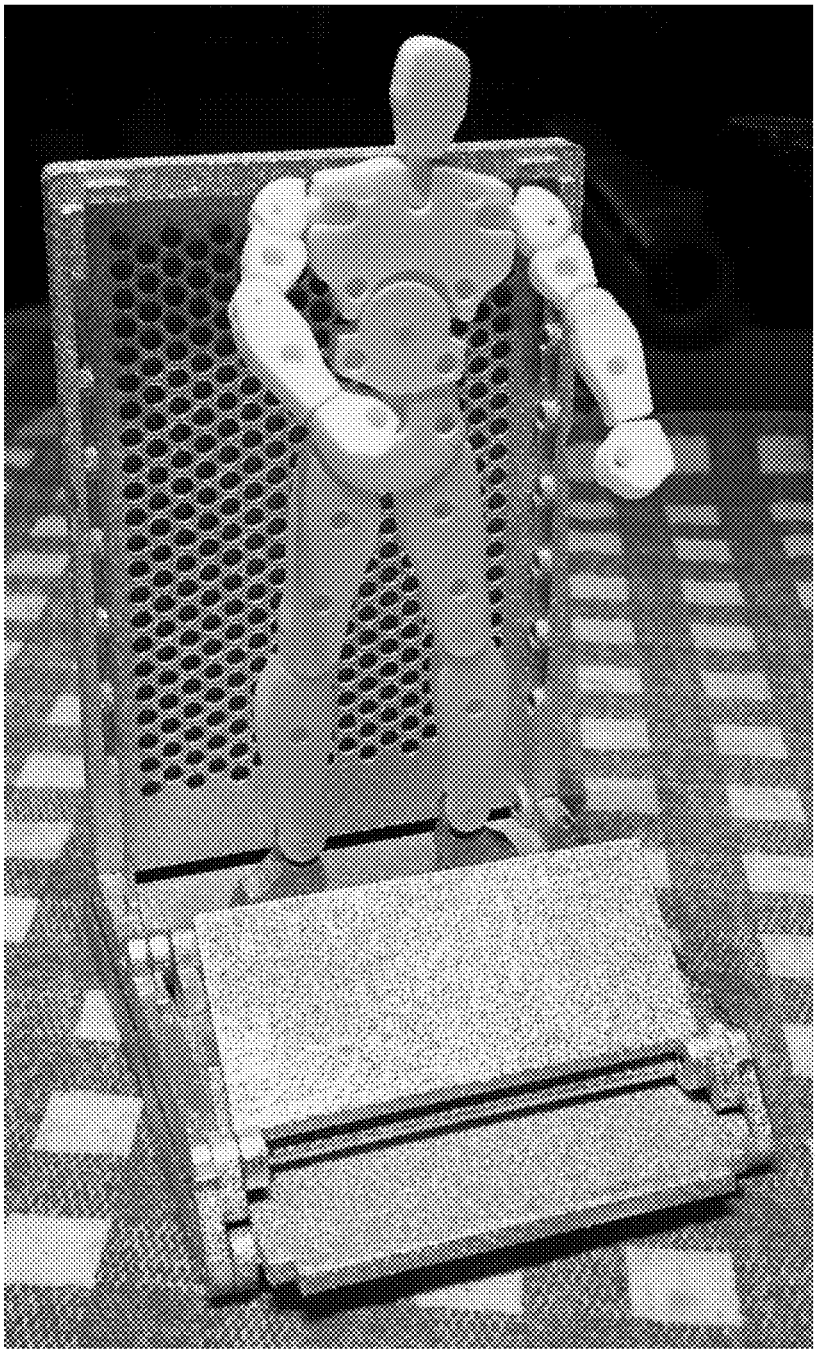
FIG. 7 is a photograph of a prototype corresponding to the embodiment of FIG. 6.

A prototype corresponding to the embodiment depicted in FIG. 6 is shown in FIG. 7. The ball-and-socket joints of the head and shoulders and the right elbow joint are posed for purpose of illustration. In the exemplary prototype depicted, the feet of the action figure are integral with the stand and mount.

Figure 8:
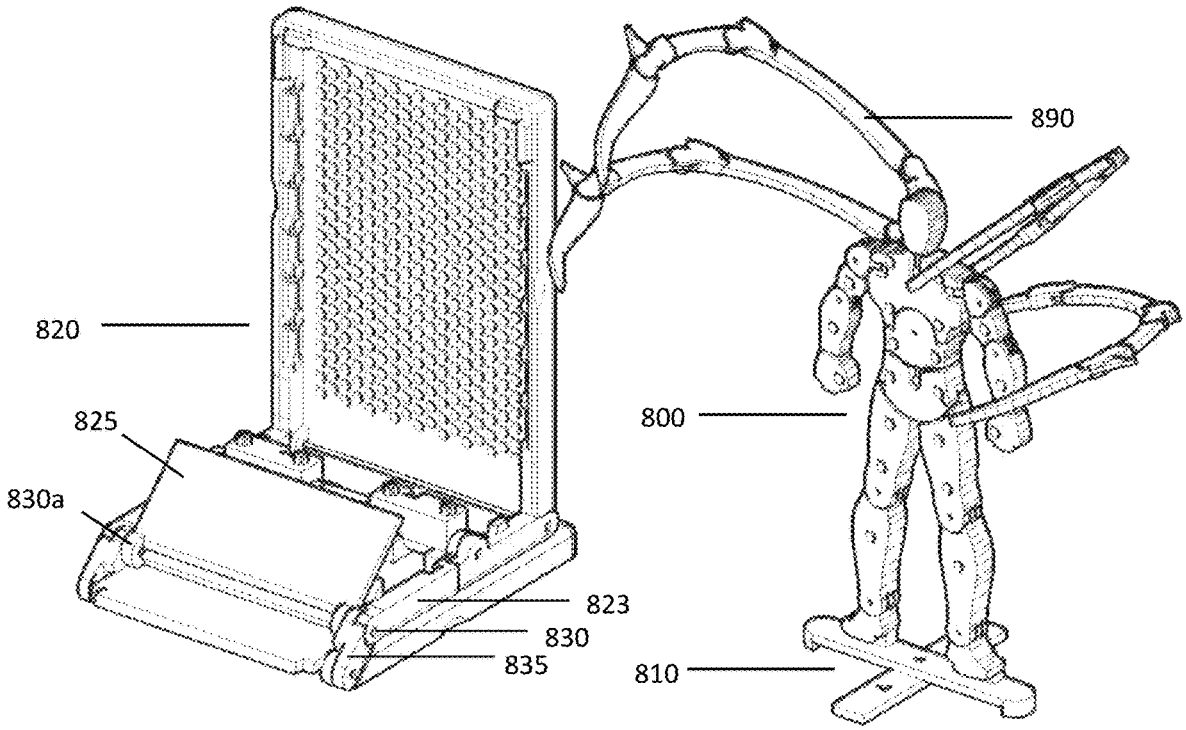
FIG. 8 is a perspective drawing of another exemplary embodiment of the present disclosure in which the case is in an open display configuration, the action figure is detached, the reconfigurable stand is in a support configuration, and accessories have been attached to the action figure.

Another exemplary embodiment is provided in FIG. 8. In the depicted embodiment, action figure 800 is detached from case 820, which is illustrated in the open display configuration. As evident in FIG. 8, placard panel 825 is dimensioned to fold within case 820 and is mounted on hinge 830*a*. Hinge 830*a* is nested within offset pivot hinge 835, which is nested in turn within hinge 830, which connects panel 823 to offset pivot hinge 835. Stand 810 is depicted in an open support configuration, and action figure accessories 890 are mounted to the back of action figure 800 via complementary engagement members.

Figure 9:
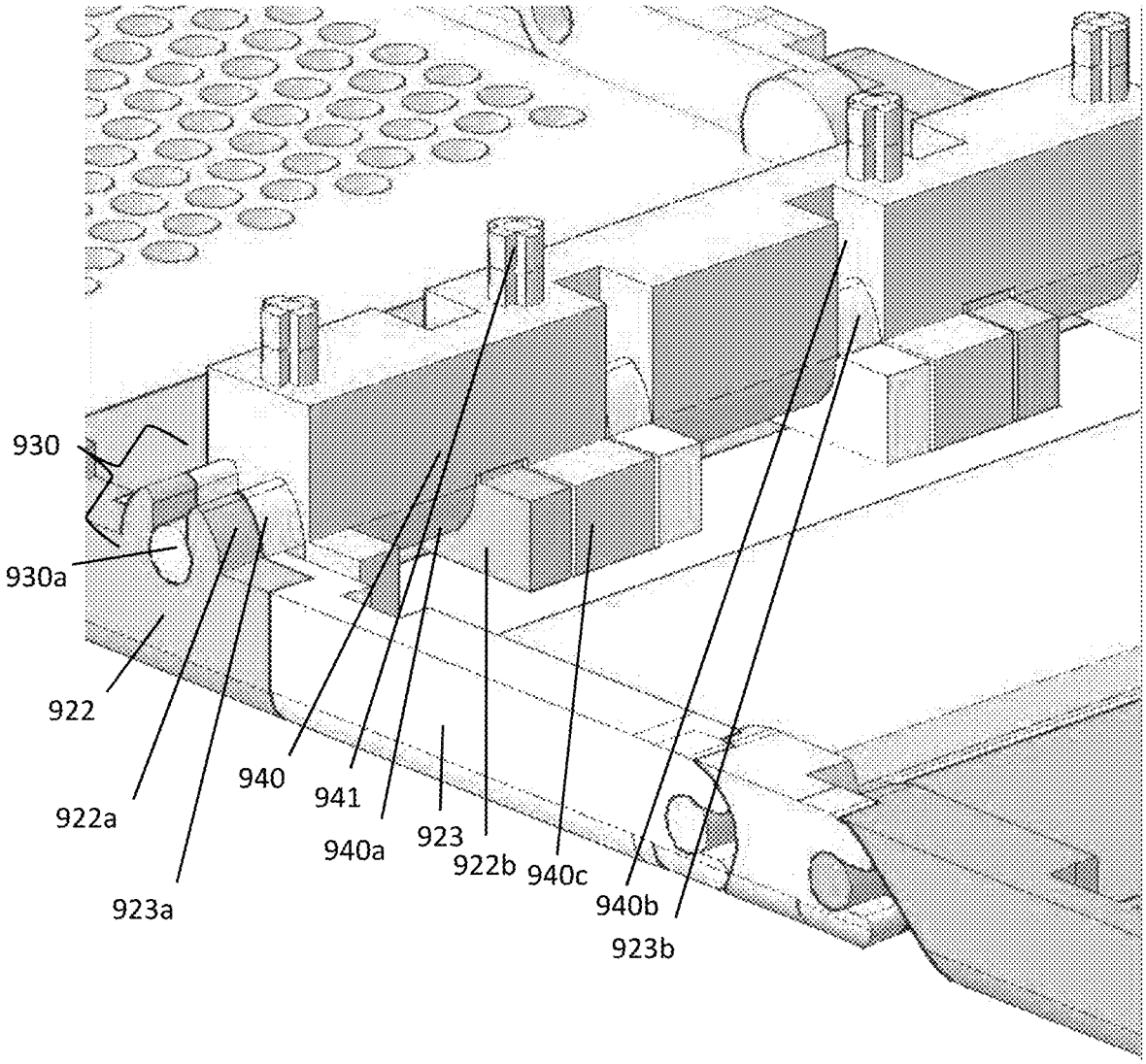
FIG. 9 is a magnified perspective drawing of an exemplary embodiment of case according to the present disclosure in an intermediate open configuration.

A magnified perspective view of an exemplary hinge and mount arrangement suitable for use with cases of the present disclosure is provided in FIG. 9. As depicted, the case is in an intermediate open configuration in which all panels are laid flat on a standing surface. Hinge 930 connects panels 922 and 923. In particular, panel portion 922*a* and panel portion 923*a* are connected to and rotatable about hinge 930 (at both lateral sides of the case). Mount 940, which comprises mounting elements 941, is disposed above hinge 930 and the interface of panels 922 and 923. As depicted, projections 940*a*, recesses 940*b*, and foundation elements 940*c* of mount 940 interdigitate with extensions 922*b* of panel 922 and extensions 923*b* of panel 923. This arrangement permits folding of the case into the low-profile closed configuration and opening of the case into the intermediate and display open configurations.

Figure 10:
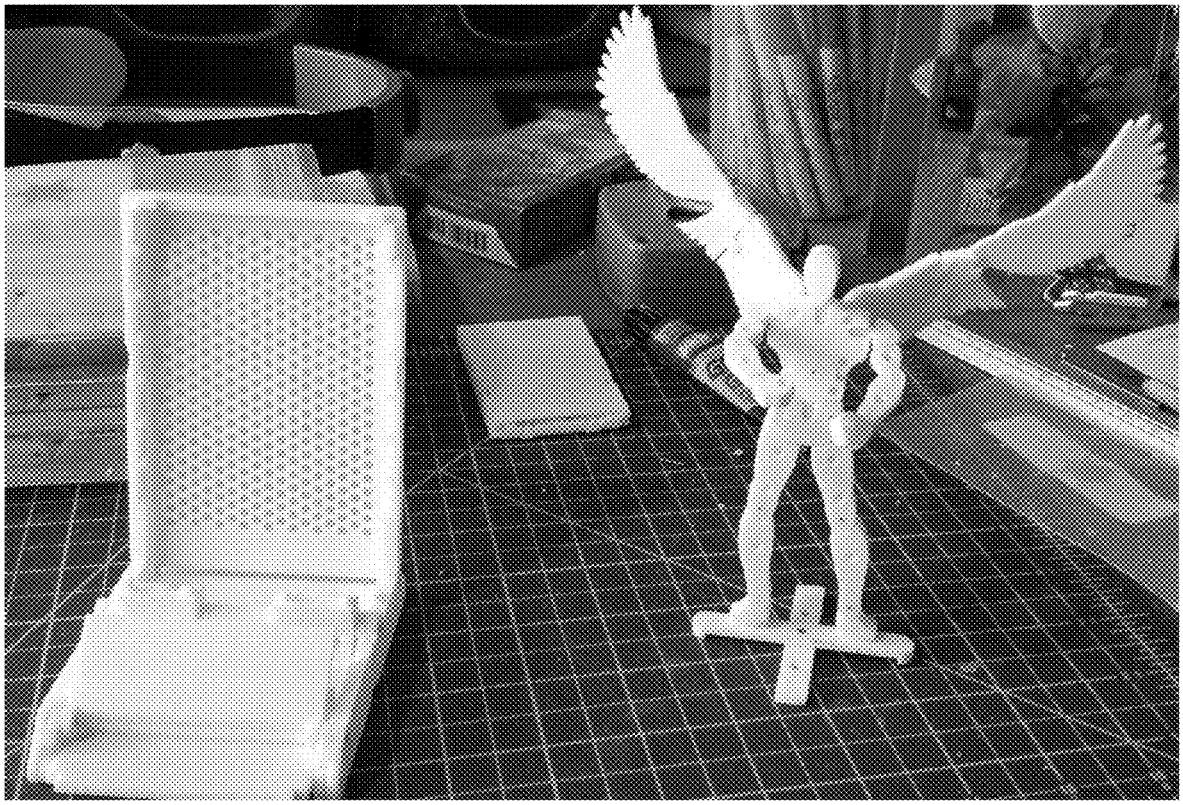
FIG. 10 is a photograph of a prototype case and action figure corresponding to the embodiment of FIG. 8.
Figure 11:
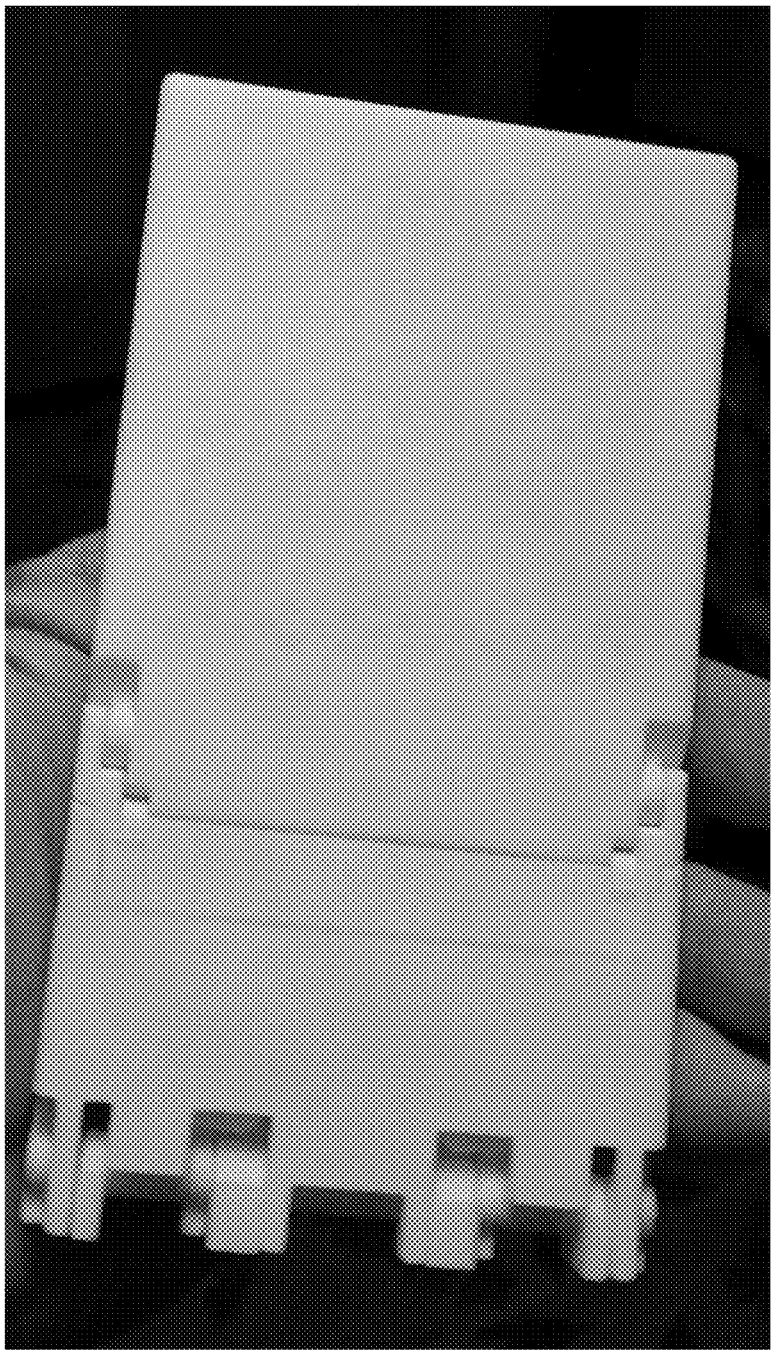
FIG. 11 is a photograph of the front of another exemplary case prototype.
Figure 12:
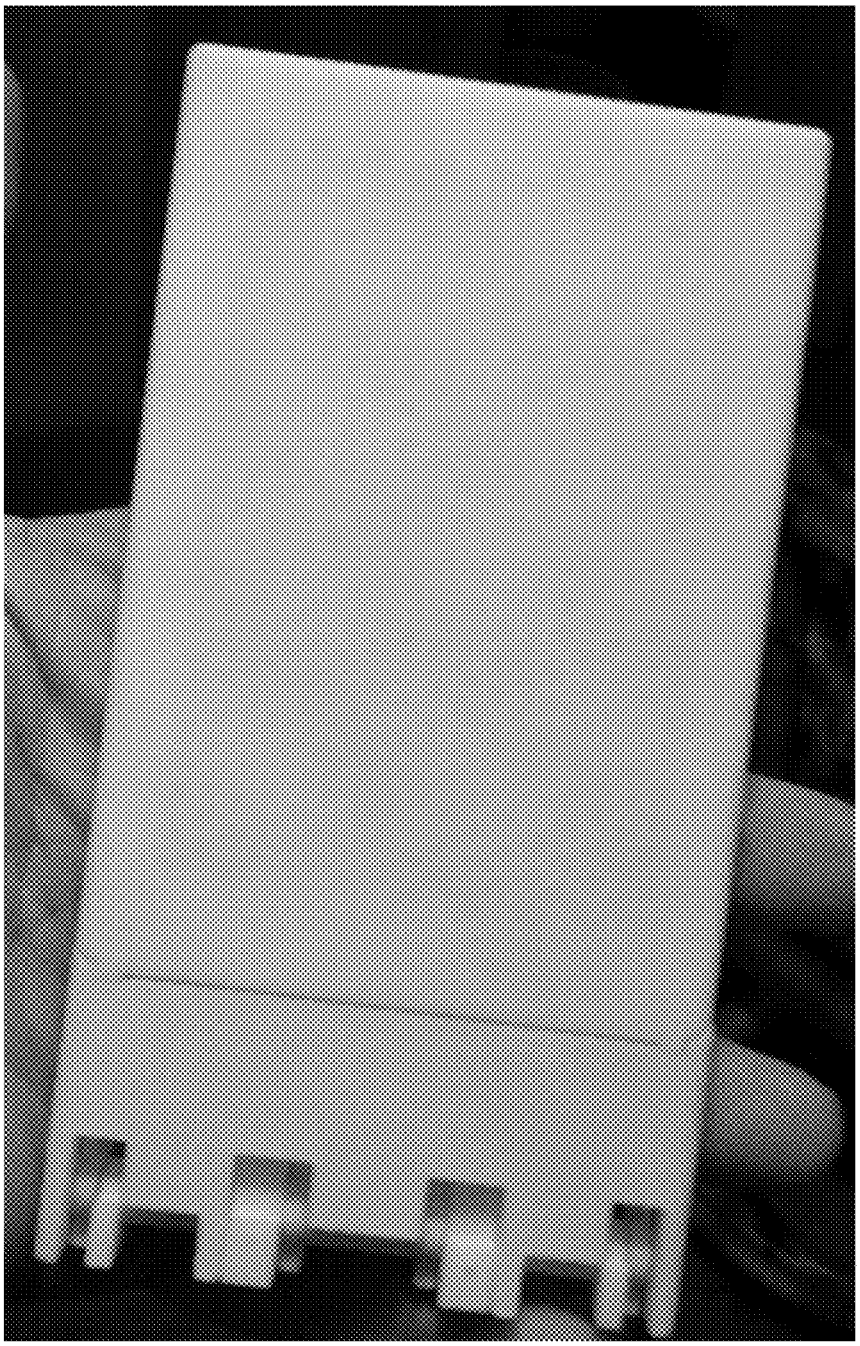
FIG. 12 is a photograph of the back of another exemplary case prototype.
Figure 13:
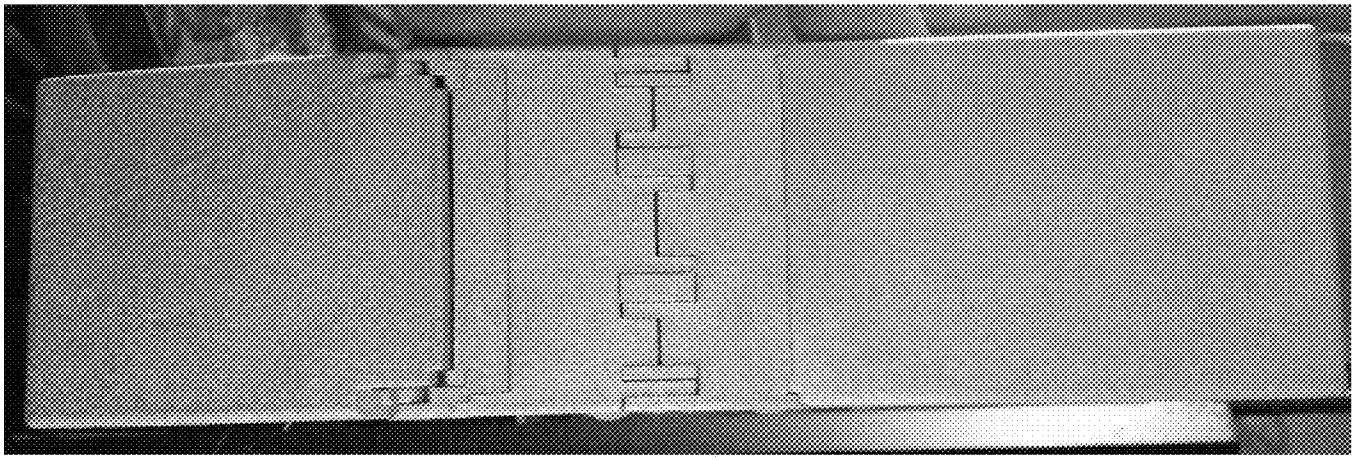
FIG. 13 is a photograph of the underside of another exemplary case prototype in an intermediate open configuration.
Figure 14:
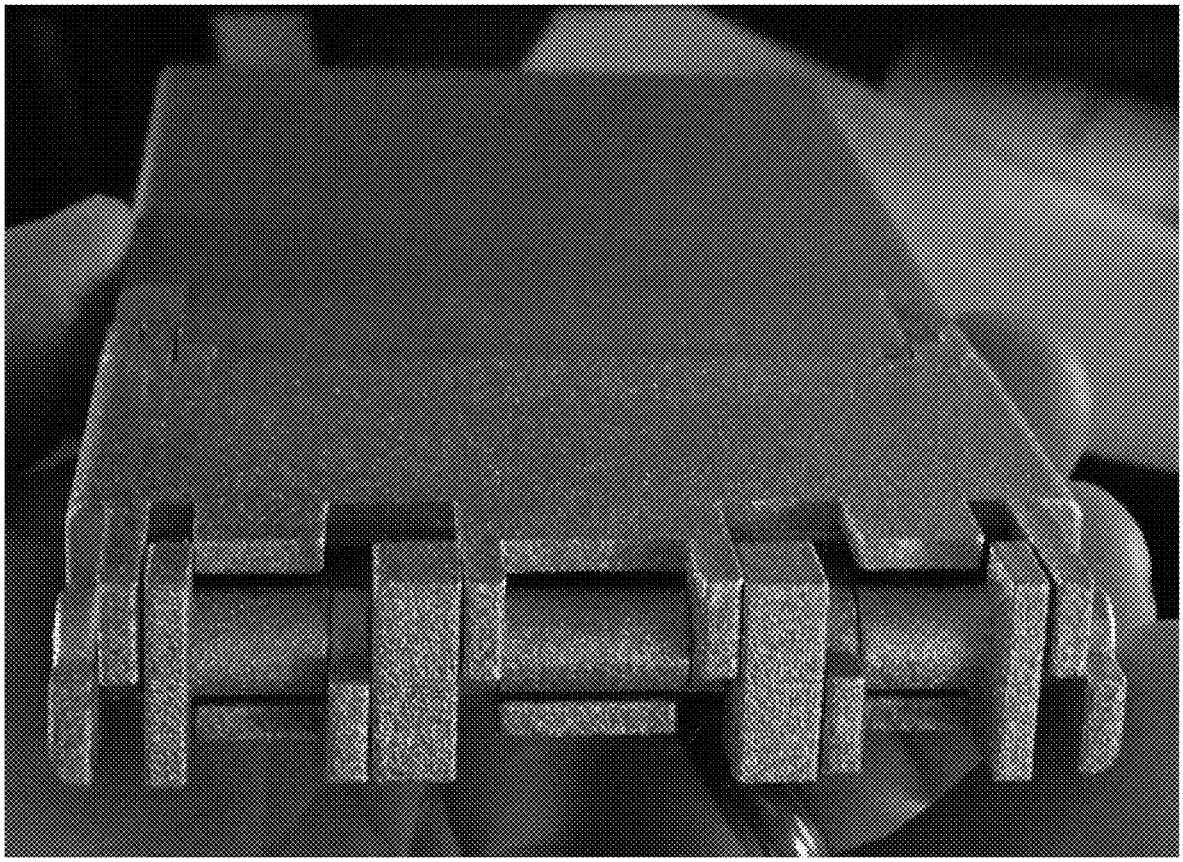
FIG. 14 is a photograph of the bottom end and back of the prototype depicted in FIG. 13 in the closed configuration.

Prototypes related to the foregoing embodiments are depicted in FIG. 10, FIG. 11, FIG. 12, FIG. 13, and FIG. 14. In particular, FIG. 10 depicts a prototype related to the embodiment illustrated in, for example, FIG. 8, in which the case is in the open display configuration and the action figure is detached, supported by its stand in the open support configuration, with accessories attached to the back of the action figure via complementary engagement members. FIG. 11 and FIG. 12 depict, respectively, the front and rear surfaces of related case prototypes in the closed configuration. FIG. 13 depicts the exterior surface of another related case prototype in an intermediate open configuration, while FIG. 14 depicts the bottom end and back surface of a related prototype. The features described above, including the connected panels, generally flat exterior surfaces, and interdigitating projections and recesses of the panels at the bottom end of the case, are apparent.

Figure 15:
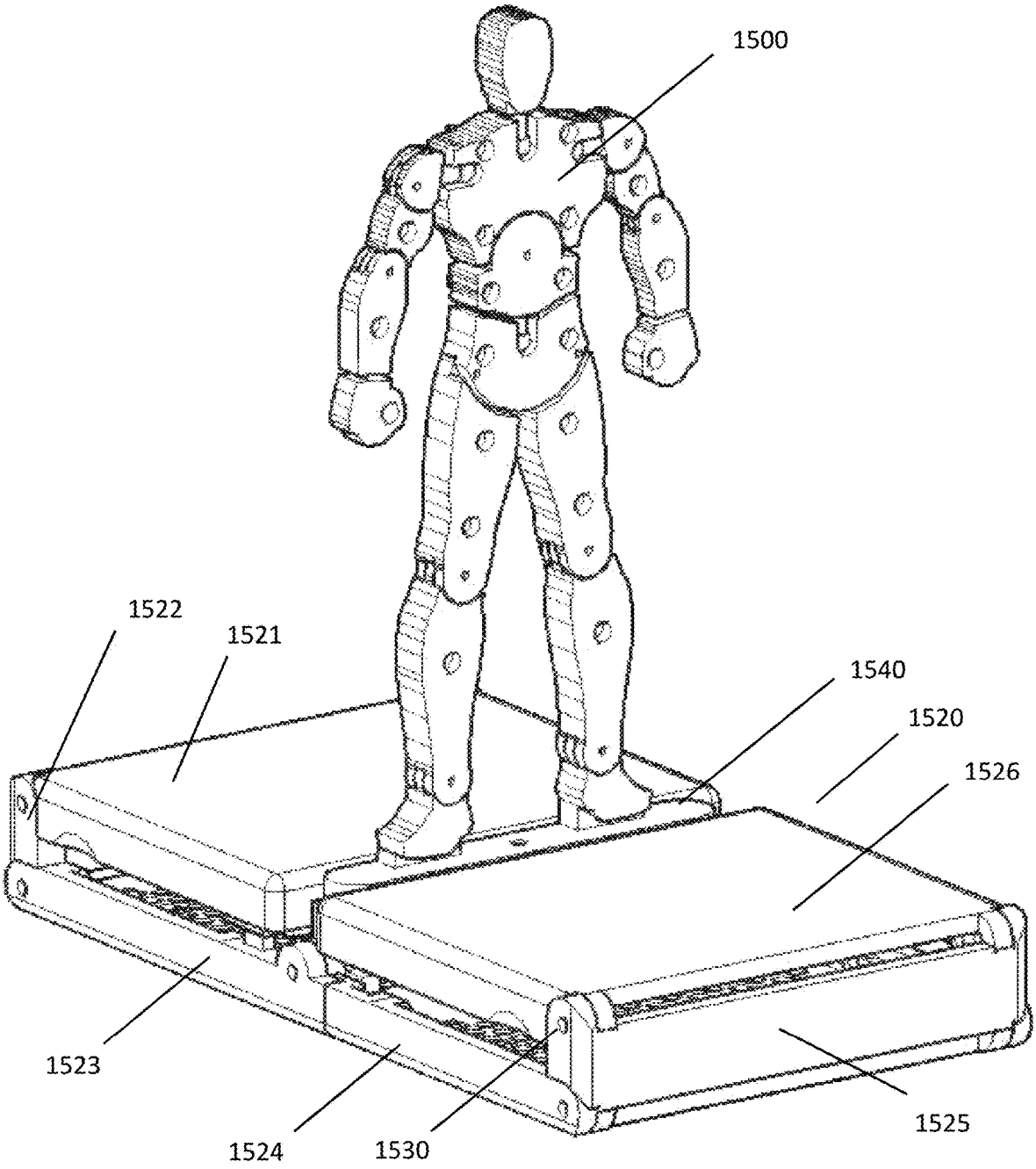
FIG. 15 is a perspective drawing of another exemplary embodiment of the present disclosure in which the case is in an open display configuration.

Another embodiment according to the present disclosure is depicted in FIG. 15. In the depicted embodiment, action figure 1500 is mounted upright via mount 1540 on case 1520, which is in the open display configuration. Case 1520 comprises a plurality of panels 1521, 1522, 1523, 1524, 1525, 1526, all of which are exterior panels, connected along parallel sides by hinges 1530. In contrast to the embodiments described above, no panel of case 1520 is disposed upright as a backdrop to action figure 1500 in the embodiment depicted in FIG. 15.

Figure 16A:
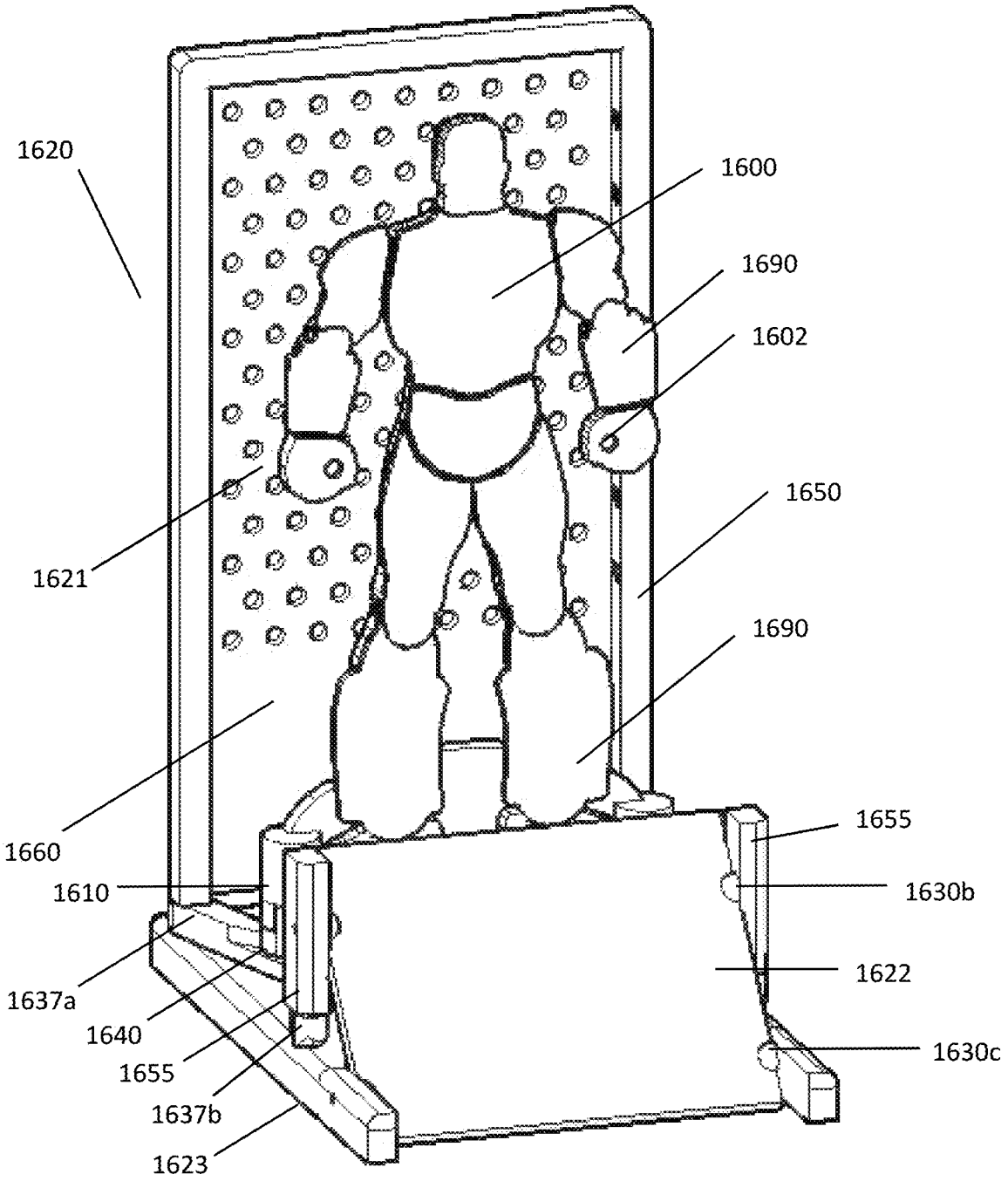
FIG. 16 consists of perspective drawings of another exemplary embodiment of the present disclosure, in which, in FIG. 16A, the case is in an open display configuration, and in FIG. 16B, the case is in an open intermediate configuration.
Figure 16B:
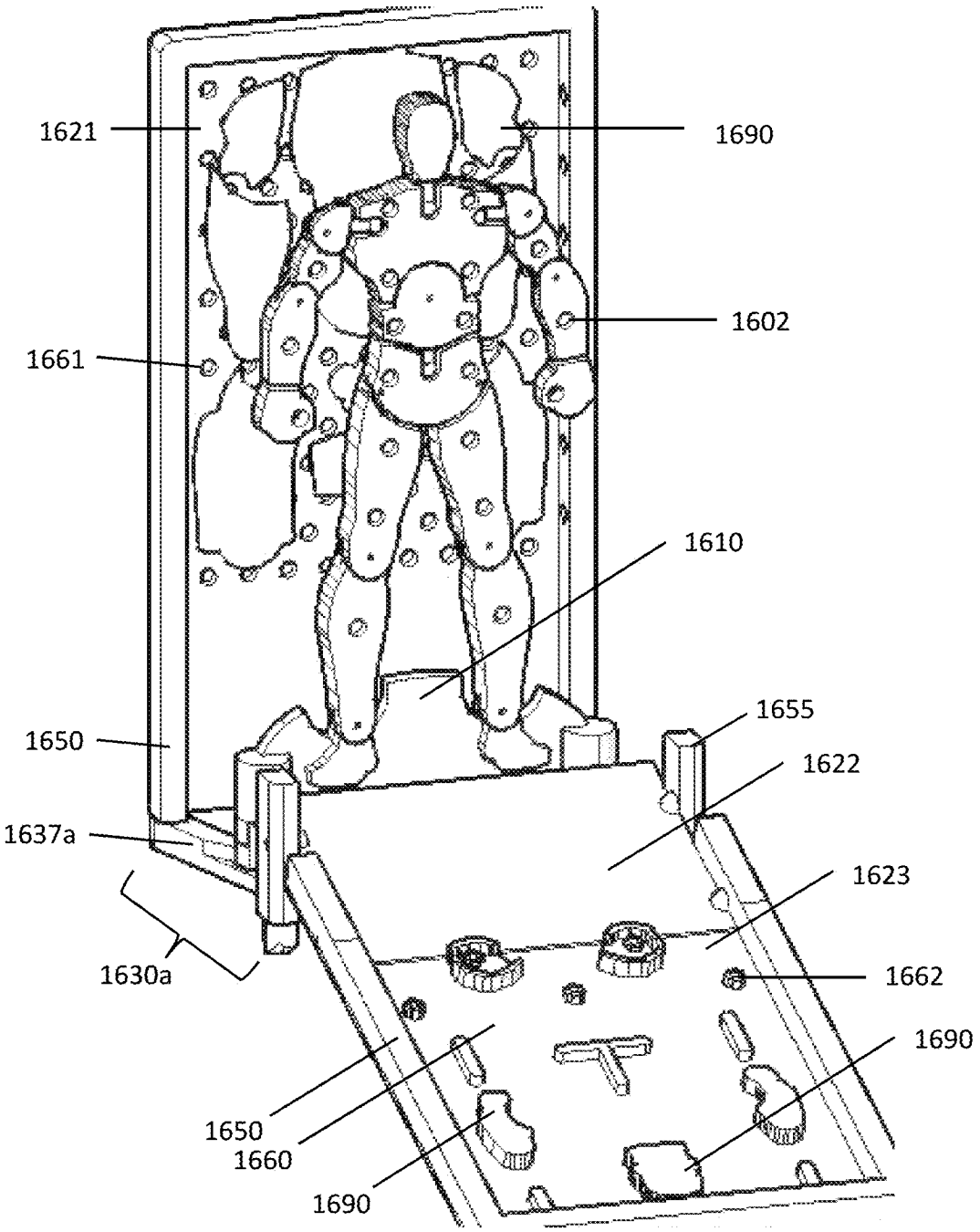

Yet another embodiment of the present disclosure is depicted in FIG. 16A and FIG. 16B. In FIG. 16A, case 1620 is shown in an open display configuration, and action figure 1600 is depicted with action figure accessories 1690 attached thereto via engagement members 1602. In FIG. 16B, case 1620 is shown in an intermediate open configuration, with action figure accessories 1690 attached to interior engagement members 1661 of panel 1621 and panel 1623. In FIG. 16A, panel 1623 has been rotated underneath the rest of case 1620 and action figure 1600, whereas in FIG. 16B, panel 1623 has not been rotated relative to 1622.

As depicted, sidewall 1650 extends orthogonally inwards at the perimeter of panels 1621, 1622, 1623 to define interior recesses 1660 therein. Engagement members 1661 and 1662 are disposed on the interior surface of the panels (interior defined relative to the closed configuration) and provide, for example, convenient storage of and access to action figure accessories 1690. As depicted, the depth of the action figure accessories 1690 when engaged with panels 1621, 1623 is less than or equal to the depth of sidewall 1650 and corresponding interior recess 1660.

The exemplary embodiment depicted in FIG. 16A and FIG. 16B comprises hinge 1630*b* connecting panels 1621 and 1622 and permitting bidirectional rotation about the axis defined by the hinge. In the depicted embodiment, the sidewall of panel 1622 is defined in part as as a pair of sidewall posts 1655. Panel 1622 is connected to sidewall posts 1655 only via hinge 1630*b*, and rotates about the axis defined by hinge 1630*b* during reconfiguration of case 1620 between the closed configuration and the open configurations depicted. Panel 1622 is connected to panel 1623 by hinge 1630*c*.

The depicted embodiment further comprises composite swivel 1630*a*. Composite swivel 1630*a* comprises a pair of swivel arms 1637*a* which connect panel 1621 and mount 1640 and a second pair of swivel arms 1637*b* which connect mount 1640 and panel 1622. In the exemplary embodiment depicted, each swivel arm 1637*a* is connected to the base of sidewall 1650 of panel 1621 by a rotating hinge, and is also connected to mount 1640 by a rotating hinge. Similarly, each swivel arm 1637*b* is connected to mount 1640 by a rotating hinge and connected to sidewall post 1655 by a rotating hinge. In the depicted embodiment, each swivel arm 1637*a* and corresponding swivel arm 1637*b* (i.e., each pair of swivel arms 1637*a*, 1637*b*) is connected to mount 1640 by a single hinge. Action FIG. 1600 is mounted to case 1620 at mount 1640 via stand 1610.

Composite swivel 1630*a* is adapted to be collapsed into a low-profile configuration (e.g., to permit reconfiguration of the case to the closed configuration) and extended as depicted to translate mount 1640 laterally from panel 1621 and similarly translate panel 1622 relative to mount 1640 and panel 1621. Swivel arms 1637*a* and 1637*b* are adapted such that swivel arm 1637*b* aligns underneath corresponding swivel arm 1637*a* when composite swivel 1630*a* is collapsed.

Figure 17:
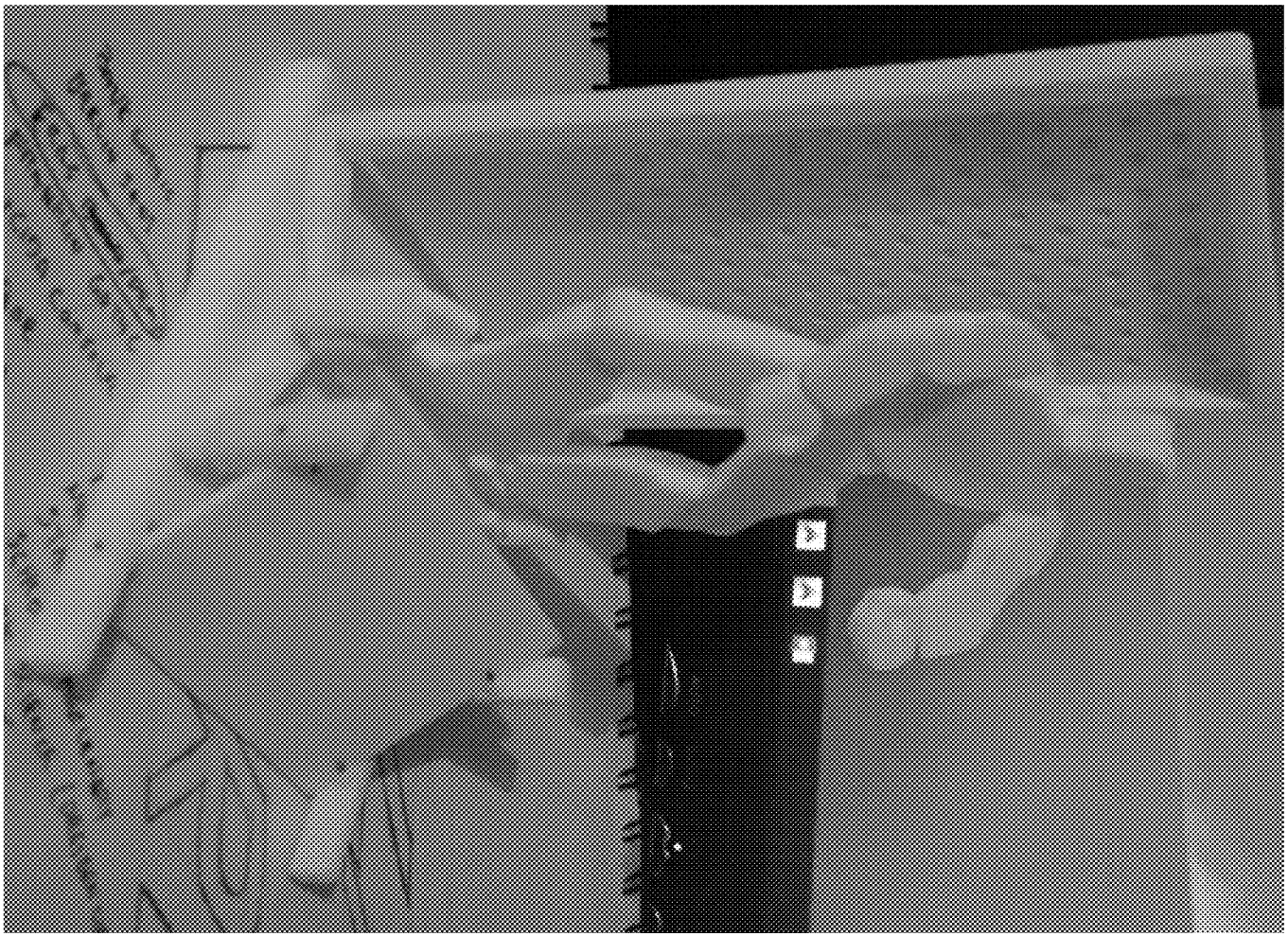
FIG. 17 is a photograph of a prototype corresponding to the embodiment of FIG. 16.
Figure 18:
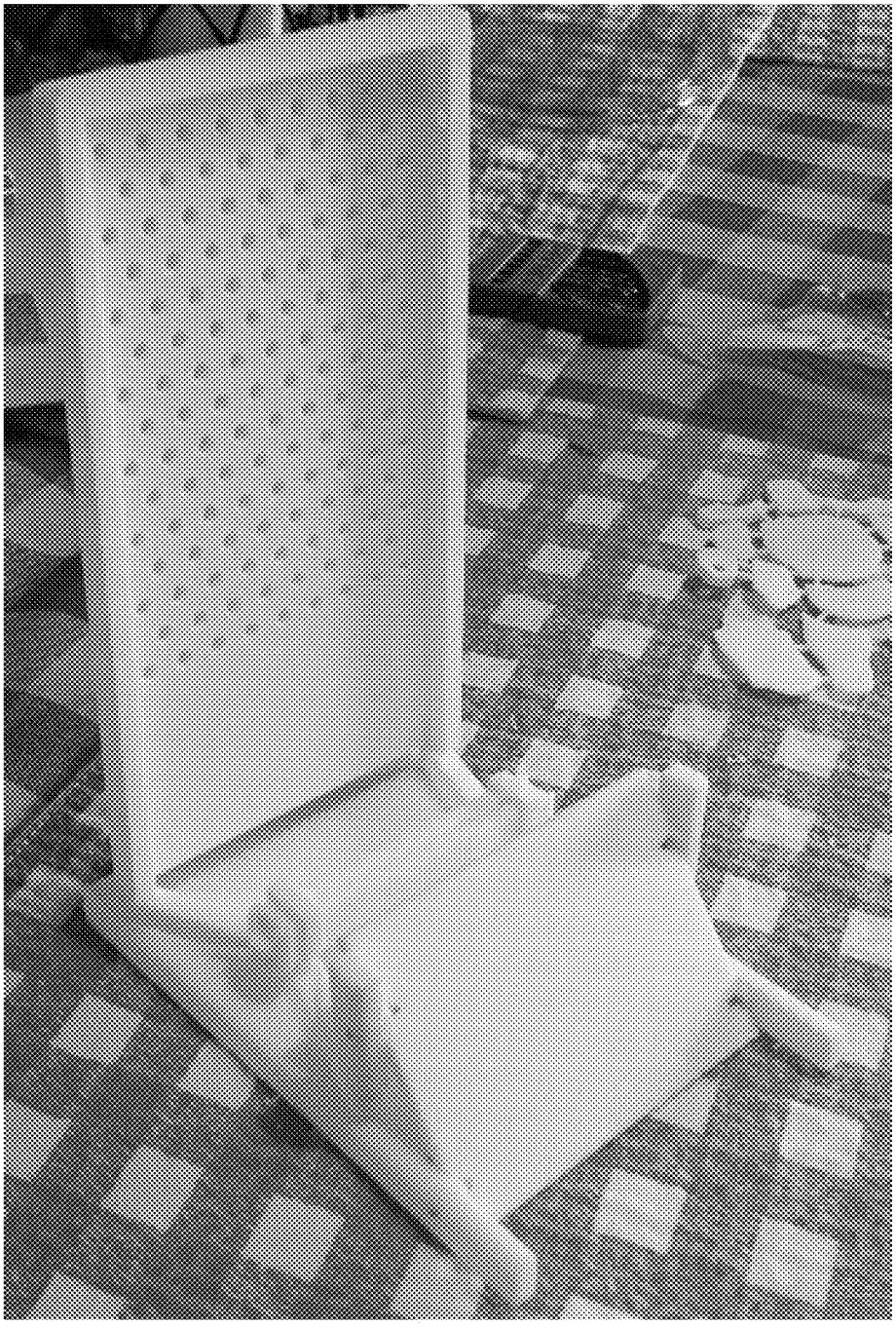
FIG. 18 is a photograph of the prototype of FIG. 17 in which the action figure is detached from the case.
Figure 19:
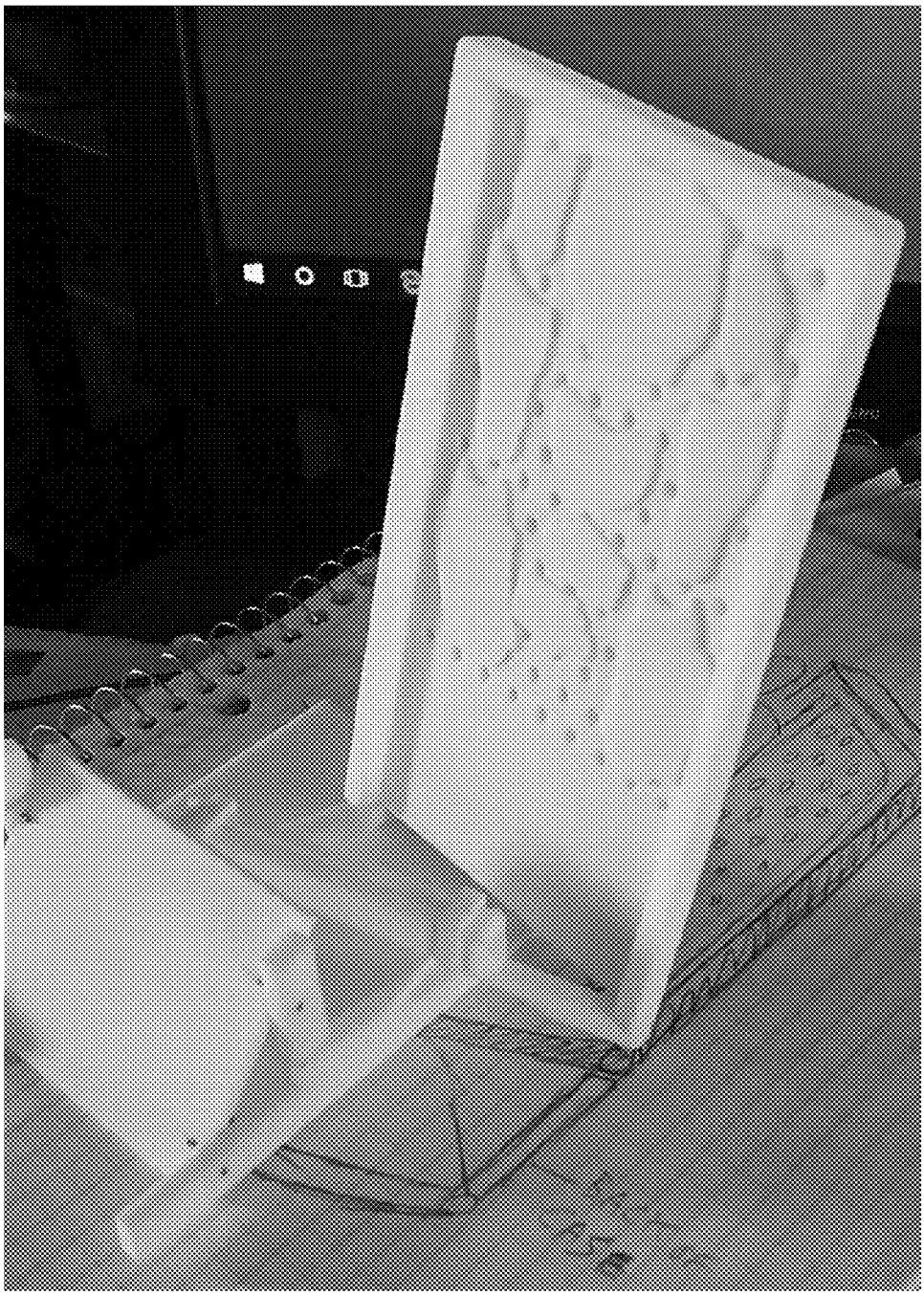
FIG. 19 is a photograph of the prototype of FIG. 18 in which accessories have been attached to the case and in which the case is a rotated open display configuration.
Figure 20:
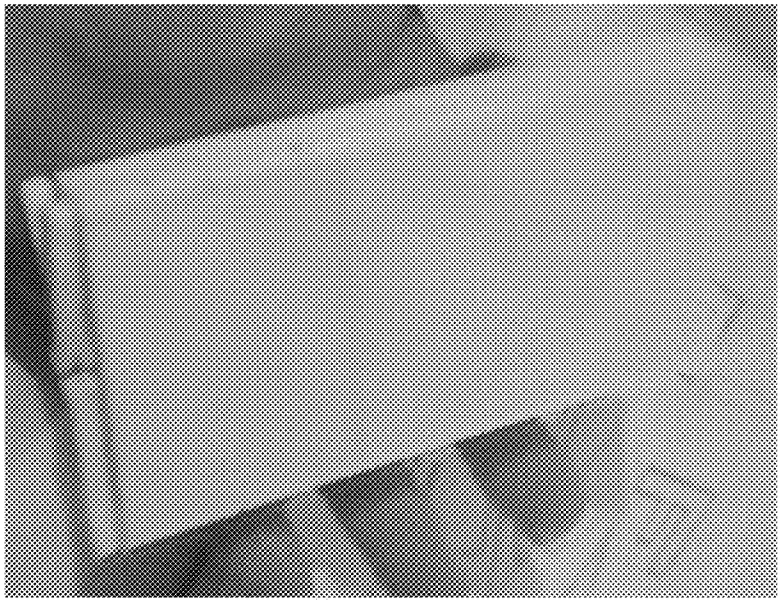
FIG. 20 is a photograph of the bottom end, back and side of the case prototype of FIG. 17 in the closed configuration.

Prototypes corresponding to the exemplary embodiment depicted in FIG. 16A and FIG. 16B are depicted in FIG. 17, FIG. 18, FIG. 19, and FIG. 20. FIG. 17 and FIG. 18 depict the exemplary embodiment in a first open display configuration. In FIG. 17, the action figure is attached to the mount, and action figure accessories are attached to the action figure. In FIG. 18, the action figure is detached. In FIG. 19, the exemplary case embodiment is depicted in a second open display configuration in which the mount and rear backdrop panel are skewed relative to the foreground placard panel. Certain action figure accessories are attached to and visible upon the rear panel in FIG. 19. In FIG. 20, the exemplary embodiment is depicted in the closed configuration. The arrangement and configuration of the complementary pairs of swivel arms and their respective interfaces with the panels and mount are apparent.

Figure 21:
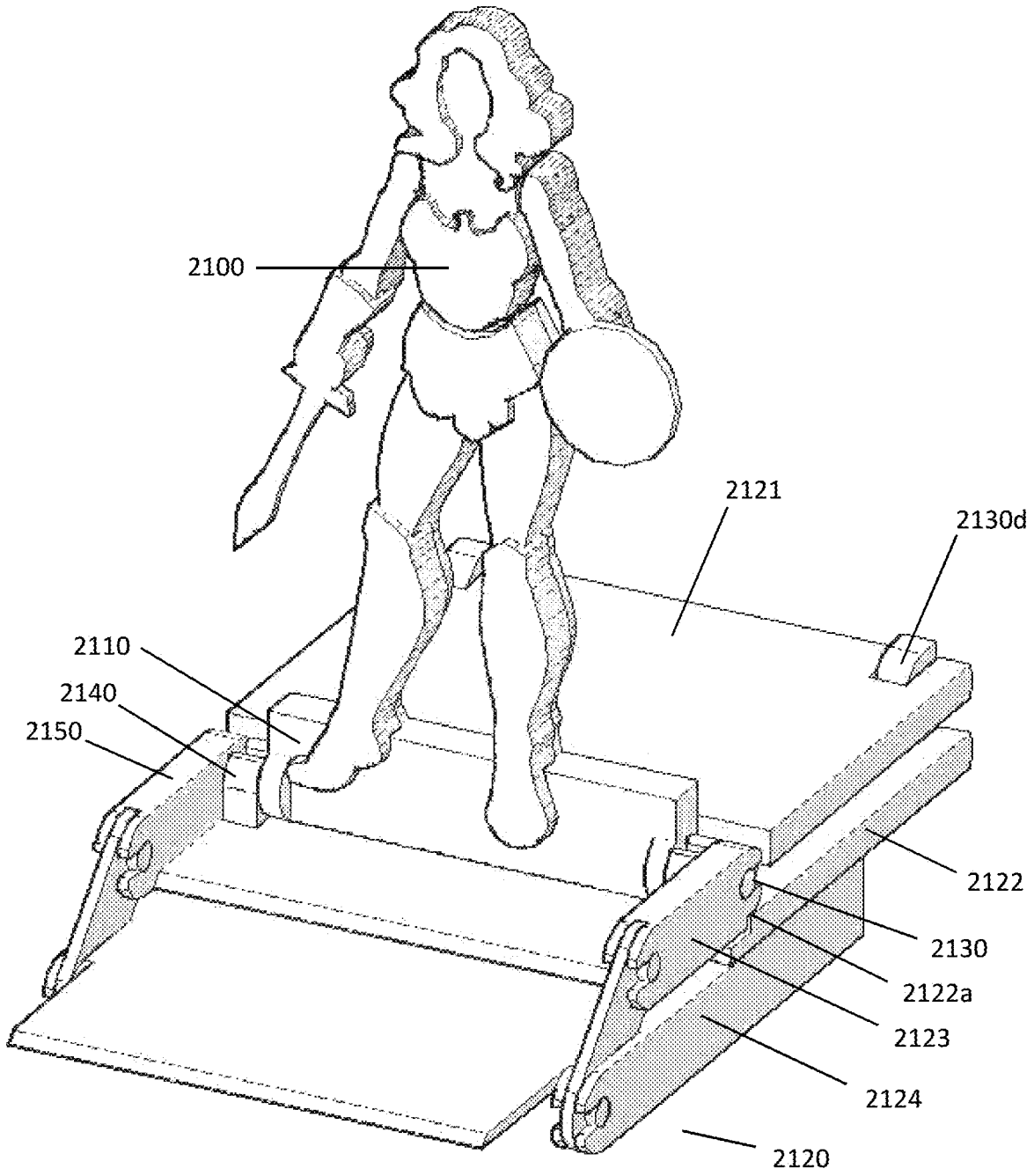
FIG. 21 is a perspective drawing of another exemplary embodiment of the present disclosure in which the case is in an open display configuration.

Another exemplary embodiment of the present disclosure is depicted in FIG. 21. As depicted, action figure 2100 is mounted to, displayed upright by, and freestanding upon case 2120 in an open display configuration. Panel 2121 is joined to panel 2122 by track hinge 2130*d*, which permits panel 2121 to rotate around and fold over panel 2122 as the case is reconfigured. Another hinge connects panel 2122 and panel 2123 along interface 2122*a*, permitting panel 2122 and connected panel 2121 to rotate over panel 2223 and connected panel 2124 during reconfiguration from the open display configuration as shown to the closed configuration. Action FIG. 2100 is engaged to mount 2140 via stand 2110 and hinge 2130. Hinge 2130 is integral with stand 2110 and permits rotation of the action figure from an orientation parallel to standing surface and to sidewall 2150 in the closed configuration to the generally perpendicular orientation as shown.

Figure 22:
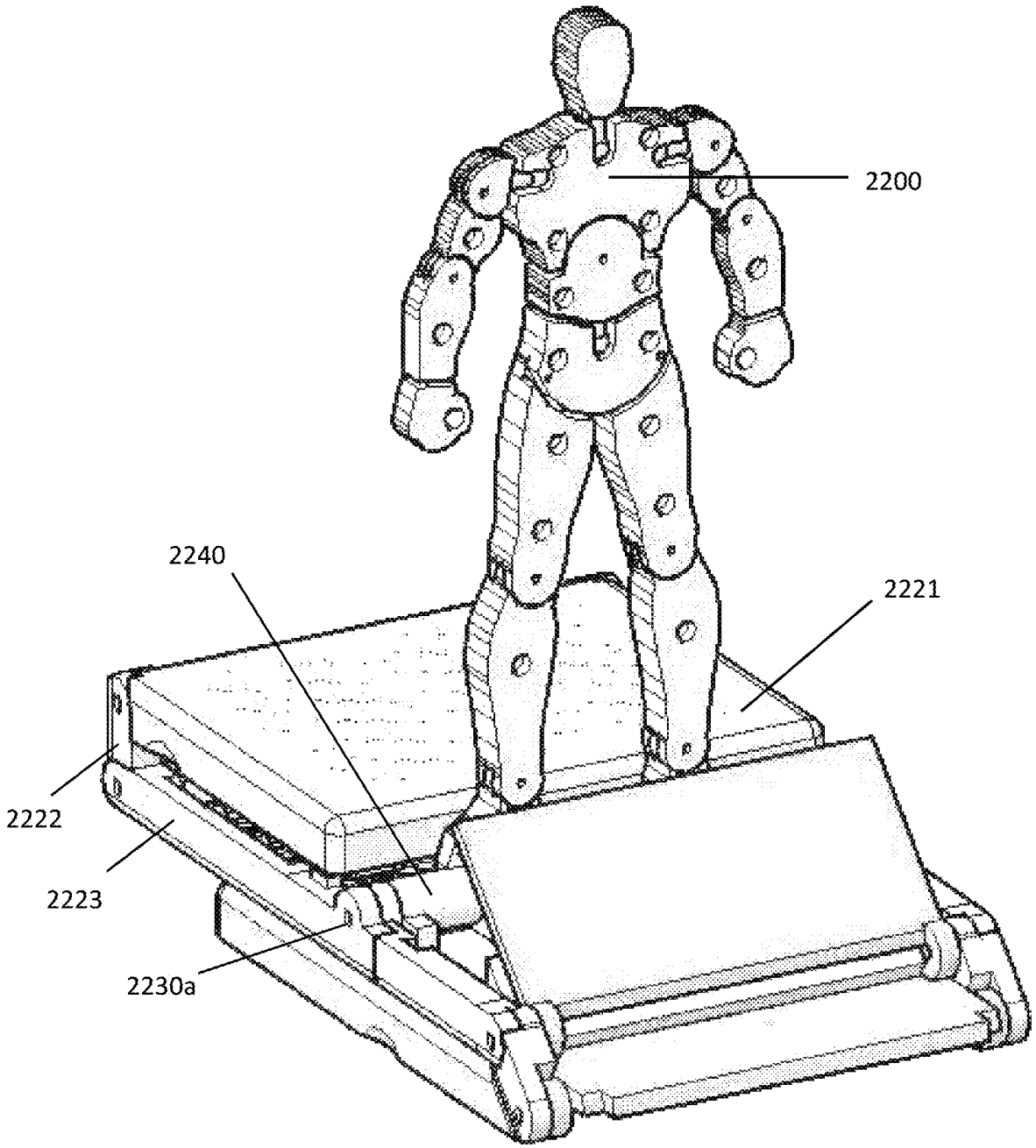
FIG. 22 is a perspective drawing of another exemplary embodiment of the present disclosure in which the case is in an open display configuration.
Figure 23:
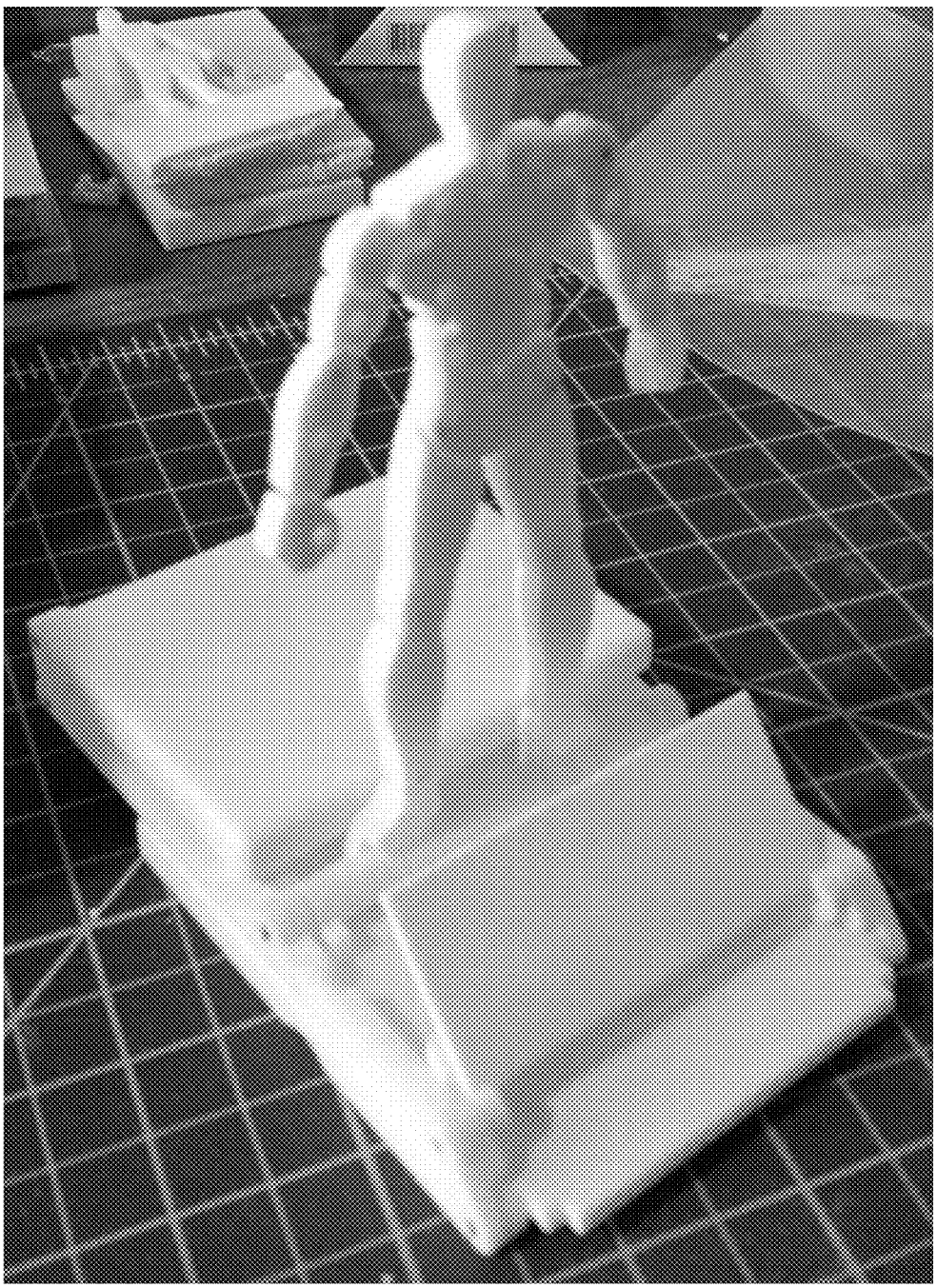
FIG. 23 is a photograph of a prototype corresponding to the embodiment of FIG. 22.

A further exemplary embodiment of the present disclosure is provided in FIG. 22. Action FIG. 2200 is displayed upright on the case in an open display configuration, engaged with mount 2240, which is disposed on hinge 2230*a*. Hinge 2230*a* is disposed beneath action FIG. 2200 and at a bottom end of the case when in the closed configuration. Panel 2222 is connected by hinges along parallel sides thereof to panel 2221 and panel 2223. A prototype corresponding to the embodiment illustrated in FIG. 22 is depicted in FIG. 23.

Figure 24:
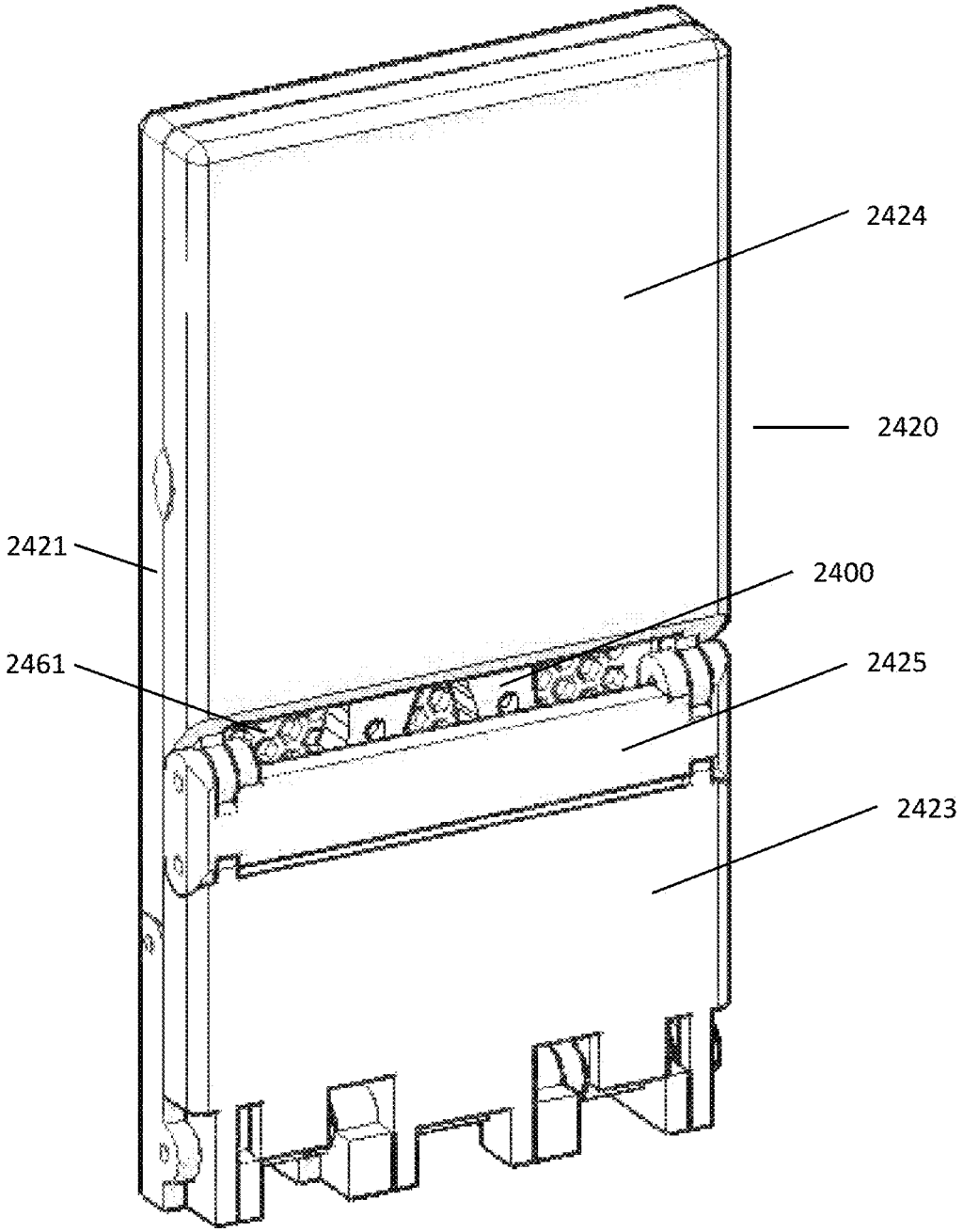
FIG. 24 is a perspective drawing of another exemplary embodiment of the present disclosure in which the case is in the closed configuration.

Another illustrative embodiment according to the present disclosure is provided in FIG. 24. This embodiment generally corresponds with the embodiment depicted in FIG. 6, and FIG. 6C in particular, but in FIG. 24, panel 2424 of case 2420 is truncated to reveal the arrangement of the underlying elements. In particular, the front of action FIG. 2400, engagement elements 2461 of the interior surface of panel 2421, and panel 2425 are revealed by trunctation of panel 2424.

Figure 25:
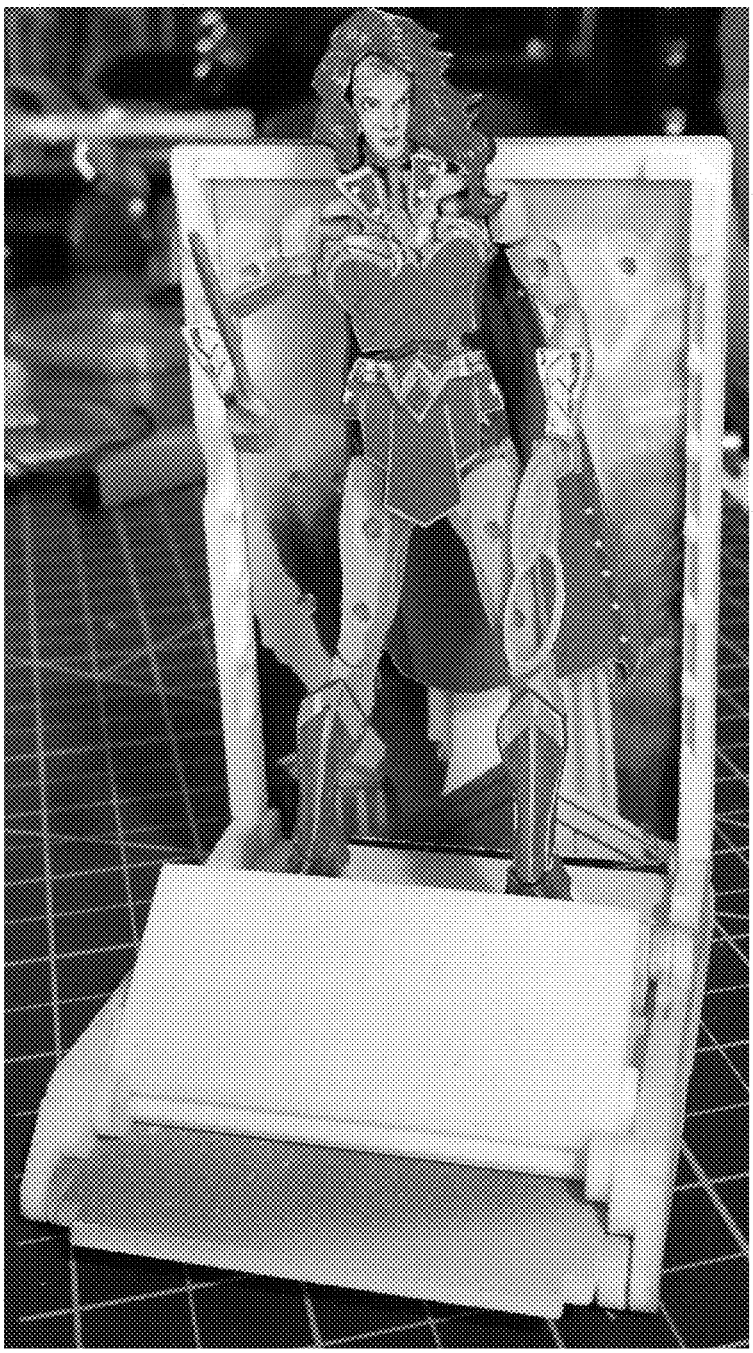
FIG. 25 is a photograph of an exemplary prototype according to the present disclosure with illustration provided on the action figure and rear panel.

Another prototype according to the present disclosure is depicted in FIG. 25. In the depicted embodiment, additional design elements are apparent. In particular, the action figure and accessories are stylized and illustrated to depict DC Comics' popular Wonder Woman® character, and the rear panel is illustrated to depict a corresponding environment. The dioramic effect of the superposition of the action figure and interior case panel provided by this exemplary embodiment is apparent from FIG. 25.

Figure 26:
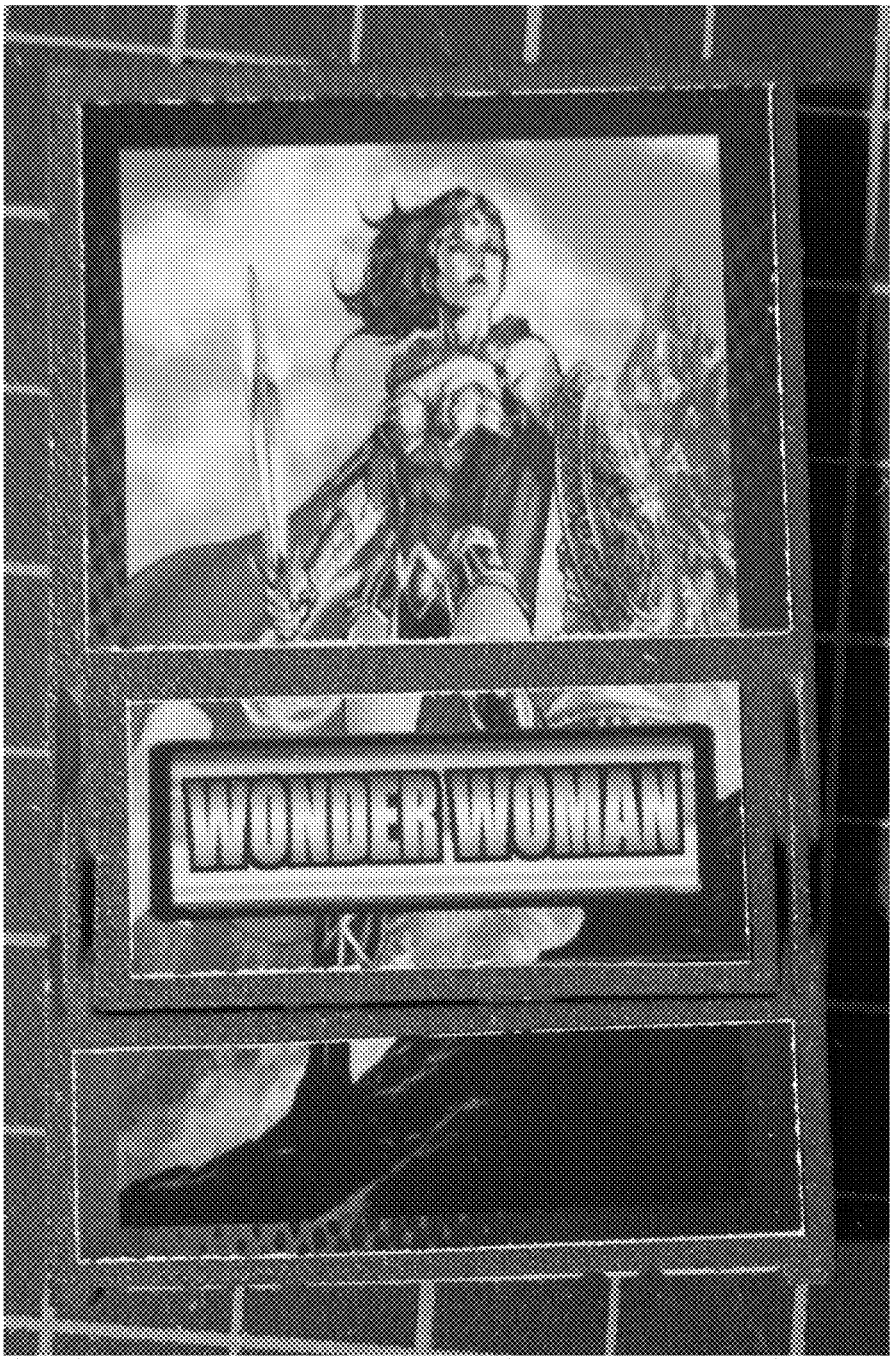
FIG. 26 is a photograph of the front of an exemplary case prototype according to the present disclosure with printed indicia and illustrations on exterior surface panels of the case, which is in the closed configuration.
Figure 27:
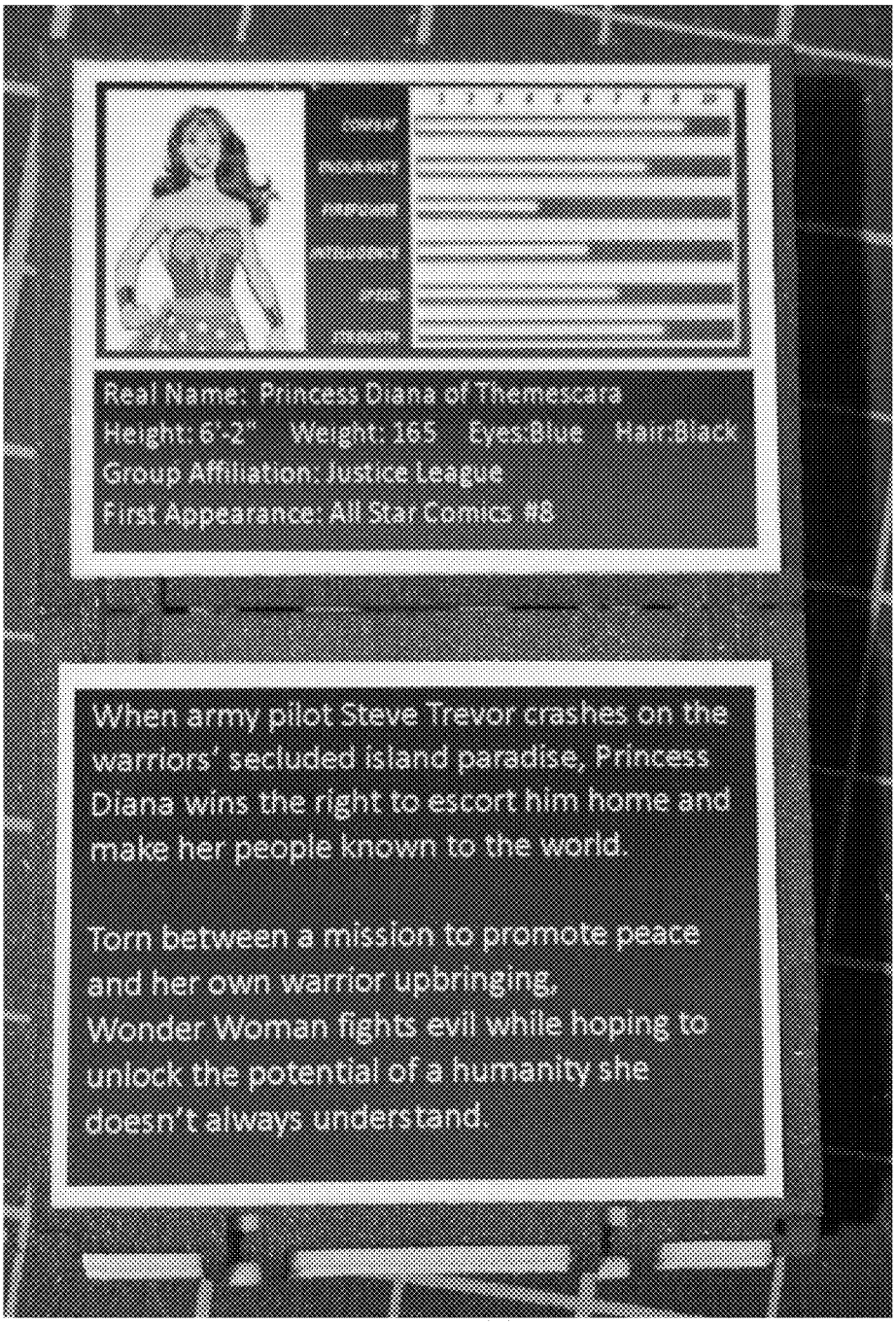
FIG. 27 is a photograph of the back of the exemplary case prototype with printed indicia and illustrations on exterior surface panels of the case, which is in the closed configuration.
Figure 28:
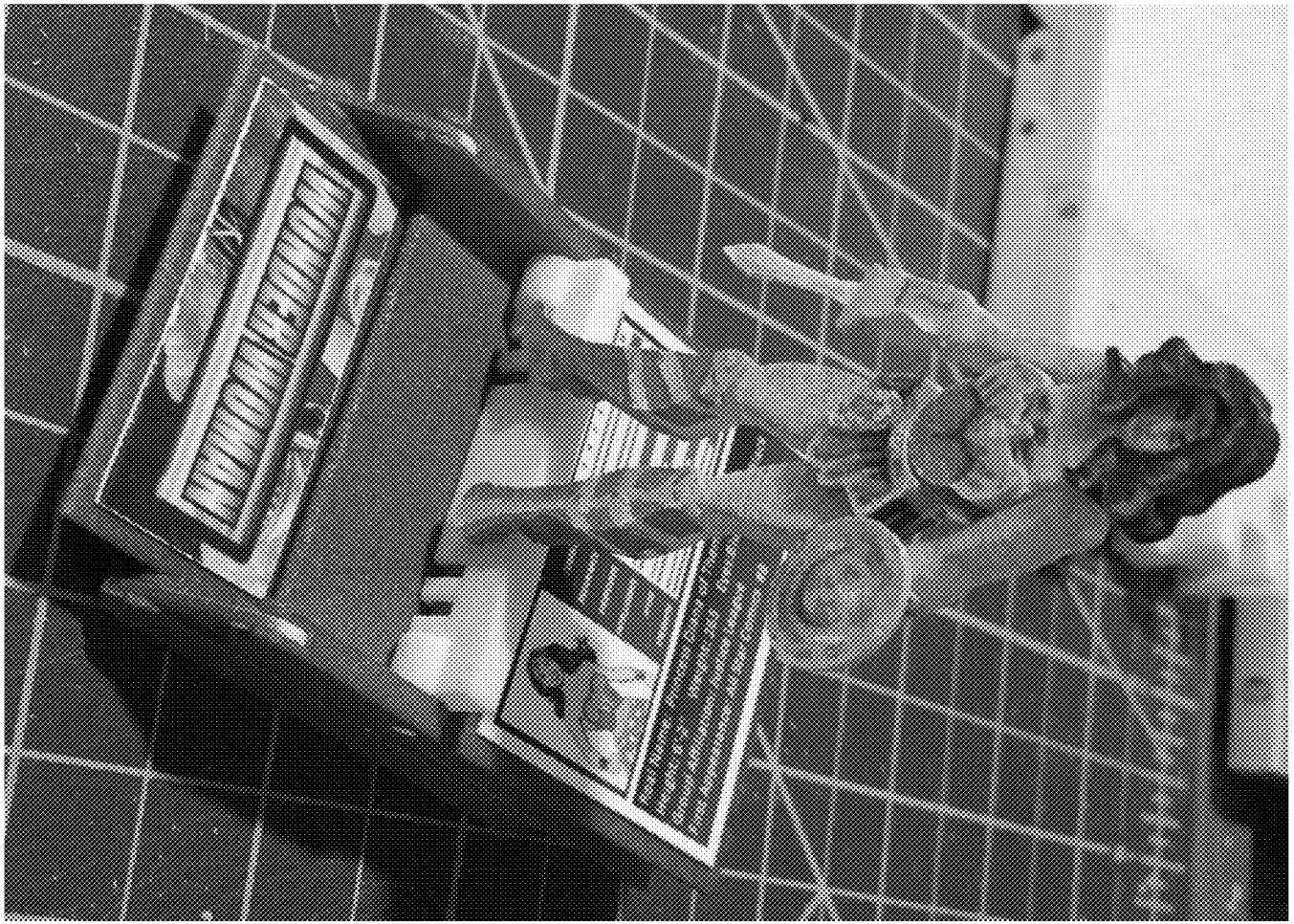
FIG. 28 is a photograph of another exemplary prototype according to the present disclosure in the open display configuration.

FIG. 26 and FIG. 27 depict, respectively, the front and back of the case, in the closed configuration, of another prototype according to the present disclosure. The same prototype is depicted in FIG. 28 with the case in an open display configuration. As shown in FIG. 26 and FIG. 27, printed labels identifying, illustrating, and describing the character represented by the action figure are provided on the exterior front and back surfaces of the case in the closed configuration. In the open configuration, these surfaces are rotated such that they are also displayed when the case is in an open display configuration.

Figure 29:
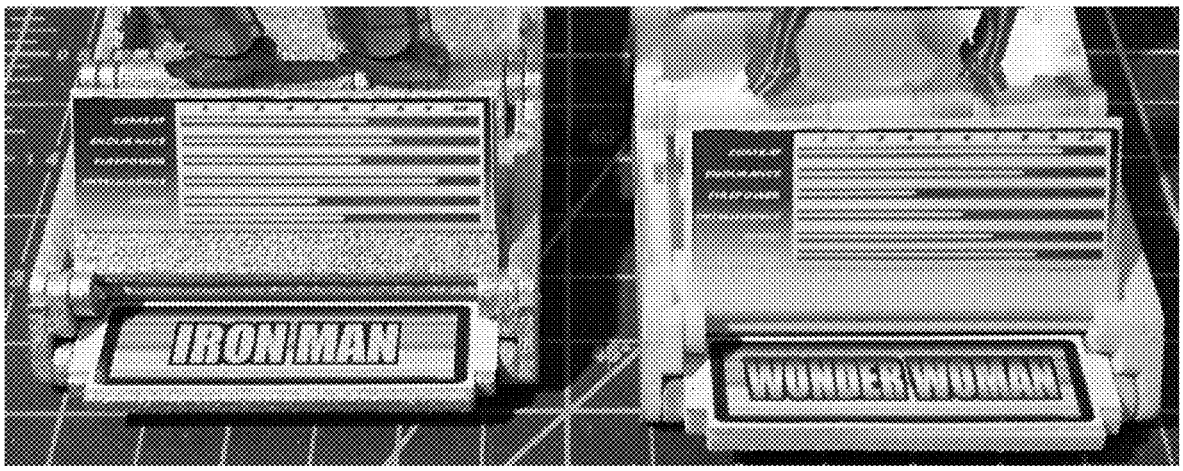
FIG. 29 is a photograph of the base and foreground of two additional exemplary prototypes according to the present disclosure, in which the cases are in the open display configuration.

Additional prototypes are depicted in FIG. 29. In particular, the bases of two prototypes are depicted in an open configuration, with labels provided to identify their corresponding characters and representative detail regarding the characters provided on the foreground placard panel. Information of this sort is particularly well-suited for gaming purposes.

Figure 30:
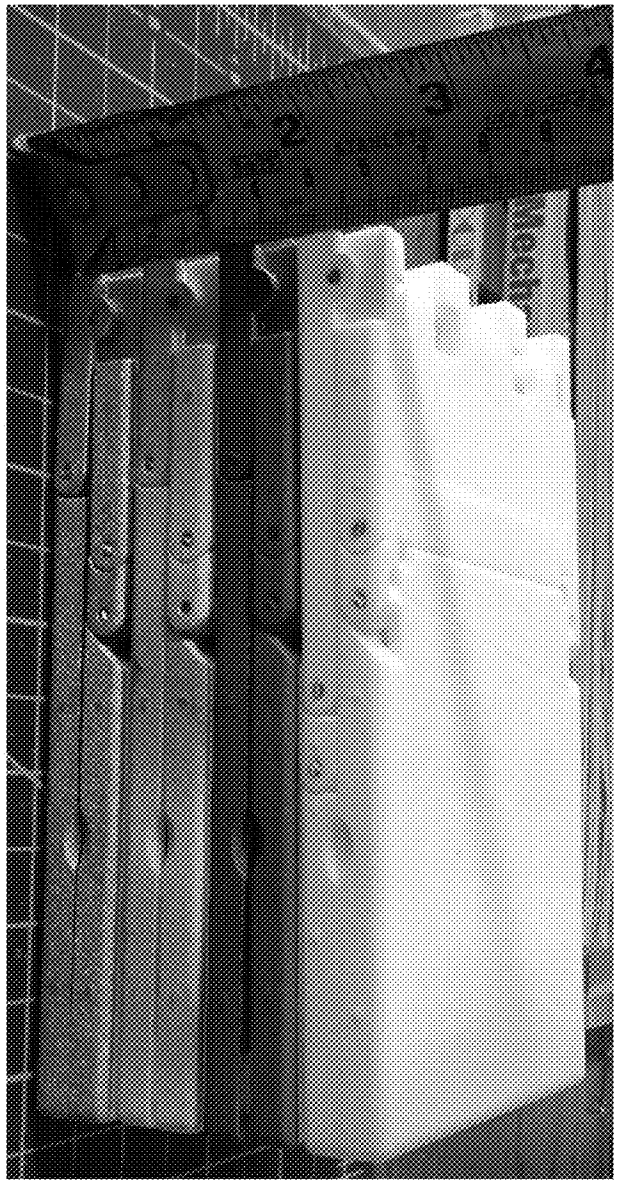
FIG. 30 is a photograph of additional exemplary prototypes according to the present disclosure which are in the closed configuration and stacked adjacent a measuring tape.
Figure 31:
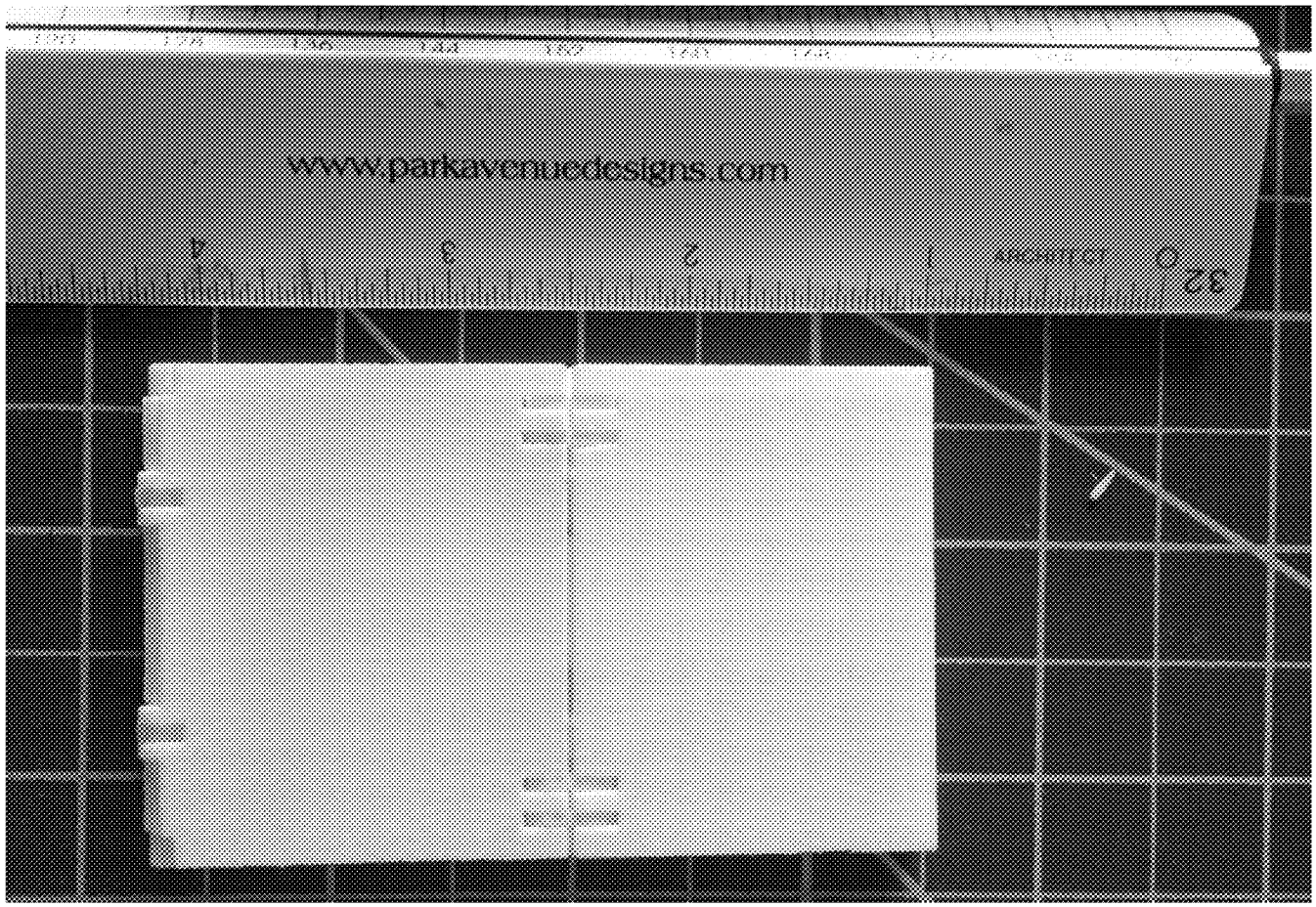
FIG. 31 is a photograph of another exemplary prototype according to the present disclosure, in which the case is in the closed configuration next to a ruler.

FIG. 30 and FIG. 31 depict representative prototypical embodiments of the present disclosure next to reference measuring tools. Although provided for purpose of illustration and example only, these figures illustrate the relative dimensions and convenient form factor of certain embodiments according to the present disclosure.

The foregoing embodiments, which are nonlimiting examples, illustrate a number of general concepts defining the various embodiments of the present disclosure. For example, embodiments of the present disclosure combine an action figure and a reconfigurable case therefor, which case comprises a mount and a plurality of panels, each panel of the plurality connected to at least one other panel of the plurality by a panel connector, such as a hinge. Additional nonlimiting general and specific features and embodiments are described hereinbelow.

Terminology

The articles, kits, and systems exemplified herein, and the terminologies used to describe and claim them, are readily understood by the person of ordinary skill in the art in light of the present disclosure, including the figures, and are to be construed according to same. Broadly embodied, the present disclosure provides, in some aspects, an article of entertainment comprising an action figure and a case therefor, wherein the case is adapted, while the action figure is connected thereto, to stably assume and reversibly transform between a closed configuration in which the action figure is enclosed within the case and at least one open display configuration in which the action figure is unenclosed by and displayed upon the case. In certain embodiments, the action figure is displayed in an orientation generally perpendicular to the standing surface of the case In the context of the present disclosure, the term "adapted to," with reference to a specified function means to have at least one structural element dimensioned and/or purposed for providing such function. In several instances, for example, the term "adapted to" refers to the relative material properties, dimensions, connections, and/or arrangements of several or all structural components of the article or articles so adapted, providing in combination a recited function. In particular, the term "adapted to" does not mean, and generally excludes, structures which may be at least theoretically capable of a function but do not possess structural elements specifically purposed for providing such function.

As used herein, the meaning of the term "generally" is context-dependent. In the context of relative angular orientation, the term "generally" means within 30 degrees in either direction. For example, the term "generally perpendicular" means a relative angular orientation of 60° to 120°. In the context of the characterization of a surface, the term generally is used to exclude minor and/or regular interruptions. For example, the term "generally flat" refers to surfaces that are entirely flat, surfaces that include regular interruptions, such as a "pegboard" of female engagement members, surfaces that include thin seams where discrete elements (e.g., exterior panels) abut, and surfaces that include engagement elements the area of which is small (i.e., 5%). Surfaces which, if disposed on a standing surface, would not lie parallel to the standing surface, are not "generally flat" as the term is used herein. In the context of case and panel shape, the term "generally" includes imperfect shapes that can be superimposed on perfect shapes of corresponding dimensions with a high degree of overlap. For example, the term "generally rectangular panel" refers to panels having a shape in plan view defined primarily by two pairs of parallel sides, the sides of each pair perpendicular to the sides of the other. As used herein, the term "generally rectangular panel" includes rectangular panels, otherwise rectangular panels having beveled or rounded corners, otherwise rectangular panels having bilaterally symmetrical hinge extensions, otherwise rectangular panels having extensions and recesses along one side thereof, and panels primarily defined by 2 pairs of parallel sides as described which, if superimposed in plan view on a rectangle of like perimeter, would have at least 80% perimeter coextension and/or at least 80% area overlap. Each of the panels depicted in the embodiments of FIG. 11 and FIG. 13, for example, is "generally rectangular" as used herein. The term "generally rectangular" as used herein does not include triangular or pentagonal shapes, for example, nor any shape not defined primarily by 4 sides as described.

The term "configuration," with reference to a case according to the present disclosure, refers to an arrangement of component elements (e.g., exterior panels) of the case. With reference to a case configuration, being adapted to "stably assume" such configuration means having adaptations provided to maintain such configuration indefinitely (or until acted upon by an external nongravitational force), and excludes structures at least theoretically capable of assuming such configuration only temporarily (e.g., elastically) or by plastic deformation. With reference to two or more configurations, being adapted to "reversibly transform between" the configurations refers to having adaptations provided to facilitate transformation to and from each configuration without structural damage or undesired deformation. As evident from the present disclosure, such adaptions expressly include those which facilitate manual transformation between configurations, as well as those which provide and/or align normal, frictional, elastic, magnetic, and/or mechanical forces to stabilize a configuration.

In certain presently preferred embodiments, the cases comprise a plurality of exterior panels and panel connectors, wherein: each exterior panel is connected by a panel connector to at least one other exterior panel; each panel connector connects one side of one exterior panel to one side of another exterior panel; at least one exterior panel has two sides which are parallel to one another and to the width or length of the case in the closed configuration; each of said parallel sides of said at least one exterior panel is connected to another exterior panel by a panel connector; and each panel connector is adapted to permit rotation about and/or translation along a single axis or perpendicular axes defined thereby. In certain of these embodiments, the cases comprise three or more exterior panels and/or at least one interior panel connected to an external panel by a panel connector. In certain of these embodiments, each panel connector comprises a hinge, a swivel, and/or a track. In certain of these embodiments, at least one panel connector comprises an intermediate structure, such as a hinge offset, and/or a composite intermediate structure, such as a hinge offset mounted on a swivel arm or a contiguous track-and-hinge interface.

According to the present disclosure, the term "panel" refers generally to a discrete structural component of the case, which component has at least one surface defined by its length and width that is generally flat. The term "exterior panel" refers to a panel having a surface disposed on the exterior of the case in the closed configuration, while the term "interior panel" refers to a panel all surfaces of which are enclosed by the case in the closed configuration.

The term "panel connector" refers to a structural element adapted to physically connect a panel at or along a side thereof to or along a side of a physically discrete second panel, and to permit relative rotation about and/or translation along an axis or two perpendicular axes defined by the panel connector. For the purposes of the present disclosure, perpendicular axes include pairs of orthogonal axes in three dimensions (i.e., X, Y, and Z).

According to the present disclosure, the term "hinge" and the related terms "swivel" and "pivot" refer to structural elements adapted to connect two discrete components of a case or action figure and to permit bidirectional rotation between the components about an axis defined by the structural element. For the purpose of the present disclosure, the term "hinge" refers more specifically to a structure connecting elements such as panels at or along a side thereof and/or defining an axis of rotation parallel to such side, the term "swivel" refers to a structure connecting and translating components via at least one fixed rotating arm, and the term "pivot" refers to a structure connecting at or near the midline of the connected structure, and defining an axis of rotation therealong. The term "track" refers to a longitudinal surface or surfaces configured to engage another panel or a portion or extension thereof and to permit sliding axial translation therealong. Hinges, swivels, and pivots can have any configuration known in the art, with the proviso that hinges formed by scoring or defining an axis of material weakness in a contiguous structural element are not included unless specifically recited as such.

Although the terms "panel connector," "hinge," "swivel," "pivot," and "track," are referred to or recited herein, for purpose of clarity, in the singular, such terms expressly include two or more like elements which cooperate to provide a common function, will be understood the person of ordinary skill in the art to include same, and are to be construed accordingly. For example, with respect to the exemplary embodiment depicted in FIG. 4, although reference is made to a series of singular hinges 430, it is evident from FIG. 4 and the descriptions of same that the term refers to and expressly includes bilateral pairs of hinges defining a common axis of rotation therebetween.

Similarly, although the present disclosure identifies panel connectors, hinges, swivels, pivots, and tracks as discrete structural components for purpose of clarity, such terms expressly include functionally corresponding elements defined in whole or in part by the panels themselves, will be understood the person of ordinary skill in the art to include same, and are to be construed accordingly. For example, with reference to the same exemplary embodiment of FIG. 4, it is evident from FIG. 4 and the descriptions of same that the term "hinge" refers to and expressly includes the hinge defined by the cooperation of pins and/or barrels defined in the panels themselves.

In certain embodiments, portions of the case comprise magnets or magnetizable metals to retain the case in an open configuration and/or a closed configuration. For example, in certain embodiments, magnets are placed at surfaces of the case which are in contact when the case is in the open configuration and surfaces in contact when the case is in the closed configuration such that a degree of force is required to open and close the case. In additional and alternative exemplary embodiments, retention is provided via at least one spring hinge.

In certain embodiments of the present disclosure, certain hinges are configured to lock at one or more positions. For example, in certain embodiments, at least one region of the hinge is provided with complementary protrusions and recesses such that the hinge and connected panels are retained in place by friction unless and until a degree of force is applied to further rotate the panels about the hinge. In one exemplary embodiment, the hinge connecting the first and second panels is configured to lock when the panels are disposed at a 90 degree angle relative to each other. In another exemplary embodiment, the hinge is configured to lock when the panels are disposed at 45, 90, and 135 degree angles relative to one another. In additional and alternative embodiments, retention in an open configuration is provided via at least one spring hinge.

In certain embodiments of the present disclosure, certain articles and/or components thereof are adapted to engage one or more other articles or components. In certain embodiments, two or more articles are adapted for complementary engagement. As used herein, the term and principle of "engagement" refers to a physically contacting arrangement between engaging and engaged elements that results in forces sufficient to retain such arrangement in the absence of an external nongravitational force. Said forces include, for example, normal, frictional, magnetic, and/or elastic forces. As used herein, the term "adapted to engage" refers to one or more structural adaptations to an engaging element provided for the purpose of facilitating and/or maintaining engagement of same to the element thereby engaged, and the term "adapted for complementary engagement" refers to mutual adaptations for same. Exemplary adaptations for engagement and complementary engagement include friction- or snap-fit dimensioning of an engaging element relative to an element engaged thereby, provision of cooperative surface elements, such as male and female engagement members, interlocking or interdigitating surfaces, and/or incorporation of permanent magnets, hook-and-loop fastener elements, and the like onto engaging surfaces. In certain exemplary embodiments, at least one surface of the case is compatible for engagement with Lego® or other interlocking systems. For example, in certain embodiments, an exterior surface of the case is configured to connect to Lego® such that the disclosed articles can be incorporated into a Lego® environment. In certain exemplary embodiments, an exterior surface of the case is configured to permit incorporation into a board game or strategy game.

Action Figures and Stands

The action figures of the present disclosure are generally designed and dimensioned to fit within the complementary cases therefor. As discussed below, the cases in turn are generally designed to have the shape of a polygonal prism and a relatively low profile/depth/thickness.

The action figures comprise one or more component elements defining the body thereof. In those embodiments comprising multiple elements, the elements are connected by joints, such as hinges and/or ball-and-socket joints. In the exemplary embodiments discussed above, the major surfaces of the action figures and their component element(s) are essentially flat. In certain embodiments of the present disclosure, however, the action figure and component element(s) of same are contoured, such as on the front/forward surface or all surfaces thereof. Additionally or alternatively, the action figure accessories (discussed below) can be contoured. In preferred embodiments, the action figures are complementary to the cases therefor, such that the action figure can be securely enclosed within the cases in the closed configuration. In further preferred embodiments, the action figure accessories are similarly complementary, such that the action figures can be securely enclosed within the cases while action figure accessories are engaged to the cases and/or action figures.

In certain embodiments, one or more joints between elements of an action figure is adapted for manual movement and posing, such as by incorporation of a snap-fit and/or friction-fit hinge or ball-and-socket arrangement therebetween. In certain embodiments, the action figure or one or more elements thereof is adapted to move automatically or semi-automatically, such as by incorporation of spring-loaded joints, mechanical or motorized gears, pistons, or drivers, and the like. In certain embodiments, including certain of the systems described below, the action figure is adapted to move automatically in response to input from an integrated circuit or central processor to which it is operably linked.

In further exemplary embodiments, the action figure comprises elastic (e.g., shape memory) components such that the action figure is compressed while the case is in the closed configuration and reconfigures to a contoured form while uncompressed (i.e., while the case is in an open configuration). In still further embodiments, certain elements of the action figure are dimensioned to collapse or telescope within adjacent elements so as to permit reversible reconfiguration between a storage configuration of reduced height and/or depth and a display configuration with increased height or depth.

In certain embodiments, the height of the action figure is at least 50% of the length of its case. In certain embodiments, the height of the action figure is at least 66% of the length of its case. In certain embodiments, the ratio of the height of the action figure to the length of its case is 0.7, 0.75, 0.8, 0.85, 0.9, or greater. In additionally preferred embodiments, the thickness or depth of the action figure in its low-profile configuration is about one inch or less, or half an inch or less, or one quarter of an inch or less.

By way of further example, in certain embodiments, the action figures themselves are adapted to be reconfigured, such as by redimensioning/transforming from a storage configuration to a display configuration or interactively during use. For example, in certain embodiments, an anthropomorphic action figure comprises at least one hinge at, for example, the waist, permitting 180° rotation in the transverse plane, thereby allowing the action figure to fold to reduce its height/length. In additional and alternative embodiments, the action figure comprises at least one hinge at the sagittal or coronal plane, which hinge permits 360° rotation to switch the forward-facing element(s). As an example, an action figure representing Wonder Woman® comprises an unarmored representation element and an armored representation element joined by a rotating hinge. During use, the user can reconfigure the action figure by rotating the desired representation to the front or rotating the other representation to the back.

In the embodiments discussed above, the action figures are scale representations of the human form and fictional humanoid characters. These embodiments are only exemplary. In certain embodiments, the action figures are representations of fictional bipedal animal characters, quadrupeds, two-, three-, and four-wheeled conveyances, aircrafts, spacecrafts, birds, and/or dinosaurs, fictional, historical or existing.

In several of the exemplary embodiments above, including the embodiment depicted in FIG. 3, the action figure comprises a stand and is attached at one or more attachment surfaces to the case via a mount. In, for example, the exemplary embodiment of FIG. 3, the stand is detachable and reattachable to the mount, and is further adapted to reconfigure from a low profile attachment configuration to an unattached support configuration with an extended support surface area. In certain embodiments, the action figure is detachable and reattachable from the mount via complementary engagement members on the stand and mount, such as and including complementary male and female elements, magnetic surfaces, and/or via snap- or friction-fit engagement of the stand and mount. In certain other embodiments, such as the exemplary embodiment depicted in FIG. 4A, the action figure is non-detachable from and/or integral with the stand.

In certain embodiments, including the exemplary embodiments above, the action figure is attached to or configured to permit attachment to the stand and/or mount at a bottom end/standing surface/base of the action figure (e.g., the feet). In certain embodiments, the attachment surface is located elsewhere on the action figure, such as, for example, the waist. In certain of these embodiments, the legs and/or feet of the action figure comprise posable joints. In certain embodiments, the action figure comprises two or more attachment surfaces. In certain embodiments, the action figure comprises an attachment surface at a bottom end thereof for use when the case is in the closed configuration, and a second attachment surface elsewhere for optional use when the case is in the open display configuration. In certain embodiments, the second attachment surface is located as appropriate to permit reattachment of to the stand at said surface so that the action figure is generally horizontal and/or parallel to the case or standing surface (e.g., on a ventral surface of the action figure).

In certain embodiments, the stand is extendable and collapsible, such as via a reconfigurable telescoping element or elements, to permit the user to elevate the action figure above the stand. In certain embodiments, the stand comprises an extension, and the action figure is attached to the stand only at the end of the extension. In an exemplary embodiment, the extension is a pillar extending coaxially from the center of the stand to attach to the action figure at the midline or waist thereof. In certain embodiments, the stand comprises a pivot which permits reorientation of the action figure, such as from generally upright/vertical to generally horizontal along the height/length of the action figure. In certain embodiments, the stand is adapted to permit rotation of the action figure about a center axis of the stand. In certain embodiments, the attachment surface of the stand is adapted to permit rotation such that the action figure is rotatable on the attachment surface while attached to the stand.

For example, in an illustrative embodiment, the action figure is a scale representation of a plane and comprises attachment surfaces at the tail end of the plane and a medial region of the underside of the plane as represented, while the stand comprises a telescoping pillar extension, said extension being rotatable about its center axis and comprising at its distal end a pivot hinge. To permit enclosure of the action figure in the case in the closed configuration, the extension is collapsed, the action figure is attached to the stand via the basal attachment surface, and the stand and pivot are rotated such that the action figure is congruent to the case in the closed configuration. In the open display configuration, the action figure can be attached to the stand via the medial attachment surface via the extension pillar in its extended configuration, pivoted such that it is parallel to the standing surface of the stand and/or case, and rotated about the center axis of the stand as desired.

Action Figure Accessories

In certain embodiments of the present disclosure, one or more accessories for the action figure and/or case are provided, the accessories being configured to be connected to the action figure and/or case. In certain embodiments, the action figure (such as at least one element thereof) and case (such as a panel surface thereof) are each configured to permit attachment of the at least one accessory thereto by cooperative engagement. In the exemplary embodiment depicted in FIG. 6, for example, action figure 600 and panel 621 each comprise a plurality of engagement elements 602, 651, 661, all of which are configured to engage complementary elements defined on the accessories. As such, accessories can be attached to and detached from both action figure 600 and panel 621. In certain embodiments, front, rear, and/or side surfaces of the action figure are adapted for accessory engagement, such as by incorporation of engagement elements. Suitable engagement elements include, for example, female engagement elements, permanent magnets, hook-and-loop fasteners, and the like. In certain embodiments, accessory and action figure surfaces are dimensioned to facilitate snap-fit and/or friction fit engagement of the accessories onto the action figure. Suitable accessories include, for example, scale representations of clothing, armor, weaponry, and the like, and combinations thereof.

In the embodiments depicted in the figures, engagement elements for the accessories are provided on interior surfaces of the case in the closed configuration. In certain embodiments, at least one accessory engagement element is provided on an exterior surface of the case. For example, in certain embodiments, accessory engagement elements are provided on the exterior surfaces of the sidewall. In illustrative embodiments, the accessories include wheels which can be attached to the exterior sidewall and/or a connector permitting attachment of the case to a corresponding adjacent case.

Cases

In the exemplary embodiments as depicted and described, the cases have the shape of a rectangular prism in the closed configuration. In certain embodiments, cases having the shape of a right prism (i.e., a polyhedron with congruent n-sided polygonal bases and n rectangular faces joining the bases), such as a right rectangular prism, when closed are provided.

While certain of such embodiments are presently preferred, the present disclosure is not so limited, and additional embodiments according to the present disclosure include cases having different shapes in the closed configuration. For example, in certain embodiments, the cases have the shape of a prism with a regular polygonal base, such as an equilateral triangle, square, or regular hexagon. In certain embodiments of the present disclosure, the cases have, in the closed configuration shapes approximating a rectangular prism but having, for example, beveled or rounded corners. In certain embodiments of the present disclosure, the cases are asymmetrical in the closed configuration. For example, in certain embodiments, the base surfaces of the case in the closed configuration (e.g., the top and bottom covers or aligned panels) are generally rectangular, but have square corners at the ends of one side and beveled corners at the ends of the parallel side. In certain embodiments, including the embodiments depicted in the figures, the case has the shape of a right (or uniform) prism in the closed configuration. In certain embodiments, the cases have the shape of an oblique prism such as a wedge or a parallelepiped. In certain embodiments, the cases have the shape of a triangular prism in the closed configuration. In certain embodiments, the cases have the shape of an object, such as a house or car, in plan view and/or elevation, in the closed configuration.

Representative and illustrative dimensions for the overall and relative dimensions of the cases of the present disclosure are also exemplified by the embodiments depicted in the figures. For example, the length of the case embodiment depicted in FIG. 30 while in the closed configuration is about 3.25 inches. In certain embodiments, the length of the case in its closed configuration is about 1 inch, or about 1.5 inches, or about 2 inches, or 2.5 inches, or about 3 inches, or about 3.5 inches, or about 4 inches, or about 4.5 inches, or about 5 inches, or about 5.5 inches, or about 6 inches, or about 6.5 inches, or about 7 inches, or about 7.5 inches, or about 8 inches, or about 8.5 inches, or about 9 inches, or about 9.5 inches, or about 10 inches, or about 10.5 inches, or about 11 inches, or about 11.5 inches, or about 12 inches, or greater than 12 inches. In certain embodiments of the present disclosure, the case has a length between 1 inch and 3 inches, or between 2 inches and 4 inches, or between 3 inches and 5 inches, or between 1 inch and 6 inches, or between 2 inches and 5 inches, or between 2.5 and 4.5 inches, in the closed configuration. In certain embodiments of the present disclosure, the ratio of the length of the case to the width of the case in the closed configuration is about 1, or about 1.1, or about 1.2, or about 1.3, or about 1.4, or about 1.5, or about 1.6, or about 1.7, or about 1.8, or about 1.9, or about 2, or greater than 2. In certain embodiments, the ratio is 1. In certain embodiments, the ratio is about $\sqrt{2}$. In certain embodiments, the ratio is between 1 and 2, or between 1 and 1.6, or between 1 and $\sqrt{2}$, or between 1 and 1.4. In certain embodiments, the width of the case in its closed configuration is about 0.7 inches, or about 1 inch, or about 1.5 inches, or about 2 inches, or 2.5 inches, or about 3 inches, or about 3.5 inches, or about 4 inches, or about 4.5 inches, or about 5 inches, or about 5.5 inches, or about 6 inches, or about 6.5 inches, or about 7 inches, or about 7.5 inches, or about 8 inches, or about 8.5 inches, or about 9 inches, or about 9.5 inches, or about 10 inches, or about 10.5 inches, or about 11 inches, or about 11.5 inches, or about 12 inches, or greater than 12 inches.

As used herein, the term "about" refers, in the context of dimension, to a range of up to one quarter of an inch more or less than the recited dimension. For example, the term "about 1 inch" means 0.75 inches to 1.25 inches. In the context of a ratio, the term about refers to a range of up to 0.05. For example, in said context, the term "about 1.4" means 1.35 to 1.45. In the context of an angle, the term "about" refers to a range of 15° degrees. For example, "about 90°" refers to a range between 75° and 105°.

In certain embodiments of the present disclosure, the depth of the case in the closed configuration is less than about 6 inches, or less than 3 inches, or less than about 2.5 inches, or less than about 2 inches, or less than about 1.5 inches, or less than about 1 inch, or less than about 0.75 inches, or less than about 0.625 inches, or less than about 0.5 inches, or less than about 0.375 inches, or less than about 0.25 inches. In certain embodiments of the present disclosure, the depth of the case in the closed configuration is between 0.25 inches and 2 inches, or between 0.375 inches and 1.5 inches, or between 0.5 inches and 1.25 inches, or between 0.625 inches and 1 inch, or between 0.25 inches and 1 inch, or between 0.375 inches and 1 inch, or between 0.5 inches and 1 inch, or between 0.25 inches and 0.75 inches, or between 0.25 inches and 0.625 inches, or between 0.375 inches and 0.625 inches. For purpose of illustration, the depth of each of the embodiments depicted in FIG. 29 is about 0.625 inches.

For ease of reference, the dimensions of the articles of the present disclosure are recited in the claims with reference to maximum dimensions. It will be understood from the present disclosure and figures that, for generally flat, polygonal and/or prismatic embodiments, such as generally flat action figures and cases having the shape of a rectangular prism in the closed configuration, the maximum dimensions as recited are the same as the overall dimensions as discussed above.

In the exemplary embodiments depicted in the figures and described above, the cases comprise a plurality of connected exterior panels and a mount, and are adapted to be reversibly transformed between and stably maintain a closed configuration in which the action figure is enclosed within the case and at least one open display configuration in which the action figure is unenclosed by and mounted upon the case. In particular, each panel of the plurality of exterior panels (e.g., three or more panels) is connected along a side thereof to at least one other panel of the plurality. The panels are connected so as to permit rotation and/or translation of the panels relative to the panel(s) to which they are connected to transform the case between its various configurations.

In preferred embodiments, and in the embodiments depicted herein, the cases are adapted to provide a generally flat standing surface in the at least one open display configuration. For example, in the embodiment depicted in FIG. 2, the bottom (or, relative to the closed configuration, interior) surfaces of the sidewall of panel 224 cooperate to provide a flat standing surface beneath the rest of the case in the open display configuration. In use, this standing surface is stably disposed on a corresponding flat surface such as a table or floor (or a gaming board or platform thereon).

In certain embodiments, a panel of the case is disposed behind the action figure in the open display configuration. Such panel, in certain embodiments, is parallel or roughly parallel to the action figure, provides a dioramic display or relief backdrop, and/or comprises a surface adapted for engagement of accessories for the action figure and/or case. In certain embodiments, such as those depicted in FIG. 9 and FIG. 19, a foreground or placard panel is disposed in front of the action figure and oriented at an oblique angle. In certain embodiments, such as those depicted in FIG. 25 and FIG. 29, the panels are arranged in the open display configuration such that the action figure or a portion thereof is displayed without foreground or background.

Preferred embodiments of the present disclosure comprise three exterior panels, four panels, 5 panels, or more. The panels are generally polygonal (e.g., rectangular) in plan view, notwithstanding certain features along one or more sides or corners of the panels, such as rounded corners, hinge offsets, and projections and recesses such as those apparent from FIG. 13 and FIG. 15. In presently preferred embodiments, at least one major surface (i.e., at least one surface defined by the length and width, and not the depth) of the panels is flat, which surface is disposed on the exterior of the case in the closed configuration.

In certain embodiments, the cases further comprise one or more interior panels. Such internal panels are enclosed by the case in the closed configuration, and no surface of such panels defines an exterior surface of the case in the closed configuration. In certain embodiments, one or more interior panels is connected along a side thereof to an exterior panel of the case, such as by a hinge. In certain embodiments, internal panels define an interior compartment and/or provide additional surfaces for engagement of accessories and/or information or illustration. Placard panel 225 of the embodiment depicted in FIG. 2 is a non-limiting example of an interior panel. In certain embodiments, one or more interior panels is double-sided, such that it comprises different illustrations, indicia, and/or surface engagement members on its major surfaces. In certain embodiments, such double-sided interior panels are detachably and reattachably connected to one or more exterior panels, or are detachably and reattachably engaged to an interior surface of the case as defined in the closed configuration, such that the interior panels can be removed and reversed while the case is in an open configuration.

In certain embodiments of the present disclosure, the case comprises in the closed configuration a first cover and a second cover, each cover comprising at least one panel. In certain embodiments, the panels are connected and configured such that two or more panels align to define at least one of the covers of the case (i.e., the sides defined by the length and width of the case) in the closed configuration. For example, in the embodiment depicted in FIG. 4B, the one cover of the case in the closed configuration is defined by panel 421, while the other cover of the case is defined by panels 422 and 423. By way of further example, in the embodiment depicted in FIG. 6, the first cover of the case in the closed configuration is defined by panels 621 and 622, while the second cover of the case is defined by panels 623 and 624. In certain embodiments, the covers are arranged in a clamshell configuration (e.g., are generally congruent) or a matchbook configuration when the case is in the closed configuration.

The cases of the present disclosure, and the component panels thereof, comprise a plurality of surfaces. In particular, the cases and panels comprise surfaces defined by their length and width, length and depth, and width and depth. In certain embodiments, the surfaces of the case defined by its length and width in the closed configuration (e.g., the front and back exterior surfaces of the case) are generally flat, notwithstanding structural features such as seams between connected panels, and comprise illustration and/or printed indicia relating to the action figure enclosed by the case. In certain embodiments, all, or all but one, of the surfaces of the case defined in part by the depth of the case in its closed configuration (e.g., the perimeter surfaces of the case) in its closed configuration are also generally flat.

In presently preferred embodiments, the case comprises at least three exterior panels, each exterior panel being connected along a side thereof to at least one of the other two or more exterior panels, and at least one of the exterior panels being connected to two other exterior panels along parallel sides thereof by panel connectors comprising rotating hinges. For example, in the embodiment of FIG. 4, and as referenced in FIG. 4B, case 420 comprises generally rectangular panels 421, 422, and 423, wherein panel 422 is connected to panel 421 along side 422*a* by rotating hinge 430*a* and connected to panel 423 along side 422*b* by rotating hinge 430*b* and via hinge offset 435 to hinge 430*c* Such arrangement permits reversible transformation of the case between the configurations depicted in FIG. 4A and FIG. 4B. In certain embodiments, including those depicted in the figures, one of said parallel sides of said at least one panel (and the side of the panel to which said side is connected)

defines or extends along an exterior surface of the case in the closed configuration, which exterior surface is defined in by the depth of the case (i.e., is not a surface of the case defined by length and width of the case). In certain such embodiments, the covers of the case are connected by a panel connector comprising a rotating hinge.

In certain embodiments, and as depicted, said parallel sides are parallel to the standing surface of the case (or a supporting surface for same, such as a table) when the case is in the open configuration and disposed thereupon. In such embodiments, the axis of rotation between aforesaid connected panels is disposed horizontally, such that the case folds and unfolds vertically relative to its orientation on the standing surface in the open configuration. In still further preferred embodiments, the mount is disposed adjacent to the panel connector connecting the front and back covers of the case. In alternative embodiments, said parallel sides are perpendicular to the standing surface of the case in the open display configuration. In certain exemplary embodiments, for example, two or more panels are configured as a gate connected along a lateral side of the case or a double door connected along both lateral sides or along the midline of the back cover of the case.

In certain embodiments, including the exemplary embodiments depicted in the figures, the parallel sides of said at one panel define and/or are parallel to a plane defined by the width of the case. In certain other embodiments, said parallel sides define and/or are parallel to a plane defined by the length of the case. These latter embodiments may be preferable for action figures more appropriately displayed in side profile.

In certain embodiments of the present disclosure, at least one panel connector comprises an intermediate structure, such as hinge offset or swivel arm. For example, in the embodiment depicted in FIG. 6, panel 623 is connected to panel 624 via hinge offset 635, which comprises hinges 630*b*, 630*c*. In the embodiment depicted in FIG. 16, panel 1622 is connected to panel 1621 by a composite intermediate structure comprising composite swivel hinge 1630*c* and posts 1655, which posts comprise hinge 1630*b*. The composite swivel comprises swivel arms 1637*a* and 1637*b*, which are connected to each other, and to panel 1621 and post 1655, respectively, by rotating pivot hinges. Said pivot hinges are oriented perpendicular to the standing surface of the case in the open configuration and to the axis of rotation defined by hinges 1630*a* and 1630*b*. As such, the panel connector of the embodiment depicted in FIG. 16 is adapted to permit both rotation and translation of panel 1622 relative to panel 1621.

In certain embodiments, one or more panel connectors is configured to permit rotation about two perpendicular axes of rotation. For example, in certain embodiments, at least a first panel is connected at a midpoint along its length or width to at least a second panel by a pivoting hinge, such as a ball-and-socket joint. In such embodiments, the first panel can be rotated in two planes relative to the second panel.

In certain embodiments, at least one panel connector is configured to permit attachment and detachment of at least one panel connected thereby. For example, in certain embodiments, at least one panel with different illustrations, indicia, and/or surface elements on its two major surfaces is connected via a snap-fit hinge such that the panel can be detached and reattached with either of its major surfaces displayed in an open configuration of the case.

In certain embodiments of the present disclosure, at least one exterior panel comprises a window. In certain embodiments, the window is constructed as an insert formed from a translucent material. In certain embodiments, the window is configured as a subpanel connected to the panel in which it is defined by a hinge or track, such that the window is adapted to be rotated or translated relative to the panel.

The cases of the present disclosure further comprise a sidewall, which sidewall defines the exterior surfaces of the case defined by the depth of the case (e.g., the perimeter surfaces) in its closed configuration. In certain embodiments, exterior surfaces are defined around all or all but one of the perimeter surfaces of the case in the closed configuration to enclose the action figure.

In certain embodiments, the sidewall is defined at least in part by the perimeter surfaces of the panels of the case. In certain embodiments, including the exemplary embodiments depicted herein, the perimeter surfaces of one or more panels of the case are defined by an orthogonally extending panel sidewall at portions of the perimeter of the panel which define the perimeter surfaces of the case in its closed configuration. In certain embodiments, including the embodiments depicted in FIG. 2, FIG. 4, and FIG. 16, the case comprises an intermediate panel connection structure, such as a hinge offset, and the case sidewall is also defined in part by such intermediate structure. In certain embodiments, the sidewall of the panel(s) to be disposed underneath the action figure when the case is in an open display configuration are configured to provide a stable standing surface for the case and action figure. In certain embodiments in which the case has the shape of an oblique prism in the closed configuration, the perimeter sidewall is defined at an oblique angle at two or more parallel sides of the case. In certain embodiments, the case comprises at least one sidewall panel, which panel is connected along a side thereof to another panel of the case. For example, in certain embodiments the top end of the case in the closed configuration is defined by a sidewall panel connected by a rotating hinge to another panel of the case.

In certain embodiments, including those depicted herein, the case is configured such that the various elements defining the sidewall (e.g., panel sidewall(s) and intermediate panel connection structures) abut. As such, in certain embodiments, the panel sidewall of one or more panels extends along only a portion of one or more perimeter sides. In the exemplary embodiment depicted in FIG. 4, for example, the sidewall of panel 423 does not extend along the entire length of the sides of the panel. In certain embodiments, one or more portions of the sidewall of one or more panels is discontinuous, such that, for example, facing sidewall portions interdigitate when the case is in the closed configuration. In certain embodiments, facing panel sidewalls abut when the case is in the closed configuration. In certain embodiments, the panels are dimensioned such that one or more panels is enclosed at least in part within the sidewall of the facing panel when the case is in its closed configuration.

In certain embodiments, a panel sidewall comprises one or more structural elements defined on the interior, exterior, and/or top surfaces of the sidewall. For example, in the exemplary embodiment depicted in FIG. 6A, panel sidewall 650 comprises a number of engagement elements 651 defined on the interior surface of the sidewall, and further comprises finger groove 652 to facilitate case opening. By way of further example, in the illustrative embodiment depicted in FIG. 4, panel sidewalls 450 define a portion of hinges 430, and are formed with two connected parallel walls sandwiching offset 435. Accordingly, in certain embodiments, one or more panel connectors are defined in the panel sidewall. It should be noted, however, that in certain of these and other embodiments, one or more panel connectors is inset from the sidewall, one exemplary such embodiment being depicted in FIG. 30.

In certain embodiments, the sidewall of one or more panels provides a point or surface of attachment or engagement for one or more internal panels. In certain embodiments, an internal panel is connected to a panel sidewall by a hinge having an axis of rotation perpendicular to or parallel to the axis of rotation defined by the hinges connecting exterior panels of the case. For example, in certain embodiments in which a rear panel is disposed upright behind the action figure in the open display configuration, the case comprises an interior panel attached to the sidewall of the rear panel by a rotating hinge. In certain of such embodiments, one or more interior panels is attached to the rear panel along a lateral surface (or the lateral surfaces) thereof such that the interior panel reversibly rotates therealong. In certain embodiments, two interior panels are connected along parallel sides of a panel sidewall to form a gate. In certain of these embodiments, the opposing interior panels are configured to interlock or interdigitate.

In certain embodiments, the case comprises a track or guide surface defined between overlapping panels of the case to permit axial translation therealong. In certain embodiments, the mount is disposed on a track or guide surface. In certain embodiments, the track comprises a pair of grooves or recesses defined along opposing surfaces of a panel, such as facing lateral panel sidewall surfaces, a panel connector, such as a hinge offset, and/or a component of the mount. In certain embodiments, the case is configured such that one or more panels can be translated relative to an overlapping panel along the portion of overlap.

In certain embodiments of the present disclosure, the case comprises elements configured to retain the case in its closed configuration and/or elements configured to facilitate opening of the case from its closed configuration. In certain embodiments, the case comprises closure elements configured to cooperatively engage to retain the closed configuration of the case until disengaged. For example, in certain embodiments, the case includes a first panel comprising a projecting surface, such as a tongue, and a second panel which comprises a complementary surface for the projecting surface, such as a groove. The case is configured such that the tongue and groove are brought into engagement by closure of the case. Once engaged, the closure elements exert force against each other, such as elastic and/or frictional force, thereby retaining the closed configuration until sufficient force (e.g., torque) is applied to disengage the elements. In the exemplary embodiment depicted in FIG. 4A, closure elements 481 are provided as surfaces projecting from panel 421. Although not specifically illustrated, panel 423 comprises complementary closure elements at corresponding locations on the panel.

In these and other embodiments, including the exemplary embodiments depicted in FIG. 4 and FIG. 6, the case comprises a surface configured to permit manual application of torque, such as a finger groove, to facilitate separation (e.g., disengagement) of the panels of the case in the closed configuration.

The articles and cases of the present disclosure further comprise a mount for the action figure, which mount is attached to or configured for attachment to the action figure and to the case, and which mount is connected to the case such that one or more panels of the case is rotated and/or translated relative to the mount during transformation between the closed configuration and the at least one display configuration.

In certain embodiments, including the exemplary embodiment of FIG. 4, the mount is integral with or fixedly attached to a single panel of the case. In the embodiment depicted in FIG. 4A, panel 421 is connected to panel 422 via mount 440, which is connected in turn to panel connector (i.e., hinge) 430.

In certain embodiments, the mount comprises a mount connection, which connection is integral with or connected a panel and/or a panel connector, such as a panel connector connecting panels at the bottom end of the case in the closed configuration. In the exemplary embodiment depicted in FIG. 4A, mount 440 is integral with panel 421, and is connected to hinge 430*a* by mount connection 440*a*, configured as a knuckle for the hinge. In the exemplary embodiment depicted in FIG. 9, mount 940 is integral with pin 930*a* of hinge 930, which connects panels 922 and 923 via knuckles 922*a*, 923*a* defined therein.

In certain embodiments, the mount connection is configured to permit rotation and/or translation of the mount relative to the panel connection and/or panel to which it is attached. In the embodiment depicted in FIG. 4, for example, mount connection is configured to permit rotation of mount 440 and panel 421 about hinge 430 and relative to panel 422. By way of further example, in the embodiment depicted in FIG. 16, the connections of mount 1610 to swivel arms 1637*a*, 1637*b* are configured to permit rotation of the swivel arms relative to the mount and/or panels 1621 and 1622 (via sidewall posts 1655), thereby translating and rotating the mount relative to the panels.

In certain embodiments, the mount is oriented to support the action figure and/or stand in an orientation perpendicular to, or generally perpendicular to, the standing surface of the case when in the open display configuration, and in an orientation parallel to, or generally parallel to, the panels of the case in the closed configuration. In certain embodiments, the mount is fixed upon the case. In certain embodiments, the mount is disposed on and rotatable about a hinge. In certain embodiments, elements of the mount and/or one or more panels are configured to confine or prevent rotation of the mount relative to the panel connection to which the mount is connected (or which is defined in part by the mount).

In certain embodiments, the mount comprises additional features configured to permit reorientation of the action figure relative to the case while the action figure is connected thereto, such as a riser, extension, or swivel. In certain embodiments, the mount is collapsible and expandable, such as by folding and unfolding components thereof, to permit the user to elevate the action figure relative to the case in the open display configuration.

In certain embodiments, including, for example, the exemplary embodiments of FIG. 4 and FIG. 6, the action figure and the mount, or a portion of the mount are integral and/or fixedly attached. In certain other embodiments, including, for example, the exemplary embodiment of FIG. 8, the mount is configured for cooperative engagement with the action figure, or, if applicable, an action figure stand, and/or the action figure is detachable from and reattachable to the mount. For example, in the illustrative embodiment depicted in FIG. 2, the mount comprises engagement elements 241, configured as male engagement members adapted to matingly engage with corresponding female engagement members on the action figure and/or stand to permit attachment and detachment from the mount.

In certain embodiments, the case comprises two or more mounts. For example, in certain embodiments, the case comprises a first mount disposed over a hinge connecting the front and back covers of the case and a second mount disposed on an interior surface of an exterior panel when the case is in the closed configuration. In such embodiments, the action figure and case are adapted such that the action figure can be reversibly attached and detached from the mounts when the case is in an open configuration.

Electronic Immersive Elements

The action figures, cases, and/or accessories of the present disclosure comprise, in certain embodiments, electronic immersive elements, such as electronic media. In certain embodiments, for example, at least one of the case, action figure, or an accessory comprises one or more light-emitting diodes, audio transducers or speakers, or video screens, as well as a power source in electrical communication with same. In certain embodiments, one or more interfaces for said immersive elements, such as a switch, console, or graphical interface is also provided to permit user interaction and control of such immersive elements. Certain embodiments, for example, comprise an integrated circuit and/or computer readable media, such as non-transitory computer readable media, having computer-readable instructions operably connected to at least one immersive element and/or interface.

Certain embodiments additionally or alternatively comprise elements for detecting and/or transmitting radiofrequency or electromagnetic signals (e.g., radiofrequency identification tags, nearfield communication tags, Bluetooth transmitters, wi-fi transmitters, antennae, induction coils, and the like). Said signals communicate, for example, information concerning the presence of one or more action figures, the engagement of one or more accessories thereto, and/or an outcome of simulated and/or rules-based interactions of two or more action figures in a gaming environment. Such information is communicated, in certain exemplary embodiments, to a video game console, a personal, laptop, or tablet computer, a cellular phone, and/or a dedicated interface, such elements being components, in certain embodiments, of systems and kits of the present disclosure, as discussed below. In certain embodiments, a circuit is closed when the case is transformed to the open configuration, such that one or more electronic immersive elements is activated.

Combinations, Systems, and Kits

The present disclosure, in certain embodiments, provides action figures, accessories, and/or cases as exemplified herein, as well as combinations of same. The present disclosure further provides, in certain embodiments, kits and systems comprising and/or related to same.

For example, certain embodiments provide a case and an action figure, wherein the case is provided in its closed configuration with the action figure connected to and enclosed within the case. In certain of these exemplary embodiments, at least one accessory is also provided, wherein the at least one accessory is attached to the case or the action figure as provided. Certain of such embodiments are provided (e.g., distributed and/or marketed) individually, and certain of such embodiments are provided in groups or combinations, such as sets, packs, and collections.

In certain embodiments, one or more cases is provided independently of an action figure and/or accessories, such as for purpose of replacement, substitution, or upgrade. Similarly, in certain embodiments, one or more action figures is provided independently, and in certain embodiments, one or more accessories is provided independently. In certain embodiments, a plurality of interchangeable action figures is provided with a generic case, which action figures and case are configured for cooperative engagement. In certain embodiments, a plurality of interchangeable accessories is provided.

As exemplified herein, the present disclosure provides articles of entertainment consisting of or comprising mutually complementary action figures, cases, and accessories therefor. Accordingly, in certain embodiments, an article of entertainment comprising a case and an action figure is provided, which action figure and case are mutually complementary. In certain embodiments, these articles further comprise at least one accessory as described.

In certain embodiments, one or more elements or components is configured to permit integration of two or more such articles. For example, in certain embodiments, at least one panel or case surface is configured to connect to a similarly configured case when the cases are in an open display configuration, such as by complementary engagement via male and female engagement members, interlocking or magnetic panel surfaces, and the like, and combinations thereof. In certain exemplary embodiments, the articles comprise one or more accessories configured to connect two or more action figures or cases, such as by complementary engagement. Accordingly, in certain embodiments of the present disclosure, the articles are connected and/or configured to be connected.

In certain embodiments, two or more cases having different shapes and/or dimensions are provided, wherein the cases are adapted to connect to each other. In certain illustrative embodiments, for example, two cases are provided, one having a rectangular shape and the other having the shape of a triangle in plan or elevation view. The cases are configured for complementary engagement such that the bottom side of the triangle or parallelogram rests on the top end of the rectangle, such that when engaged, the combined article has the shape of a house. In related embodiments, the combined article has the shape of a car, truck, robot, or dinosaur, for example.

Certain embodiments include environmental accessories configured to contain and/or hold at least one case and/or action figure. Such accessories, in certain embodiments, are not configured for storage within the case in the closed configuration. For example, in certain embodiments, one or more accessories having the shape of a vehicle, such as a car or tank, or a portion thereof, is provided. The accessory contains an inner recess configured to hold a case in one or more configurations, and/or a mount for an action figure according to the present disclosure. In certain embodiments, one or more environmental accessories as described is provided separately. In certain embodiments, one or more environmental accessories having the shape of a house, building, or landscape is provided.

In certain embodiments, the case comprises one or more engagement elements adapted to facilitate connection to another case and/or accessory, such as an environmental accessory. For example, in certain embodiments, one or more panels of the case comprises a recess adapted to engage a complementary engagement member. In certain embodiments, the cases further comprise on one or more panels a complementary engagement member for engaging corresponding protrusions of similarly adapted cases. In certain embodiments, the environmental accessories comprise a complementary engagement member for engaging such recess, so as to maintain engagement between case and accessory until manually disengaged by the user. In certain embodiments, the engagement members are concealable and/or deployable, such as by sliding, rotating, or pressing the surface of such engagement member to configure same for engagement to another case or accessory.

Accordingly, in certain embodiments of the present disclosure, articles comprising a plurality of cases, action figures, and accessories therefor are provided, which cases, action figures, and accessories can be connected and/or combined to create a composite article and/or physical environment, such as landscape and/or scenery, therefor. For example, in certain embodiments, the articles comprise one or more of complementarily engaging cases, interior panels, removable panels, connection accessories, exterior case accessories, and/or illustrated mats and/or backdrops which are scored and/or prefolded to permit refolding and storage within the case in the closed configuration. In certain embodiments, accessories for storing and transporting the articles of the present disclosure are provided, including binders, bags, belts, and boxes containing a plurality of compartments configured to complement and securely contain individual cases and accessories as exemplified herein.

Virtual Interaction

The present disclosure further provides, in certain embodiments, one or more elements relating the articles to each other and/or to a virtual environment, such as a set of rules or a software environment. For example, certain embodiments, including the embodiments depicted in FIG. 29, comprise a surface, such as a placard panel, displaying indicia identifying the character represented and one or more relative attributes of the represented character when the case is in an open display configuration. Such attributes, in certain embodiments, permit incorporation and/or interrelation of the articles in a gaming environment, such as a rules-based strategy game. In certain embodiments, the articles comprise at least one element providing signal-based identification and/or interrelation of the articles and a virtual environment, such as an integrated circuit with hardwired output, RFID or nearfield communication tag, Bluetooth transmitter, Wi-Fi output, or image recognition data protocol compatible element. For example, in certain embodiments, the articles comprise a signal output selected from an RFID tag, nearfield communication tag, and a Bluetooth transmitter. The articles and systems of the present disclosure are likewise compatible with outputs employing other signalling protocols.

The present disclosure further provides, in certain embodiments, devices, components, processors, media, and products configured to physically and/or virtually integrate one or more articles as described herein into an environment, such as a game, and systems comprising same. For example, in certain embodiments, a system comprising at least one article as exemplified herein is provided with one or more of a game board, a rulebook, a user interface, and/or nontransitory computer readable media. In certain exemplary embodiments, the game board comprises one or more insets, risers, and/or tracks configured to engage a case and/or action figure of the present disclosure. In certain embodiments, the game board comprises one or more power sources and/or one or more inputs to and/or outputs from a central processor or integrated circuit, which sources, inputs and/or outputs are adapted to be operably connected to corresponding elements of cases and/or action figures as provided herein.

In certain exemplary embodiments, the user interface comprises one or more of a randomizer, such as a wheel or die, and/or a scorekeeping implement, such as an abacus.

In certain embodiments, the user interface is digital and/or graphical. In certain embodiments, the user interface is operably linked to one or more elements of the case or panel. For example, in certain embodiments, the case comprises a video screen and/or at least one of the case and action figure comprises an LED array. In certain embodiments, the user interface is operably linked to an integrated circuit or central processor and nontransitory computer readable media having a set of executable instructions for integrating at least one article of the present disclosure into a video game.

Certain embodiments are configured such that, in operation, one or more articles, and/or the configurations thereof and/or engagements therebetween are identified by, for example, digital electronic and/or radiofrequency signals transmitted to a signal detector associated with a central processor. The central processor is operably linked to nontransitory computer readable media having a set of executable instructions for integrating these identities in a virtual environment and outputting the outcomes of interactions in the environment. Certain articles and systems according to the present disclosure are compatible and configured for use with a personal computer, portable electronic device, video gaming console and/or toys-to-life technology platform and comprise software for such use.

Production, Manufacture, and Assembly

The action figures, cases, and accessories of the present disclosure are made from any suitable materials. In preferred embodiments, the articles of the present disclosure are made from durable materials with an elastic modulus sufficient to prevent unwanted deformation during intended use. In certain embodiments, the articles of the present disclosure are composed of one or more plastics, including, for example, polyethylene (e.g., high-density polyethylene, medium-density polyethylene, low-density polyethylene, high and ultra-high molecular weight polyethylene, and polyethylene terephthalate), polypropylene, polystyrene (e.g., acrylonitrile butadiene styrene), polyamide, polylactic acid, polysiloxane, and polyvinyl chloride, one or more metals, metal oxides, and metal alloys, and/or wood. Articles of the present disclosure, including components thereof, such as action figure elements and case panels, are produced, in certain embodiments, by injection molding, extrusion, stamping, and/or three-dimensional printing.

The present disclosure further provides, in certain embodiments, systems and kits for the production, manufacture, and/or assembly of the cases, action figures, and accessories embodied herein. For example, in certain embodiments, a kit comprising one or more preassembled cases, action figures, and/or accessories is provided. In certain embodiments, such kits are provided with, for example, printed assembly instructions, templates, blank labels, and the like.

In certain embodiments, at least one mold for the production of, e.g., case panels, action figure elements, accessories, and/or additional components of the articles exemplified herein in provided. In certain embodiments, specifications and/or templates for production of the articles embodied herein are provided. For example, in certain embodiments, nontransitory computer readable media having executable instructions for automated production of the articles embodied herein (and/or their component parts), such as by injection molding, extrusion, stamping, and/or three-dimensional printing, are provided. In certain embodiments, nontransitory computer-readable media having executable instructions for automated assembly and/or packaging are provided.

Representative Embodiment

Embodiment 1

An article of entertainment comprising an action figure and a case therefor, wherein the case comprises a mount for attachment of the action figure, and wherein the case is adapted, while the action figure is attached to the mount, to stably assume and reversibly transform between a closed configuration in which the action figure is enclosed within the case and at least one open display configuration in which the action figure is unenclosed by and displayed upon the case.

Embodiment 2

The article of embodiment 1, wherein, in the open display configuration, the case comprises a standing surface and the action figure is generally perpendicular to the standing surface.

Embodiment 3

The article of embodiment 1 or embodiment 2, wherein the case comprises a plurality of generally polygonal panels.

Embodiment 4

The article of any of the preceding embodiments, wherein the case comprises a plurality of panel connectors are adapted to permit relative rotation and/or translation of the panels connected thereby.

Embodiment 5

The article of any of the preceding embodiments, wherein the case has the shape of a rectangular prism in the closed configuration.

Embodiment 6

The article of embodiment 5, wherein the panels are generally rectangular.

Embodiment 7

The article of any of the preceding embodiments, further comprising an action figure accessory, wherein the action figure accessory and at least one surface of the action figure and/or the case are adapted for complementary engagement.

Embodiment 8

The article of any of the preceding embodiments, wherein the action figure comprises a plurality of elements connected by posable joints.

Embodiment 9

The article of any of the preceding embodiments, wherein the action figure is adapted to be reversibly detached from and attached to the mount.

Embodiment 10

The article of any of the preceding embodiments, wherein the action figure comprises a stand adapted to be reversibly detached from and attached to the mount and adapted to stably assume and reversibly transform between an attachment configuration in which the mount is collapsed and a detachment configuration in which the mount is expanded to provide an expanded standing surface for the action figure.

Embodiment 11

The article of any of the preceding embodiments, wherein the action figure is generally flat and has a maximum depth of half an inch or less.

Embodiment 12

The article of any of the preceding embodiments, wherein the case has a maximum depth of one inch or less in the closed configuration.

Embodiment 13

The article of any of the preceding embodiments, wherein the case has a maximum length between about 2.5 inches and about 5.75 inches.

Embodiment 14

The article of any of the preceding embodiments, wherein a ratio of a maximum length of the case to a maximum width of the case in the closed configuration is between 1 and 2.

Embodiment 15

The article of any of the proceeding embodiments, wherein a plurality of surfaces of the case comprise illustration and/or information, and wherein the action figure and said surfaces are aligned in the open display configuration.

Embodiment 16

The article of any of the preceding embodiments, wherein the case comprises a plurality of exterior panels and panel connectors, and wherein: each exterior panel is generally rectangular and is connected by a panel connector to at least one other exterior panel; each panel connector connects one side of one exterior panel to one side of another exterior panel; at least one exterior panel has two sides which are parallel to one another and to a plane defining a maximum width or length of the case in the closed configuration; each of said parallel sides of said at least one exterior panel is connected to another exterior panel by a panel connector; and each panel connector is adapted to permit rotation about and/or translation along a single axis or perpendicular axes defined thereby.

Embodiment 17

The article of embodiment 16, wherein the case comprises three or more exterior panels.

Embodiment 18

The article of embodiments 16-17, wherein each panel connector comprises a hinge.

Embodiment 19

The article of embodiments 16-18, wherein at least one panel connector comprises an intermediate structure.

Embodiment 20

The article of embodiments 16-19, wherein at least one panel comprises a panel sidewall along at least a portion of a perimeter of the panel.

Embodiment 21

The article of embodiments 16-20, wherein at least one exterior panel is rotated about 270° during transformation between the closed configuration and the at least one open display configuration.

Embodiment 22

The article of embodiments 16-21, wherein the case comprises a first exterior panel, a second exterior panel, and a third exterior panel, the second exterior panel is connected to the first exterior panel by a first panel connector comprising a first hinge defining a first axis of rotation, the second exterior panel is connected to the third exterior panel by a second panel connector comprising a second hinge defining a second axis of rotation, and the first axis of rotation is parallel to the second axis of rotation.

Embodiment 23

The article of embodiment 22, wherein the second exterior panel is rotated about 90° about the first hinge relative to the first exterior panel and the third exterior panel is rotated about 180° about the second hinge relative to the second exterior panel during transformation between the closed configuration and the at least one open configuration.

Embodiment 24

The article of embodiment 22, wherein the second exterior panel is rotated about 135° about the first hinge relative to the first exterior panel and the third exterior panel is rotated about 135° about the second hinge relative to the second exterior panel during transformation between the closed configuration and the at least one open configuration.

Embodiment 25

The article of embodiments 16-24, further comprising at least one interior panel connected to an exterior panel by a panel connector.

Embodiment 26

The article of embodiment 25, wherein the at least one interior panel includes a placard panel.

Embodiment 27

The article of embodiments 25-26, wherein the at least one interior panel includes a panel connected to an exterior panel by a swivel or pivot.

Embodiment 28

The article of any of the preceding embodiments, wherein the mount is connected to the case by a mount connection.

Embodiment 29

The article of embodiment 28, wherein the mount connection comprises a hinge connected to a panel connector.

Embodiment 30

The article of embodiments 16-29, wherein at least one panel connector comprises a swivel.

Embodiment 31

The article of embodiments 22-30, wherein the first panel connector comprises a swivel.

Embodiment 32

The article of embodiments 3-31, wherein at least one panel comprises a sidewall.

Embodiment 33

The article of any of the preceding embodiments, wherein the article comprises a power source and one or more electronic immersive elements.

Embodiment 34

An article of any of the preceding embodiments, wherein the article comprises a signal output.

Embodiment 35

The article of embodiment 34, wherein the signal output is selected from the group consisting of an RFID tag, nearfield communication tag, and Bluetooth transmitter.

Embodiment 36

A system comprising an article of any of the preceding embodiments and a game board configured to engage the article.

Embodiment 37

A system comprising an article of embodiment 34 or 35, a signal detector, nontransitory computer readable media, a central processor, and a user interface, wherein the signal detector is configured to identify the signal output from the article and the nontransitory computer readable media has instructions for integrating the identity of the signal into a virtual environment.

Embodiment 38

The system of embodiment 37, wherein the system is a video gaming system.

The embodiments, details, and descriptions provided and depicted herein are nonlimiting and are provided for purpose of illustration only. Articles of entertainment, systems and kits comprising same, and combinations thereof according to the present disclosure are further exemplified in the claims below.

What is presently claimed is:

1. An article of entertainment comprising an action figure and a case therefor, the case comprising:

a mount for attachment of the action figure; a plurality of generally rectangular panels including exterior panels consisting of a first exterior panel, a second exterior panel, and a third exterior panel; and a plurality of panel connectors including a first panel connector comprising a first hinge defining a first axis of rotation and a second panel connector comprising a second hinge defining a second axis of rotation which is parallel to the first axis of rotation;

wherein the case is adapted, while the action figure is attached to the mount, to stably assume and reversibly transform between a closed configuration in which the case has the shape of a rectangular prism and the action figure is enclosed within the case, and at least one open display configuration in which the case defines a standing surface and the action figure is generally perpendicular to the standing surface and unenclosed by and displayed upon the case;

and further wherein at least one exterior panel is rotated about 270° during transformation between the closed configuration and the at least one open display configuration, wherein the second exterior panel is rotated about 90° about the first hinge relative to the first exterior panel and the third exterior panel is rotated about 180° about the second hinge relative to the second exterior panel during transformation between the closed configuration and the at least one open configuration.

2. The article of claim 1, wherein the action figure comprises a stand adapted to be reversibly detached from and attached to the mount and adapted to stably assume and reversibly transform between an attachment configuration in which the mount is collapsed and a detachment configuration in which the mount is expanded to provide an expanded standing surface for the action figure.

3. The article of claim 1, wherein the action figure is generally flat and has a maximum depth of half an inch or less, the case has a maximum depth of one inch or less in the closed configuration, the case has a maximum length between about 2.5 inches and about 5.75 inches, and a ratio of a maximum length of the case to a maximum width of the case in the closed configuration is between 1 and 2.

4. The article of claim 1, wherein at least one panel connector comprises an intermediate structure, and at least one panel comprises a panel sidewall along at least a portion of a perimeter of the panel.

5. The article of claim 1, further comprising at least one interior panel connected to an exterior panel by a panel connector.

6. The article of claim 5, wherein the interior panel includes a placard panel.

7. The article of claim 1, wherein the mount is connected to the case by a mount connection comprising a hinge connected to a panel connector.

8. The article of claim 1, wherein the first hinge comprises a spring and male and female connecting elements defined in the first exterior panel and second exterior panel.

9. An article of entertainment comprising an action figure and a case therefor, the case comprising:

a mount for attachment of the action figure; a plurality of generally rectangular panels including exterior panels consisting of a first exterior panel, a second exterior panel, and a third exterior panel; and a plurality of panel connectors including a first panel connector comprising a first hinge defining a first axis of rotation and a second panel connector comprising a second hinge defining a second axis of rotation which is parallel to the first axis of rotation;

wherein the case is adapted, while the action figure is attached to the mount, to stably assume and reversibly transform between a closed configuration in which the case has the shape of a rectangular prism and the action figure is enclosed within the case, and at least one open display configuration in which the case defines a standing surface and the action figure is generally perpendicular to the standing surface and unenclosed by and displayed upon the case;

and further wherein at least one exterior panel is rotated about 270° during transformation between the closed configuration and the at least one open display configuration, wherein the second exterior panel is rotated about 135° about the first hinge relative to the first exterior panel and the third exterior panel is rotated about 135° about the second hinge relative to the second exterior panel during transformation between the closed configuration and the at least one open configuration.

10. The article of claim 9, wherein the first hinge comprises a spring and male and female connecting elements defined in the first exterior panel and second exterior panel.

11. The article of claim 9, wherein the action figure comprises a stand adapted to be reversibly detached from and attached to the mount and adapted to stably assume and reversibly transform between an attachment configuration in which the mount is collapsed and a detachment configuration in which the mount is expanded to provide an expanded standing surface for the action figure.

12. The article of claim 9, wherein the action figure is generally flat and has a maximum depth of half an inch or less, the case has a maximum depth of one inch or less in the closed configuration, the case has a maximum length between about 2.5 inches and about 5.75 inches, and a ratio of a maximum length of the case to a maximum width of the case in the closed configuration is between 1 and 2.

13. The article of claim 9, wherein at least one panel connector comprises an intermediate structure, and at least one panel comprises a panel sidewall along at least a portion of a perimeter of the panel.

14. The article of claim 9, further comprising at least one interior panel connected to an exterior panel by a panel connector.

15. The article of claim 9, wherein the mount is connected to the case by a mount connection comprising a hinge connected to a panel connector.

16. The article of claim 15, wherein the interior panel includes a placard panel.

* * * * *